US011178491B2

(12) United States Patent
Huang

(10) Patent No.: US 11,178,491 B2
(45) **Date of Patent: *Nov. 16, 2021**

(54) RADIATION DEVICE AND DUAL SUSPENSION EDGE LOUDSPEAKER, LOUDSPEAKER BOX, AND APPLICATION THEREOF

(71) Applicant: TANG BAND IND CO., LTD., Ningbo (CN)

(72) Inventor: Hsin Min Huang, Ningbo (CN)

(73) Assignee: TANG BAND IND CO., LTD., Ningbo (CN)

( * ) Notice: Subject to any disclaimer, the term of this patent is extended or adjusted under 35 U.S.C. 154(b) by 0 days.

This patent is subject to a terminal disclaimer.

(21) Appl. No.: 16/871,061

(22) Filed: May 11, 2020

(65) Prior Publication Data

US 2020/0275210 A1 Aug. 27, 2020

Related U.S. Application Data

(63) Continuation of application No. 16/302,669, filed on Nov. 18, 2018, now Pat. No. 10,694,293.

(51) Int. Cl.

| | |
|---|---|
| ***H04R 7/18*** | (2006.01) |
| ***H04R 1/02*** | (2006.01) |
| ***H04R 1/28*** | (2006.01) |
| ***H04R 7/12*** | (2006.01) |
| ***H04R 9/06*** | (2006.01) |
| ***H04R 31/00*** | (2006.01) |
| ***H04R 9/02*** | (2006.01) |

(52) U.S. Cl.

CPC ..... *H04R 7/18* (2013.01); *H04R 1/025* (2013.01); *H04R 1/2834* (2013.01); *H04R 7/12* (2013.01); *H04R 9/025* (2013.01); *H04R 9/06* (2013.01); *H04R 31/00* (2013.01); *H04R 31/003* (2013.01); *H04R 2400/11* (2013.01)

(58) Field of Classification Search

CPC ..... H04R 7/18; H04R 7/12; H04R 31/003; H04R 2400/11; H04R 1/025; H04R 1/2834; H04R 9/025; H04R 9/06

USPC ..... 381/335, 342, 347, 348, 124

See application file for complete search history.

(56) References Cited

U.S. PATENT DOCUMENTS

2006/0280330 A1* 12/2006 Watanabe ..... H04R 9/022 381/397

2010/0215207 A1* 8/2010 Funahashi ..... H04R 9/043 381/400

* cited by examiner

*Primary Examiner* — William A Jerez Lora

(74) *Attorney, Agent, or Firm* — Raymond Y. Chan; David and Raymond Patent Firm

(57) ABSTRACT

A dual suspension edge member structure for a radiation device, a dual suspension edge loudspeaker and a loudspeaker box. The radiation device comprises an outer supporting frame, a vibration element, a first suspension edge member extending between the vibration element and the outer supporting frame, an inner frame connected to the vibration element, an outer holding frame, and a second suspension edge member connected between the inner frame and the outer holding frame. The dual suspension edge member structure of the radiation device for making the dual suspension edge loudspeaker or loudspeaker box prevents shaking and shifting of the vibration element to improve the sound effect quality.

18 Claims, 31 Drawing Sheets

RADIATION DEVICE AND DUAL SUSPENSION EDGE LOUDSPEAKER, LOUDSPEAKER BOX, AND APPLICATION THEREOF

CROSS REFERENCE OF RELATED APPLICATION

This application is a Continuation application that claims the benefit of priority under 35 U.S.C. § 120 to a non-provisional application, application Ser. No. 16/302,669, filed Nov. 18, 2018, which is incorporated herewith by reference in its entity.

BACKGROUND OF THE PRESENT INVENTION

Field of Invention

The present invention relates to the field of acoustics device, and more particularly to a radiation device and dual suspension edge loudspeaker, loudspeaker box, and application thereof, wherein the radiation device is for enhancing the sound quality of loudspeaker and loudspeaker box.

Description of Related Arts

Music has always been an indispensable and important part of human life. Acoustics device has been a significant medium for playing music.

As various audio technologies have been continuously developed and people's material living standard has risen, more people have paid increasing attention on their artistic and spiritual quality and music has been an important approach to achieve that. Music is composed by syllables of various frequencies, where the higher frequency demonstrates the resounding part of the sound while the lower frequency reflects the depth of the sound. Hence, both high and low frequencies are critical portions for ideally reproducing sound for an acoustics device.

Sound transmission relies on vibration responding and the responding is weaker when the frequency of the sound is lower. As a result, it is difficult for most acoustics devices to reproduce low-frequency sound. However, most consumers in the modern society have been discontent with simple vast high-pitched sound, but demanding more on bass as well as exquisite performance.

Conventional acoustics device with bass effect usually has a planar passive member, so as to reproduce bass through the response of the passive member. The passive member usually includes a bracket, a suspension edge member, and a vibrating diaphragm, while the inner vibrating diaphragm is connected to the outer bracket through the ring-shape suspension edge member. The passive member cooperates with a speaker unit to form an acoustics device, such that when the speaker unit produces sound, the passive member can respond to its low frequency sound wave, so as to reinforce the weaker low-frequency sound and make it hearable.

Nonetheless, the quality of the sound effect and the strength of the response depend on the vibration performance of the vibrating diaphragm to certain extent. In other words, it is related to factors like softness and thickness of the vibrating diaphragm. Unfortunately, since the vibrating diaphragm is only affixed by one suspension edge member, the area of the conventional passive member is limited in smaller size. Besides, when the vibrating diaphragm is reciprocatingly vibrating, it will create an interacting force between the vibrating diaphragm and the suspension edge member. Therefore, the thickness of the vibrating diaphragm has to be relatively thick enough to bear the impact of such force. Nevertheless, factors like increasing the thickness and mass of the vibration diaphragm will render a larger inertia of the entire vibrating board that weakens its ability to respond to low frequency sound. As a result, its performance in bass reproduction will not be very good.

Besides, the conventional passive member with single suspension edge member, as illustrated in FIG. 1, only includes a vibration diaphragm 1 in the middle and a surrounding suspension edge member 2. If it aims to provide a better bass, it has to reduce the thickness of the vibrating diaphragm or utilize a softer material thereof correspondingly and, unfortunately, such vibrating diaphragm will then generate noise sounded "papa . . . " due to the inconsistent vibration of the vibrating diaphragm. Therefore, the structure of conventional passive member does not allow blind reduction of the thickness or usage of softer material for the vibrating diaphragm.

Moreover, the suspension edge member is adapted to stabilize and cushion the vibrating diaphragm. That is force generated in the vibration process of the vibrating diaphragm can be gradually cushioned and transferred to the bracket through the suspension edge member, such that the bracket will not move along with the vibrating diaphragm. Similarly, the conventional suspension edge member also requires to be made by relatively thicker and harder material so as to ensure smaller amplitude of the vibration of the vibrating diaphragm, but it is not conducive to the enhancement of the bass effect.

SUMMARY OF THE PRESENT INVENTION

An object of the present invention is to provide a radiation device and dual suspension edge loudspeaker, and loudspeaker box thereof, wherein the radiation device comprises a vibration assembly, which comprises a vibration element being supported and arranged is such a manner that the vibration element can be made thinner and capable of producing larger vibration amplitude to enhance the bass effect thereof.

An object of the present invention is to provide a loudspeaker box and its radiation device and dual suspension edge loudspeaker, wherein the radiation device of the dual suspension edge loudspeaker comprises a first suspension edge member and a second suspension edge member, wherein each of the two suspension edge members has an arch structure and an opening where the two openings of the first and second suspension edge members are arranged facing opposite directions, so as to utilize the mechanical characteristics of the arch structure to cushion the pulling force generated during the vibration of the vibration element.

An object of the present invention is to provide a loudspeaker box and its radiation device and dual suspension edge loudspeaker, wherein the loudspeaker box has at least a passive vibration unit which can prevent the loudspeaker box from undesirable and bad situation, such as shaking and etc., while the passive vibration unit is enhancing the low-frequency sound effect of the loudspeaker box, so as to produce purer sound by the loudspeaker box.

An object of the present invention is to provide a radiation device and dual suspension edge loudspeaker, and loudspeaker box thereof, wherein the passive vibration unit comprises at least two passive vibrators having two opposing vibration directions respectively, such that when each of the passive vibrators vibrates in responsive to the same vibration of the main vibration speaker, the vibration of one of the passive vibrators in one vibration direction is able to counter-balance and cancel out the displacement tendency due to the vibration of the other passive vibrator in the opposite vibration direction, so as to avoid any unpleasant and undesirable "shifting movement or displacement" of the loudspeaker box.

An object of the present invention is to provide a loudspeaker box and its radiation device and dual suspension edge loudspeaker, wherein the dual suspension edge loudspeaker comprises the radiation device, a magnetic system, and a voice coil coupled with the radiation device and the magnetic system, such that the voice coil can reciprocatingly move under the effect of the electromagnetic driving force of the magnetic system and drive or bring the radiation device to reciprocatingly move along an axial direction thereof, i.e. to vibrate back and forth, so as to agitate and vibrate the air inside and around the loudspeaker box to produce sound.

An object of the present invention is to provide a loudspeaker box and its radiation device and dual suspension edge loudspeaker, wherein the radiation device comprises an inner frame, wherein the inner frame supports the vibration element to the vibration diaphragm to be made with lighter and thinner material while preventing noise generation due to the light and thin vibration diaphragm.

An object of the present invention is to provide a loudspeaker box and its radiation device and dual suspension edge loudspeaker, wherein the radiation device comprises two suspension edge members each connecting with the vibration element and the inner frame, so as to cushion the force generated by the vibration element and the inner frame during the vibration motion.

An object of the present invention is to provide a loudspeaker box and its radiation device and dual suspension edge loudspeaker, wherein the radiation device comprises an outer supporting frame and a body frame, wherein the vibration element is supported by the outer supporting frame through one of the suspension edge members, wherein the body frame is connected with an inner side of the outer supporting frame, wherein the inner frame is connected with the body frame through another one of the suspension edge members, such that the dual suspension edge member is constructed.

An object of the present invention is to provide a loudspeaker box and its radiation device and dual suspension edge loudspeaker, wherein the vibration element is supported by the inner frame, so that the suspension edge members can be made of lighter and thinner material with better resilience, allowing the vibration element to have larger vibration amplitude during the vibrating motion that substantially improves the bass effect thereof.

An object of the present invention is to provide a radiation device and dual suspension edge loudspeaker, and loudspeaker box thereof, wherein the inner frame is supported between the two suspension edge members, such that both the suspension edge members and the vibration element can be made of softer and thinner material while avoiding noise generation in the sound produced.

An object of the present invention is to provide a radiation device and dual suspension edge loudspeaker, and loudspeaker box thereof, wherein the inner frame supports the vibration element in an annular manner to ensure the force applied to the vibration element in an even and uniform manner, so that when the radiation device is arranged along a vertical direction to make the dual suspension edge loudspeaker and the loudspeaker box, the influence due to gravity that causes uneven vibration is reduced.

In order to achieve the above and other objects and advantages of the present invention, an aspect of the present invention provides a radiation device for vibrating to produce sound effect, which comprises:

at least an outer supporting frame;

at least a vibration element;

at least a first suspension edge member, extended between the vibration element and the outer supporting frame;

at least an inner frame, connected with the vibration element;

at least an outer holding frame; and at least a second suspension edge member, connected between the inner frame and the outer holding frame.

According to some embodiments, the inner edge and the outer edge of the first suspension edge member are respectively connected with the top side of the vibration element and the top side of the outer supporting frame.

According to some embodiments, the radiation device also comprises at least a body frame, wherein the outer holding frame is connected with the body frame and the outer supporting frame is connected with the body frame.

According to some embodiments, the inner frame comprises at least a connecting portion and at least an inner holding frame, wherein the connecting portion is connected with the bottom side of the vibration element, wherein the inner holding frame is laterally extended to the connecting portion, wherein the second suspension edge member is extended between the inner holding frame and the outer holding frame.

According to some embodiments, the inner edge and the outer edge of the second suspension edge member are respectively attached on the bottom side surfaces of the inner holding frame and the outer holding frame.

According to some embodiments, the first suspension edge member surrounds the fringe of the vibration element, the second suspension edge member surrounds the outer side wall of the inner frame, and the inner frame is a hollow structure.

According to some embodiments, the connecting portion of the inner frame comprises one or more through holes provided therein.

According to some embodiments, the first suspension edge member and the second suspension edge member each has an arch-shaped cross sectional structure while protruding toward opposite directions.

According to some embodiments, the vibration element is curved structure having a concave shape, wherein the vibration element and the first suspension edge member connected therewith are protruding toward opposite direction.

In some embodiments, cross sectional shapes of the first suspension edge member and the second suspension edge member are selected from the group consisting of arch shape, W-shape, M-shape, S-shape, inverted S-shape, V-shape, inverted V-shape, U-shape, inverted U-shape, wavy, and zigzag, or that each of the first suspension edge member and the second suspension edge member is suspension edge members having a plurality of resilient ribs.

According to some embodiments, the inner frame of the radiation device is adapted for connecting with a voice coil for driving the radiation device to produce sound.

According to some embodiments, the radiation device is utilized as a passive radiation device to respond to an audio system to resonate and produce sound.

The present invention also provides a radiation device for vibrating to produce sound, which comprises:

at least a first suspension edge member;

at least a suspension edge member inner holding frame;

at least a suspension edge member outer holding frame, wherein the first suspension edge member is extended between the suspension edge member inner holding frame and the suspension edge member outer holding frame;

at least a voice coil, connected with a bottom side of the suspension edge member inner holding frame;

at least a second suspension edge member;

at least an inner holding frame connected with the voice coil; and at least an outer holding frame, wherein the second suspension edge member is extended between the inner holding frame and the outer holding frame;

According to some embodiments, the inner portion of the first suspension edge member integrally covers the suspension edge member inner holding frame to serve as a vibration element.

The present invention also provides a radiation device for vibrating to produce sound, which comprises:

at least a first suspension edge member;

at least an outer supporting frame;

at least a vibration element, wherein the first suspension edge member is extended between the outer supporting frame and the vibration element;

at least an voice coil, connected with the vibration element;

at least a second suspension edge member;

at least an inner holding frame, connected with the voice coil; and at least an outer holding frame, wherein the second suspension edge member is extended between the inner holding frame and the outer holding frame;

According to some embodiments, the inner holding frame further has a plurality of grooves and provides a plurality of ribs, wherein each of the ribs is arranged between two of the adjacent grooves.

According to some embodiments, the inner holding frame further has a plurality of perforations radially arranged therein.

The present invention also provides a dual suspension edge loudspeaker, comprising:

at least a radiation device;

at least a magnetic system;

at least a voice coil having one end connected with the inner frame of the radiation device and another end coupled with the magnetic system, wherein the voice coil is driven to reciprocatingly move back and forth under the effect of the electromagnetic driving force of the magnetic system, so as to drive the vibration element of the radiation device to reciprocatingly move back and forth along an axial direction thereof to produce sound.

The present invention also provides a loudspeaker box, which comprises at least a speaker and at least a radiation device as recited above serving as the passive radiation device, wherein when the speaker vibrates and produces sound, the radiation device produces sound according to resonance accordingly as well, so as to enhance the bass effect of the loudspeaker box. When there are multiple radiation devices, two of the radiation devices are preferred to be symmetrically arranged on two opposite sides of the loudspeaker box.

The present invention also provides a loudspeaker box, comprising:

at least a main vibration speaker; and at least a passive radiation device, comprising at least a first passive vibrator and at least a second passive vibrator, wherein a vibration chamber is provided and shared by the main vibration speaker, the first passive vibrator, and the second passive vibrator, wherein when the main vibration speaker responds to an audio signal input and vibrates to produce sound, both the first passive vibrator and the second passive vibrator vibrate in responsive to the vibration of the main vibration speaker to produce auxiliary sound effect, while the vibration directions of the first passive vibrator and the second passive vibrator are opposite.

Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

Figure 1:
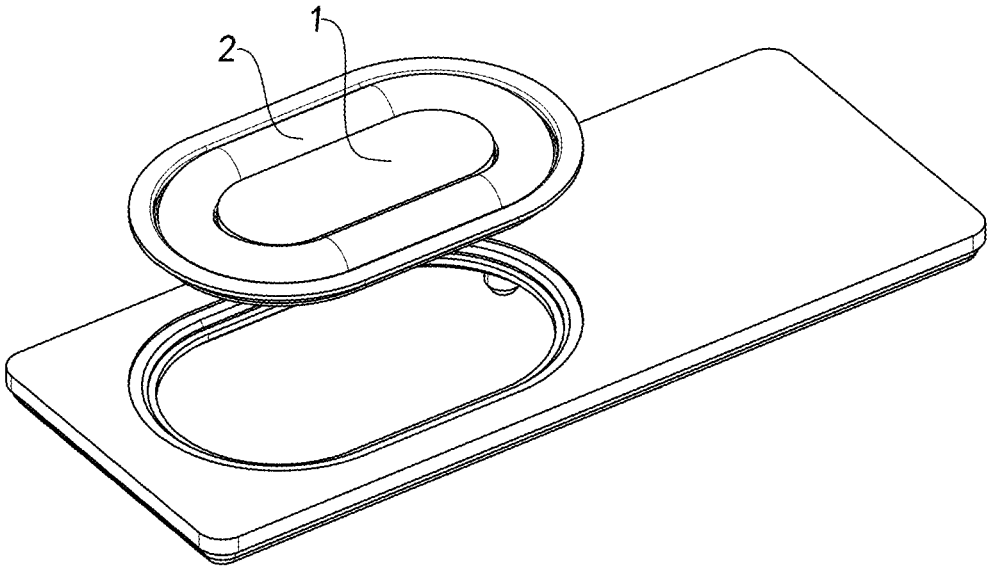
FIG. 1 is a perspective exploded view of a conventional single suspension edge member radiation device.

The following description is disclosed to enable any person skilled in the art to make and use the present invention. Preferred embodiments are provided in the following description only as examples and modifications will be apparent to those skilled in the art. The general principles defined in the following description would be applied to other embodiments, alternatives, modifications, equivalents, and applications without departing from the spirit and scope of the present invention.

Those skilled in the art should understand that, in the disclosure of the present invention, terminologies of "longitudinal," "lateral," "upper," "lower," "front," "back," "left," "right," "perpendicular," "horizontal," "top," "bottom," "inner," "outer," and more that indicate relations of direction or position are based on the relations of direction or position shown in the appended drawings, which is only for ease of describing the present invention and simplifying the description, rather than to indicate or imply that the referred device or element has to apply specific direction or to be operated or structured in specific direction. Therefore, the above-mentioned terminologies shall not be interpreted as confine to the present invention.

FIGS. 2-5 illustrate a radiation device according to a first preferred embodiment of the present invention, wherein the radiation device is embodied as a passive radiation device in this embodiment. The radiation device 10 is utilized to produce vibration function in responsive to the effect of an audio vibration system, so as to drive and bring the air around the radiation device 10 to vibrate and produce sound. Specifically, the vibration system is an acoustics vibration system. For instance, the audio system can be a speaker, loudspeaker box and etc. Then, the radiation device 10 is equipped with the speaker to produce an auxiliary sound effect, especially to equip with the speaker to produce a bass effect. In other words, the radiation device is not directly connected with any voice coil for being driven to vibrate and produce sound. Instead, it passively produces sound by means of the resonance with the active vibrating audio system.

The radiation device 10 comprises a frame assembly 11 and a vibration assembly 12. The vibration assembly 12 is supported by the frame assembly 11 while the frame assembly 11 is arranged for installing the radiation device 10 with the audio system. Alternatively, the radiation device 10 is equipped with the audio system through the frame assembly 11. In this way, when the radiation device 10 is installed with the audio system, the radiation device 10 is adapted to respond to the low-frequency sound wave of the audio system to enhance the low-frequency sound quality.

According to the present embodiment, the frame assembly 11 comprises a ring-shaped outer supporting frame 111 and a basket-shaped body frame 112. The vibration assembly 12 further comprises a ring-shaped first suspension edge member 121, a ring-shaped second suspension edge member 122, a vibration element 123, and an inner frame 124.

The outer supporting frame 111 is adapted for installing the radiation device 10 with the audio system or equipping the radiation device 10 with the vibration system. The first suspension edge member 121 is arranged between the outer supporting frame 111 and the vibration element 123. In other words, the vibration element 123 is connected with the outer supporting frame 111 through the first suspension edge member 121. When the vibration element 123 vibrates in response to the vibration system or the sound wave of the audio system, the displacement of the vibration element 123 from its original position will generate offset force which is transmitted to the outer supporting frame 111 through the first suspension edge member 121 that substantially provides a cushioning and buffering effect, such as a pulling force. Correspondingly, the first suspension edge member 121 also provides a reaction force with respect to the vibration element 123 for restoring the original position of the vibration element 123. Accordingly, the first suspension edge member 121 is a medium for the interaction between the vibration element 123 and the outer supporting frame 111. The first suspension edge member 121 and the vibration element 123 are made of resilient material, so as to ensure a gentle and soft transmission of the acting force and reaction force for the first suspension edge member 121 while the first suspension edge member 121 is transferring such acting and reaction forces, and that it also reduce the acting force applied to the outer supporting frame 111, such that the outer supporting frame 111 suffers less adverse influence due to the vibration of the vibration element 123.

According to this preferred embodiment of the present invention, the first suspension edge member 121 is made, by means of injection molding technology, integrally with the vibration element 123 at the same time. Specifically, when the first suspension edge member 121 is integrally molded by injection molding, it may also be integrally connected with the outer supporting frame 111 at the same time. In other words, the first suspension edge member 121, the vibration element 123 and the outer supporting frame 111 are integrated into an integral body through injection molding. It is understood that the first suspension edge member 121 is made by embedding injection molding technology. In other words, the outer supporting frame 111 and the vibration element 123 are pre-placed in the molding mould, and then the liquid form raw material for forming the first suspension edge member 121 is injected, wherein the raw material for forming the first suspension edge member 121, after cooling and solidification, will extend to attach on the outer supporting frame 111 and the vibration element 123 for connecting and fixing the outer supporting frame 111 and the vibration element 123 to form an integral component.

According to this preferred embodiment of the present invention, the vibration element 123 generates vibrations while the vibration element 123 is in responsive to the vibration system or the sound waves of the audio system, such as generating a resonance in response to the low frequency acoustic wave, through the transmission of the surrounding air as medium, to enhance the low frequency acoustic wave and like. In particular, the vibration element 123 is a vibration diaphragm. It is worth mentioning that the vibration element 123 is made of metal material, such as aluminum material and like. In other words, the vibration element 123 can also be a metal diaphragm, such as aluminum diaphragm and etc. The first suspension edge member 121 is made of elastic material such as rubber which is integrally coupled and formed with the vibration element 123 so that the first suspension edge member 121 is arranged between the vibration element 123 and the outer supporting frame 111. Hence, it is appreciated that the first suspension edge member 121 and the vibration element 123 can be made of different materials. For instance, the first suspension edge member 121 is made of softer material while the vibration element 123 is made of harder material, that can substantially prevent rapid transmission of the pulling stress effectively and ensure the vibration of the vibration element 123 being more regularly.

It is worth mentioning that when the radiation device 10 is equipped with the vibration system, an enclosed space should be formed to ensure a better responding effect of bass.

Further, the first suspension edge member 121 is arranged surrounding around the vibration element 123 while the outer supporting frame 111 is arranged surrounding around the first suspension edge member 121. In other words, the vibration element 123, the first suspension edge member 121 and the outer supporting frame 111 are integrally formed as an annular track-like structure that each of the vibration element 123, the first suspension edge member 121 and the outer supporting frame 111 forms an individual track.

The annular structure can be in an oval ring shape, a circular ring shape, a rectangular ring shape, or other similar ring shape structure. According to this embodiment of the present invention, the annular structure is embodied as a circular ring shape. Nevertheless, according to other embodiments of the present invention, the annular structure can also be embodied as a closed ring in various shapes, such as square, triangle, and etc. Person skilled in the art should understand that specific structural shape of the outer supporting frame 111, the first suspension edge member 121 and the vibration element 123 shall not be considered as limitations of the present invention.

In other words, the outer supporting frame 111 is a ring-shaped hollow panel, wherein the first suspension edge member 121 is positioned inside the hollow panel and the radiation device 10 is supported by the outer supporting frame 111. In other words, the radiation device 10 and the audio system are installed in position through the outer supporting frame 111. Specifically, in one embodiment of the present invention, an outer edge of the first suspension edge member 121 is embedded in an inner portion of the outer supporting frame 111. In particular, the outer supporting frame 111 has a circular inner supporting groove 1111, located at an inner edge of the hollow panel, which is a circular groove indented from an upper surface of the outer supporting frame 111 for fittingly receiving an outer edge of the first suspension edge member 121.

According to other embodiments of the present invention, the outer supporting frame 111 may also be formed through other components, such as the front panel of the loudspeaker box. That is the first suspension edge member 121 and the vibration element 123 can be directly mounted to the front panel of the loudspeaker box without the need to make an independent outer supporting frame 111, i.e. utilizing the front panel of the loudspeaker box as the outer supporting frame 111.

According to this preferred embodiment of the present invention, the first suspension edge member 121, having a curved cross section, is curvedly extended and connected between the outer supporting frame 111 and the vibration element 123, instead of being extended between the outer supporting frame 111 and the vibration element 123 in a planar manner, so as to better cushion and buffer the offset force of the vibration element 123 during vibration. In other words, the first suspension edge member 121 reduces the influence of the vibration of the vibration element 123 on the outer supporting frame 111. In particular, the first suspension edge member 121 comprises an annular first inner connection portion 1211, an annular first outer connection portion 1212 and an annular first suspension body 1213 extended between the first inner connection portion 1211 and the first outer connection portion 1212. Further, the first outer connection portion 1212 is formed and shaped to be fittingly placed in the supporting groove 1111 of the outer supporting frame 111 while the first inner connection portion 1211 and the vibration element 123 are integrally formed and connected. For example, the first inner connection portion 1211 can be extended to a top surface of the outer edge of the vibration element 123. In addition, the first suspension body 1213 is protruded/indented or further folded between the first inner connection portion 1211 and the first outer connection portion 1212 in form of pleat(s), arch(es), or wave(s) structure, according to the design and modification based on the actual needs. Therefore, it should be understood that the first suspension body 1213 may, based on the requirement, also be made in form of a plane. Hence, the scope of the present invention shall not be limited with the shape of the suspension body 1213. In addition, the first suspension body 1213 may also be spacedly provided with a plurality of resilient ribs along an annular direction of the first suspension body 1213, wherein the resilient ribs can be radially, evenly and uniformly arranged so as to limit the displacement direction of the first suspension body 1212 in the axial direction thereof. It is worth mentioning that the resilient ribs may also be in form of protrusions or indentions.

According to this embodiment of the present invention, the first suspension edge member 121 circularly arranged between the vibration element 123 and the outer supporting frame 111 is extended protrudingly and curvedly between the vibration element 123 and the outer supporting frame 111 to form an arch shape cross section. Specifically, each of the arch shaped first suspension edge member 121 and the arch shaped second suspension edge member 122 has a protruding convex side and a concave side defining an opening, wherein the openings of first suspension edge member 121 and the second suspension edge member 122 are arranged facing opposite directions. That is, the arch shaped first suspension edge member 121 and the arch shaped second suspension edge member 122 are arranged protruding in opposite directions, so that by means of the mechanical characteristics of the arch shape structure, the pulling force generated during the vibration of the vibration element 123 is cushioned and buffered by the arch shaped first and second suspension edge members 121, 122. Accordingly, the shapes and structures of the first suspension edge member 121 and the second suspension edge member 122 can be designed to coordinate with each other based on the actual condition and requirement.

Figure 4:
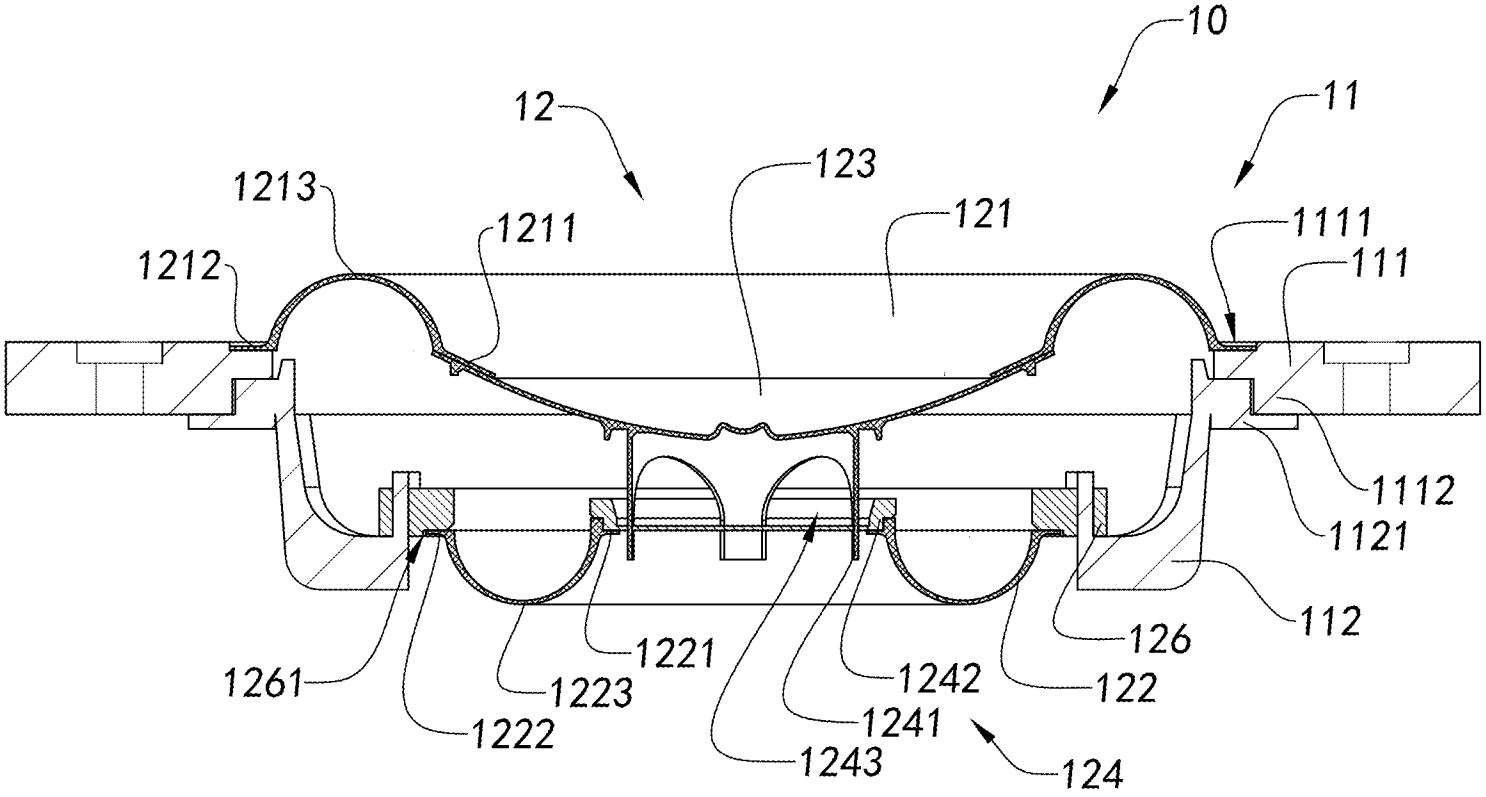
FIG. 4 is a sectional view of the radiation device according to the above first preferred embodiment of the present invention.

According to the present embodiment of the present invention, the vibration element 123 is connected with the first suspension edge member 121 in a curvedly extending manner, wherein the curving direction of the vibration element 123 and the curving direction of the first suspension edge member 121 are in opposite directions, so as to better cushioning and buffering the acting force of the vibration element 123. For example, as shown in FIG. 4, the vibration element 123 is concavely and downwardly curved towards the second suspension edge member 122 and the first suspension edge member 121 is convexly and upwardly curved away from the second suspension edge member 122. More specifically, the first suspension edge member 121 is protruded convexly and upwardly in arch shape and the vibration element 123 is indented concavely and downwardly in arch shape, so that two opposing arched structures are formed for better cushioning and buffering the vibrating force of the vibration element 123 and providing a gentle and flexible restoring force for the vibration element 123. According to another embodiment of the present invention, the first suspension edge member 121 may be made in concave arch shape and the vibration element 123 may be made in convex arch shape correspondingly to provide a better cushioning and buffering for the acting force of the vibration element 123.

Figure 2:
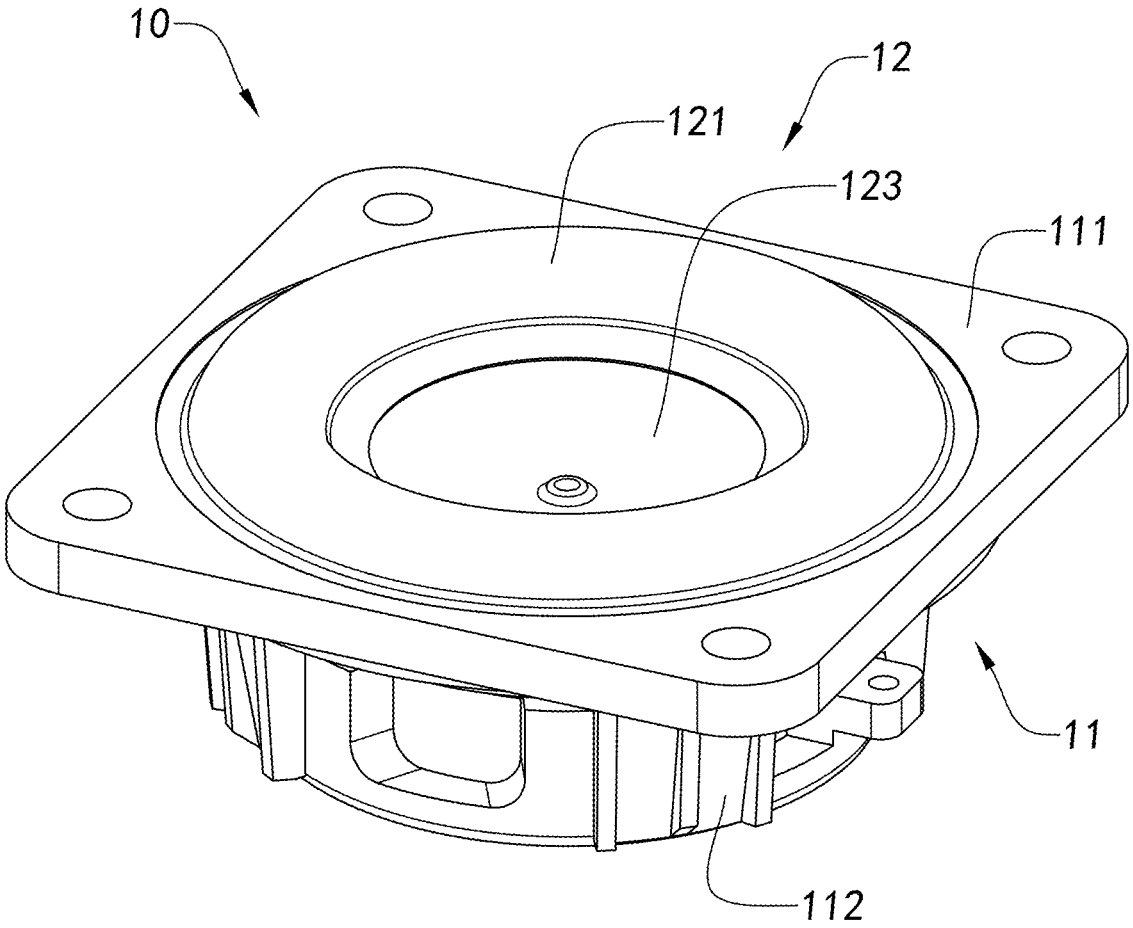
FIG. 2 is a perspective view of a radiation device according to the above first preferred embodiment of the present invention.

According to this embodiment of the present invention, as shown in FIGS. 2 and 4, the first suspension edge member 121 is integrally and curvedly connected to an outer side of the vibration element 123.

Figure 3:
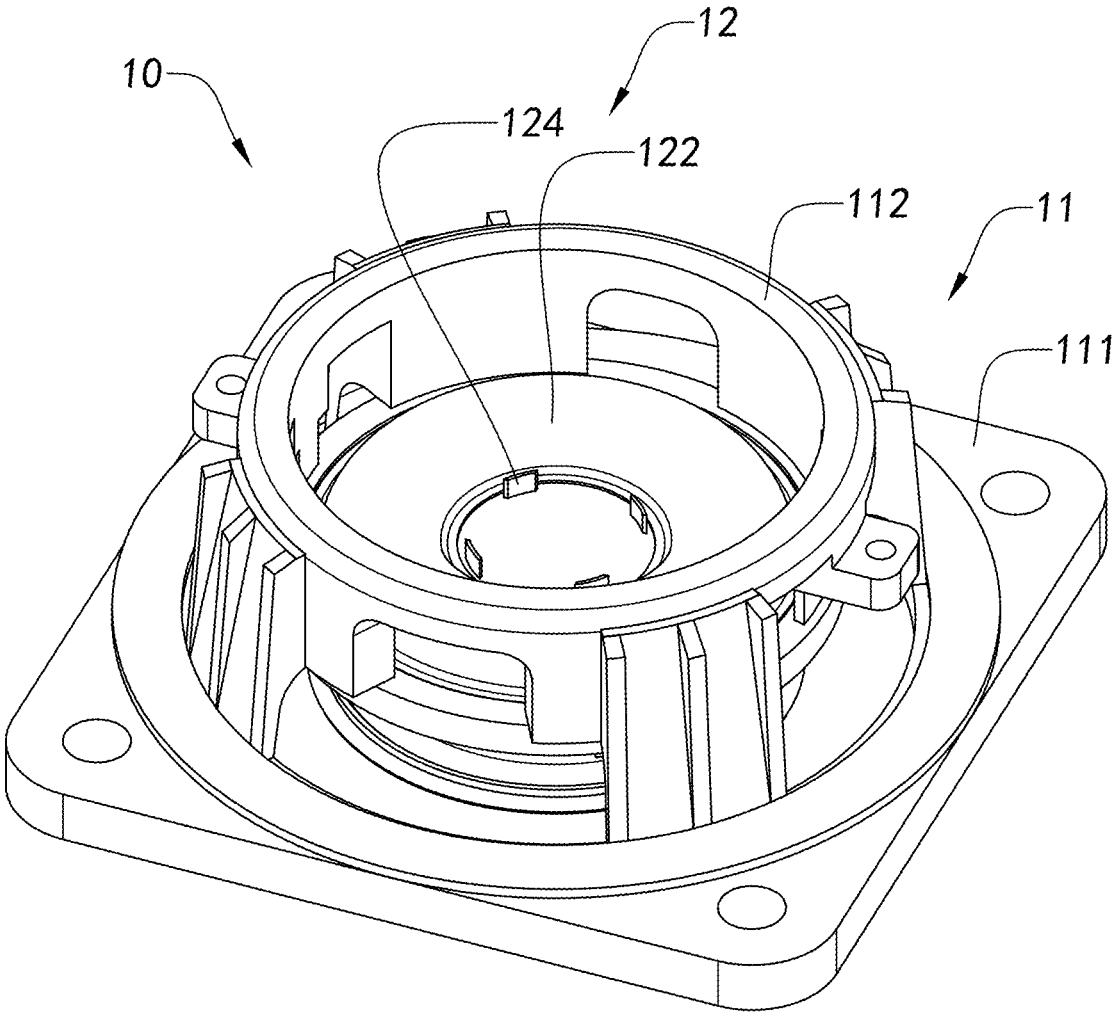
FIG. 3 is a bottom perspective view of the radiation device according to the above first preferred embodiment of the present invention.
Figure 5:
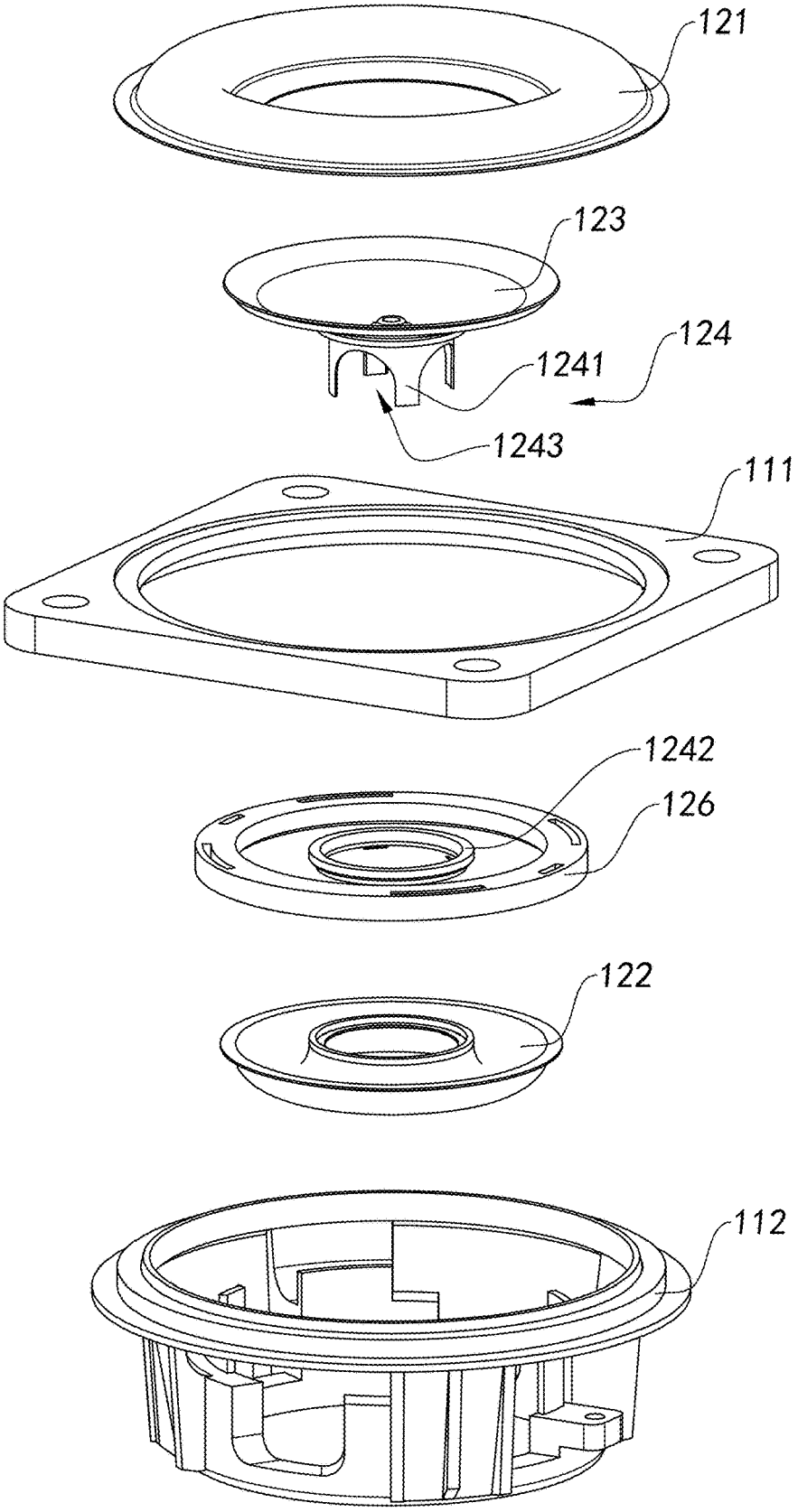
FIG. 5 is an exploded view of the radiation device according to the above first preferred embodiment of the present invention.

According to the present embodiment of the present invention, referring to FIGS. 3 to 5, the vibration assembly 12 further comprises an outer holding frame 126. The inner frame 124 comprises a connecting portion 1241 and an inner holding frame 1242. The connecting portion 1241 is extended from a bottom of the vibration element 123. The inner holding frame 1242 is in ring shape and laterally extended from the connecting portion 1241. The body frame 112 is assembled to connect with the outer supporting frame 111. The second suspension edge member 122 is connected between the inner holding frame 1242 and the outer holding frame 126. The outer holding frame 126 is assembled to connected with the body frame 112 or is integrally protruded from the body frame 112, that is the ring-like flange protruded on an inner surface of the body frame 112. In addition, the outer holding frame 126 may have an external support groove 1261 provided and located on an inner edge of the hollow plate structure of the outer holding frame 126, so as to facilitate an outer edge of the second suspension edge member 122 to be received in the external support groove 1261 so as to allow the outer edge of the second suspension edge member 122 to be attached and connected with the bottom surface of the outer holding frame 126.

Specifically, an upper end of the inner frame 124 is supported by the vibration element 123 while a lower end of the inner frame 124 is connected with an inner side of the second suspension edge member 122. In particular, the second suspension edge member 122 is connected with an outer wall of the inner holding frame 1242 of the inner frame 124 by adhering connection or integral formation.

According to the present embodiment of the present invention, the inner frame 124 which is a hollow structure has a lower end communicated with an enclosed space defined in the audio system. The connecting portion 1241 of the inner frame 124 may have multiple openings 1243, such that the air as medium for transmitting vibration can enter the space formed and defined by the first and second suspension edge members 121 and 122 and the vibration element 123 from a vibration chamber of the audio system.

The second suspension edge member 122 is curvedly connected between the body frame 112 and the inner frame 124 and that the curving direction of the second suspension edge member 122 is opposite to the curving direction of the first suspension edge member 121. According to the present embodiment of the present invention, the first suspension edge member 121 has an outwardly protruding arch shape and the second suspension edge member 122 has an inwardly indenting arch shape, as shown in FIG. 4, so as to cooperatively and correspondingly cushion and buffer the acting force of the vibration element 123 with respect to the outer supporting frame 111 and the body frame 112 and provide a gentle and flexible restoring force for the vibration element 123. In addition, the second suspension edge member 122 is connected between the inner holding frame 1242 and the outer holding frame 126. In other words, the second suspension edge member 122 is connected with the inner frame 124 through the inner holding frame 1242. The second suspension edge member 122 is connected with the body frame 112 through the outer holding frame 126.

According to this embodiment of the present invention, the second suspension edge member 122 can be made by means of integral injection molding technology and be connected with the inner holding frame 1242 and the outer holding frame 126 at the same time. Specifically, while the second suspension edge member 122 is integrally formed by injection molding, it can also be made integrally connecting with the inner holding frame 1242 and the outer holding frame 126 simultaneously. In other words, the second suspension edge member 122, the inner holding frame 124, and the outer holding frame 126 are integrated into an integral component by means of integral injection molding. In other words, the second suspension edge member 122 is made by embedding and injection molding technology, wherein the inner holding frame 1242 and the outer holding frame 126 are pre-placed in the molding mould, and then the raw material in liquid form for making the second suspension edge member 122 is injected into the molding mould, wherein the material of the second suspension edge member 122 is extended and attached to the inner holding frame 1242 and the outer holding frame 126 to fix the inner holding frame 1242 and the outer holding frame 126 integrally after cooling and solidification to form the integral component.

According to this preferred embodiment of the present invention, the second suspension edge member 122 is curvedly connected between the inner holding frame 1242 and the outer holding frame 126, instead of being planarly extended between the inner holding frame 1242 and the outer holding frame 126, so as to better cushion and buffer the offset force of the vibration element 123 during vibration. Furthermore, the second suspension edge member 122 comprises a second inner connection portion 1221, a second outer connection portion 1222 and a second suspension body 1223 positioned between the second inner connection portion 1221 and the second outer connection portion 1222. Further, the second outer connection portion 1222 is positioned and received in the external support groove 1261 of the outer holding frame 126. The second inner connection portion 1221 and the inner holding frame 1242 are integrally formed and connected. In addition, the second suspension body 1213 is protruded/indented from and between the second inner connection portion 1211 and the second outer connection portion 1212 to form a curved shape structure, or alternatively, a pleated shape structure, an arch shape structure, or wave shape structure, according to the design and modification based on actual needs. Therefore, according to the actual need, the second suspension body 1213 may of course made in a planar shape or other shapes as required, that should not be considered as limitation to the scope of the present invention. Besides, a plurality of resilient ribs may also be provided radially, evenly and uniformly along the annular direction on the second suspension body 1213, so as to limit the displacement direction of the first suspension body 1212 in the axial direction thereof. It is worth mentioning that each of the resilient ribs can be made in form of protrusion or indention.

It is appreciated that the radial distance of the first suspension edge member 121 to its center and the radial distance of the second suspension edge member 122 to its center is not limited. Preferably, as shown to FIG. 4, the radius of first suspension edge member 121 and the radius of the second suspension edge member 122 are different, wherein the first suspension edge member 121 is larger than the second suspension edge member 122 that the first suspension edge member 121 is farther from the center of the vibration device 10 while the second suspension edge member 122 is closer to the center of the vibration device 10, so as to reduce the size of the inner holding frame 1242 and the weight of the entire radiation device while ensuring the vibrational energy to be concentrated in the vibration element 123 for vibration to produce sound. The first suspension edge member 121 and the second suspension edge member 122 may have different arch heights, or as illustrated in FIG. 4, have the same arch height.

When the radiation device 10 is used in an audio system, it is equipped with the audio system to define an enclosed space, that is a vibration chamber. When the vibration audio system produces vibration sound wave, the radiation device 10 responds to the vibration frequency. Specifically, based on the material characteristic of the vibration element 123, the vibration element 123 is arranged to only respond to the low frequency sound wave and produce resonance, so as to enhance the low frequency sound wave. The enhanced low frequency sound wave is transmitted through the air medium in the enclosed space (vibration chamber) to enhance the weak low frequency sound wave to be hearable. For example, during the vibration process, referring to FIG. 4, when the vibration element 123 moves inwardly, a downward pulling force is applied to the first suspension edge member 121 and a downward stress is generated to the inner frame 124. However, the arch shaped first suspension edge member 121 can reduce the pulling force rapidly and gently provide a restoring force to the vibration element 123, so as to avoid the outer supporting frame 111 from being affected by the vibration element 123. The inner frame 124 supports the vibration element 123. As the vibration element 123 moves downwardly and generates a downward acting force to the second suspension edge member 122, the arch shaped second suspension edge member 122 can rapidly reduce the acting force of the inner frame 124 and generate an upward restoring force during its deforming process, so as to avoid the body frame 112 from being affected by the acting force of the inner frame 124. On the contrary, when the vibration element 123 moves upwardly, the first suspension edge member 121 and the second suspension edge member 122 serve to provide corresponding cushioning and buffering function.

It is worth mentioning that the dual suspension edge member low frequency responding structure constructed by the first suspension edge member 121, the second suspension edge member 122, and the inner frame 124 of the present invention is different from conventional single suspension edge member passive member and performs better in low frequency responding than the conventional single suspension edge member passive member apparently. As for the conventional single suspension edge member passive member, the vibrating diaphragm is connected with the bracket through a suspension edge member, wherein if the vibrating diaphragm is too thin, the durability will be relatively poor and the vibration of the vibrating diaphragm can be uneven, that can generate noise like "papa . . . " easily.

However, according to the preferred embodiment of the present invention, the stress and force acting on the vibration element 123 is even and uniform because of the supporting of the inner frame 124. Accordingly, even when the vibration element 123 is thinner in thickness, the vibration element 123 can still produce a relatively even and uniform movement without generating such "papa . . . " noise. Also, due to the support of the inner frame 124, when the first suspension edge member 121 and the second suspension edge member 122 can be made with relatively softer and lighter material and meet the motion requirements of the vibration element 123. When the vibration element 123 is made with thinner material and responds to sound wave to vibrate naturally, the vibration element 123 can produce larger vibration amplitude, so as to enhance the quality of low-frequency response to the sound wave. Besides, when the first suspension edge member 121 and the second suspension edge member 122 are made with softer material, under a better resilience effect, they can have more potential to produce larger vibration amplitude for the vibration element 123. In addition, to the conventional passive member, when the passive member is utilized in a speaker or loudspeaker box, the passive member is generally arranged vertically. Due to the gravity of the vibration diaphragm itself, its vibration is uneven vibration.

However, according to this preferred embodiment of the present invention, due to the support of the inner frame 124, when the radiation device 10 is vertically arranged, it is appreciated that the vibration element 123 as well as the first suspension edge member 121 and the second suspension edge member 122 are respectively supported by the inner frame 124, wherein symmetrical and even pulling force is provided around the vibration element 123, such that the vibration element 123 is less affected by gravity, vibrates evenly and uniformly, and produces pure and clean sound.

It is worth mentioning that, according to this embodiment of the present invention, the vibration element 123 has circular cross section and the inner holding frame 1242 of the inner frame 124 is in circular shape. Nonetheless, according to other embodiments of the present invention, the vibration element 123 and the inner frame 124 can also be other shapes. For example, the vibration element 123 can be rectangle shape or triangular shape, and the inner holding frame 1242 of the inner frame 124 can be rectangular shape or triangular shape. Certainly, the shapes of the first suspension edge member 121 and the second suspension edge member 122 can be modified correspondingly to the shapes of the vibration element 123 and the inner frame 124. Person skilled in the art should understand that the shapes of the vibration element 123, the inner frame 124, the first suspension edge member 121, and the second suspension edge member 122 shall not be considered as limitation to the scope of the present invention.

According to this embodiment of the present invention, the first suspension edge member 121 and the second suspension edge member 122 form the modularized radiation device 10 through the coupling of the outer supporting frame 111 and the body frame 112. Further, the outer supporting frame 111 comprises one or more supporting frame coupling portions 1112. The body frame 112 comprises a body frame coupling portion 1121. The outer supporting frame 111 and the body frame 112 form the radiation device 10 through the connection of the supporting frame coupling portion 1112 and the body frame coupling portion 1121. The supporting frame coupling portion 1112 and the body frame coupling portion 1121 can be coupled, joined or connected by various means, such as through matched buckling components, screw components, hot welding, ultrasonic bonding, and etc. In addition, the supporting frame coupling portion 1112 and the body frame coupling portion 1121 form a pair of engaging grooves respectively adapted for fittingly coupling with each other, such as one of the pair of engaging grooves is in protruding step shape and the other engaging groove is in indenting step shape correspondingly, for ease of assemble and alignment.

Figure 6:
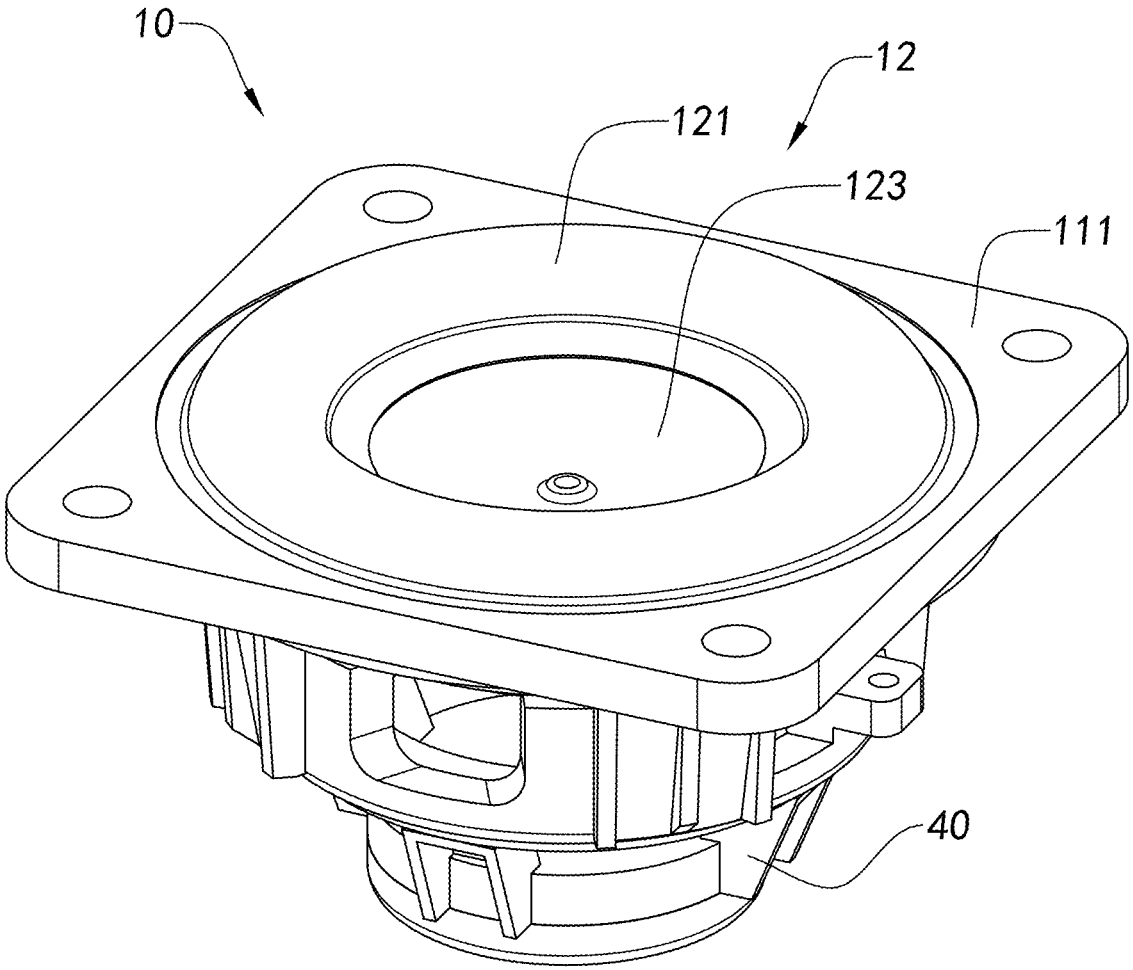
FIG. 6 is a perspective view of a speaker made with the radiation device according to the above first preferred embodiment of the present invention.
Figure 7:
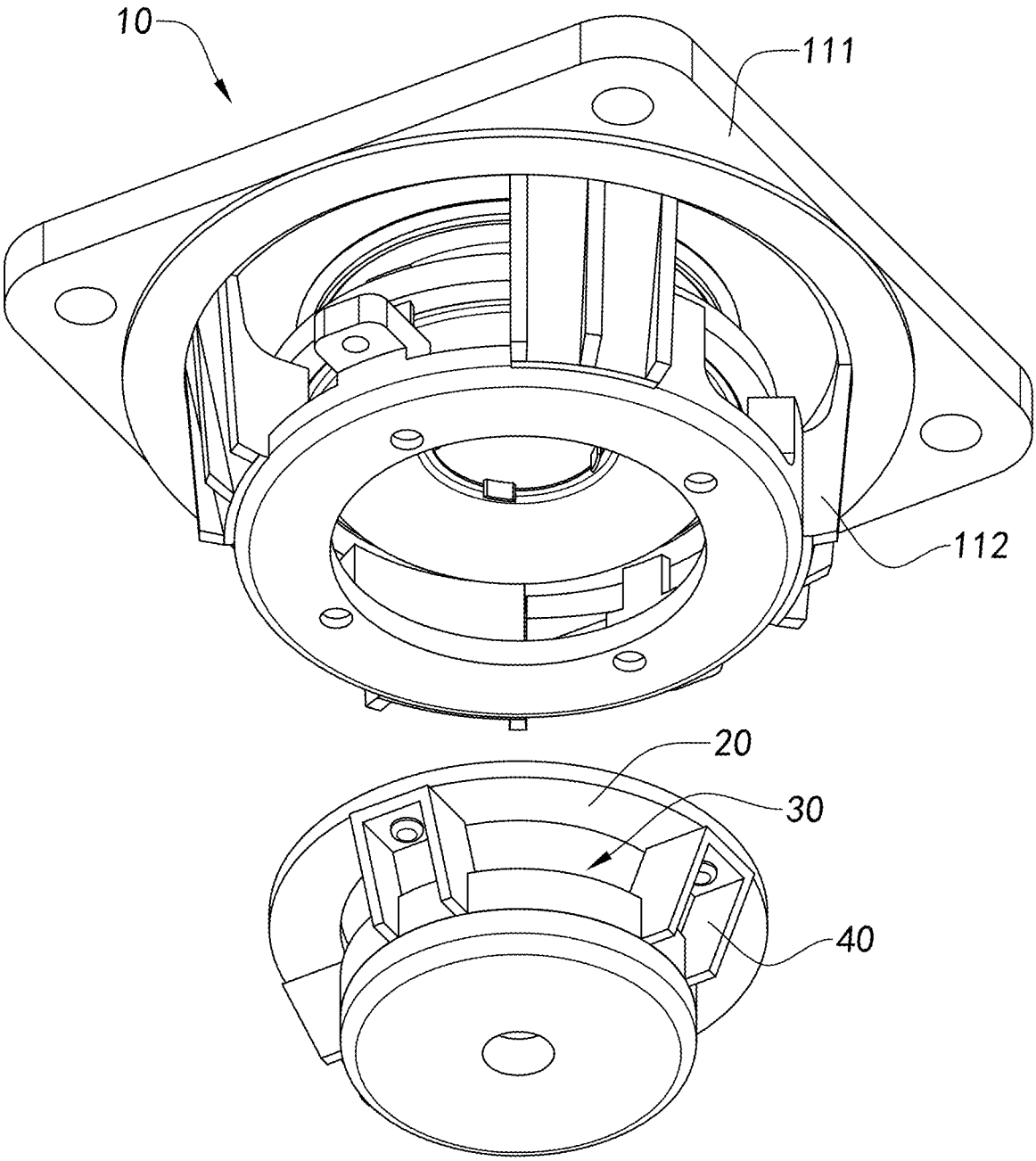
FIG. 7 is an exploded view of the speaker according to the above first preferred embodiment of the present invention.
Figure 8:
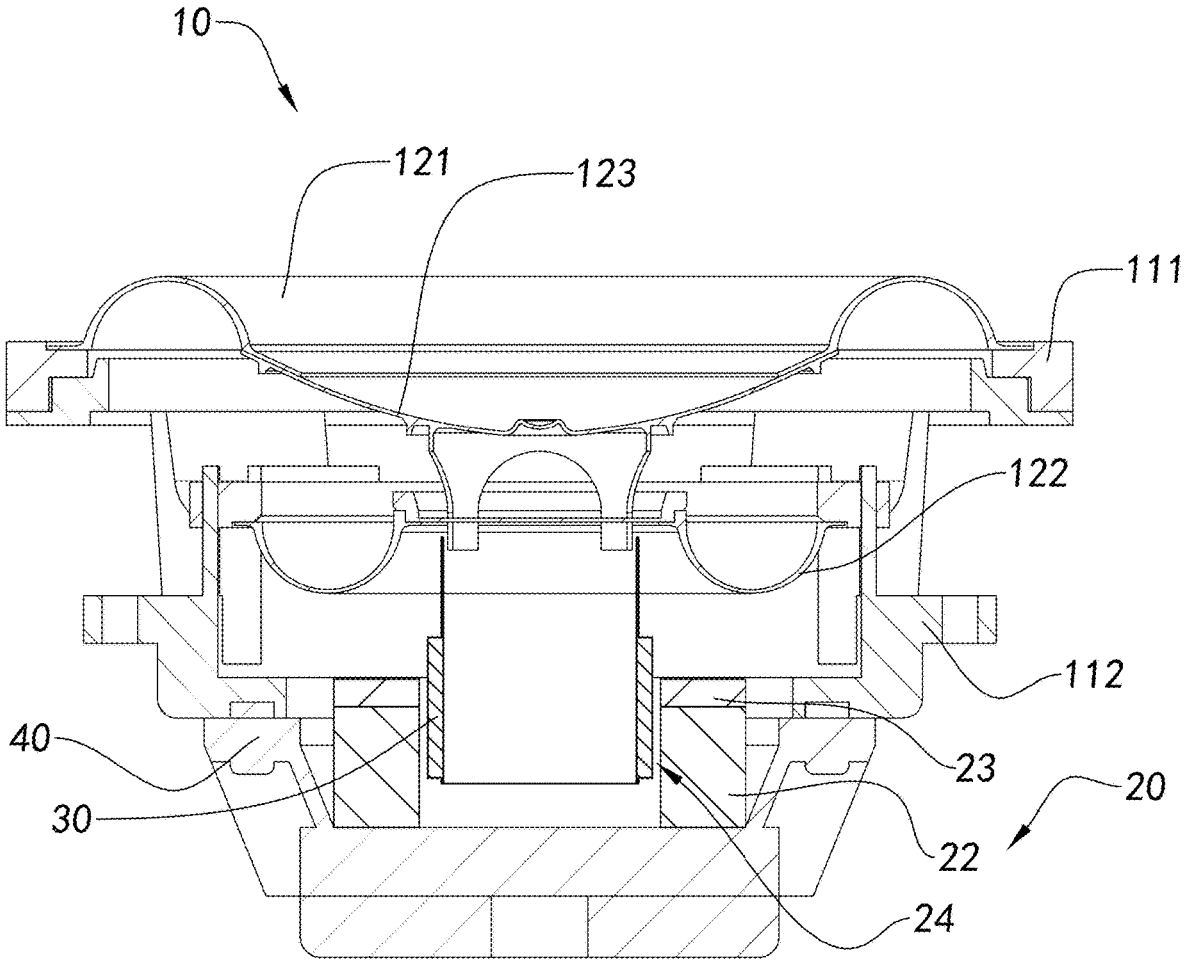
FIG. 8 is an exploded view of the speaker according to the above first preferred embodiment of the present invention.

Referring to FIGS. 6 to 8, the radiation device of the present invention as embodied above is equipped to make a dual suspension edge loudspeaker, which comprises the radiation device 10, a magnetic system 20, a voice coil 30, and a vibration framework 40. According to some embodiments of the present invention, the outer supporting frame 111 of the radiation device 10 is adapted to be connected with the vibration framework 40 or the vibration framework 40 can be directly connected with the body frame 112 of the radiation device 10. Alternatively, the vibration framework 40 can substitute the body frame 112 that the first suspension edge member 121 and the second suspension edge member 122 of the radiation device 10 can respectively be directly mounted on the vibration framework 40 of the dual suspension edge loudspeaker. The voice coil 30 is connected with the radiation device 10 to resonate with the magnetic system 20 and vibrate to produce sound. According to the present embodiment, the inner frame 124 of the radiation device 10 is connected with the voice coil 30, and the radiation device 10 is directly driven by the voice coil 30 to vibrate and produce sound, rather than to passively produce sound through resonance as mentioned in the above embodiment. According to the present embodiment, based on reinforced structure of the dual suspension edge member of the radiation device 10, the vibration element 123 can better respond to low frequency sound wave to vibrate, have greater vibration amplitude and avoid producing noise, so as to ensure the dual suspension edge loudspeaker providing better sound quality, especially in low frequency.

Specifically, the radiation device 10 and the magnetic system 20, as well as the voice coil 30 and the vibration framework 40, are arranged in opposing manner with each other while defining an enclosed space in between.

Specifically, the magnetic system 20 comprises a permanent magnetic member 22 and at least a magnetic conductor 23. The permanent magnetic member 22 is installed in the vibration framework 40 and positioned below the magnetic conductor 23. Also, a magnetic gap 24 is formed between the permanent magnetic member 22 and the vibration framework 40. An end of the voice coil 30 is coupled with the vibration element 123 of the vibration assembly 12 of the radiation device 10, while the other end of the voice coil 30 is coupled with the magnetic gap 24 of the magnetic system 20. The vibration framework 40 may have a conventional U-shaped structure and the magnetic conductor 23 may have a conventional polar piece structure. The vibration framework 40 and the magnetic conductor 23 direct the magnetic field and force of the permanent magnetic member 22 to the magnetic gap 24, so as to allow the magnetic system 20 to interact with the voice coil 30 arranged in the magnetic gap 24. In other words, the vibration framework 40, the permanent magnetic member 22, and the magnetic conductor 23 jointly are arranged to form a magnetic field loop to coordinate with the voice coil 30 to produce vibration.

The permanent magnetic member 22 can be a ferrimagnet. It may also be various kinds of magnet, ferrimagnet or magnetic steel, such as metallic magnet, ferrite magnet, rare-earth magnet, and etc. According to this preferred embodiment of the present invention, the permanent magnetic member 22 can be an NdFeB magnet.

Besides, the magnetic system 20 may also be embodied in other manners. For example, the magnetic system 20 further comprises a connector 25 connected with the vibration framework 40, the permanent magnetic member 22 and the magnetic conductor 23 to form an integral structure. In other words, the integral structure is assemble and made through the connector 25 without the need of any adhesive to connect, wherein each component is fixed at its appropriate position so as to provide the loop of magnetic field. Preferably, the connector 25 is made by embedding injection molding technology. In other words, the vibration framework 40, the permanent magnetic member 22 and the magnetic conductor 23 are placed in the molding mould, and then the raw material in liquid form for manufacturing the connector 25 is injected into the molding mould, wherein the material of the connector 25 is extended and attached on the vibration framework 40, the permanent magnetic member 22 and the magnetic conductor 23 to affix the vibration framework 40, the permanent magnetic member 22, and the magnetic conductor 23 to form the integral structure after cooling and solidification.

It is appreciated that the various components of the magnetic system 20 can be made to form the integrated structure by means of adhesive through the conventional gluing or adhering process. Or, the magnetic system 20 may also made through integral injection molding technology. More specifically, the vibration framework 40, the permanent magnetic member 22, and the magnetic conductor 23 can be integrally made to form the integrated structure by means of injection molding.

Figure 9:
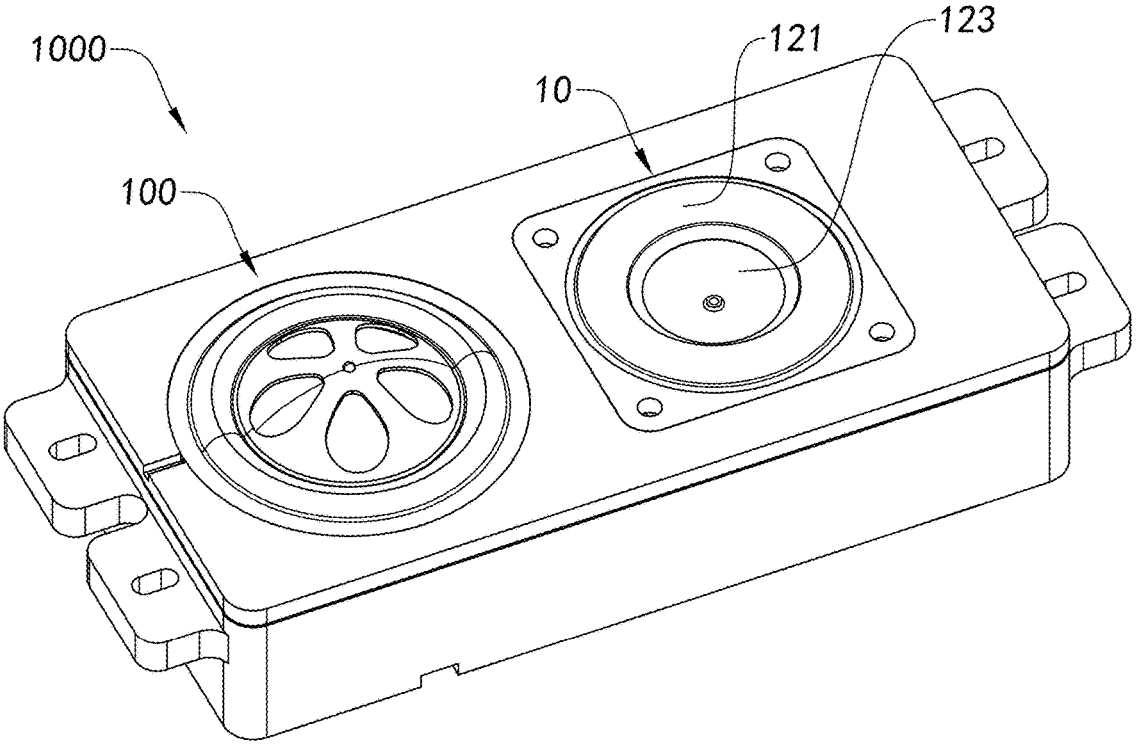
FIG. 9 is a perspective view of a loudspeaker box made with the radiation device according to the above first preferred embodiment of the present invention.
Figure 10:
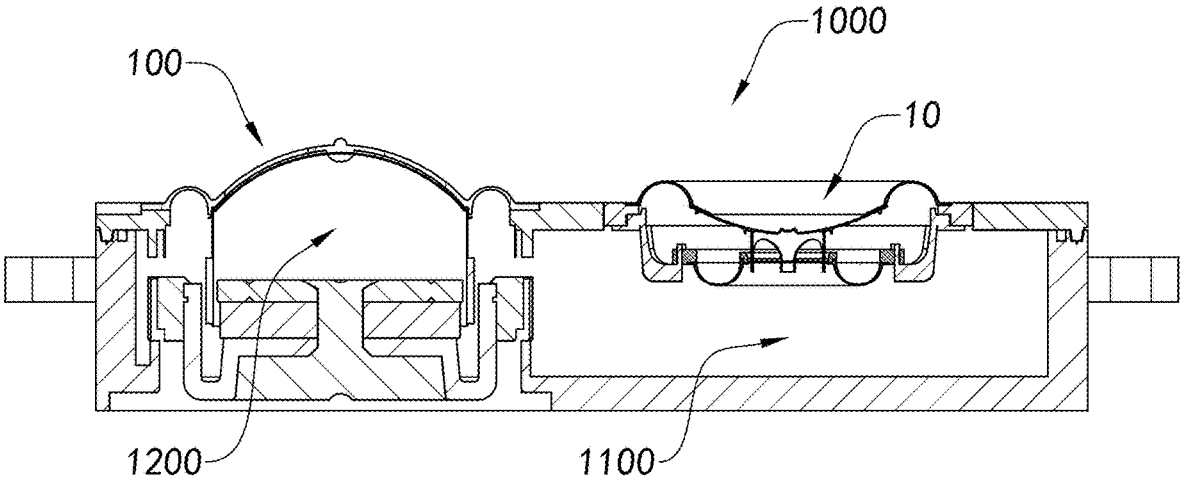
FIG. 10 is a sectional view of a loudspeaker box made with the radiation device according to the above first preferred embodiment of the present invention.

Referring to FIGS. 9 and 10, a loudspeaker box 1000 made with the radiation device as disclosed above is illustrated. According to this embodiment, the loudspeaker box 1000 comprises at least a speaker 100 and at least one radiation device 10. The radiation device 10 is enclosed in the speaker 100, so that when the speaker 100 vibrates to produce sound wave, the radiation device 10 responds to the sound wave and vibrates too. Referring to FIG. 10, the radiation device 10 and the speaker 100 together form and define a first cavity 1100 in the loudspeaker box 1000. The speaker 100 has a second cavity 1200 provided therein, wherein the first cavity 1100 and the second cavity 1200 are connected and communicated with each other, such that when the vibration and sound wave produced by the speaker 100 has been transmitted within the box body of the loudspeaker box 1000, the vibration and sound wave produced by the speaker 100 can be further transmitted through the air as medium in the first cavity 1100 and the second cavity 1200 to reach the radiation device 10 and drive the radiation device 10 to vibrate corresponding to the sound wave, specially the low frequency sound wave therein, so as to enhance the low frequency sound quality of the loudspeaker box 1000.

It is worth mentioning that the speaker 100 may not be the one as illustrated in FIG. 7, but can be a traditional speaker which comprises a vibrating board. When the speaker 100 of the present invention (or conventional speaker) produces sound wave, the vibrating board and the radiation device 10 respectively respond to the sound wave, so as to enhance the low frequency sound wave thereof through different ways. In other words, it utilizes the coordination between the vibrating board and the radiation device 10 to enhance the bass effect of the speaker 100 or other speakers. It should be understood that the vibrating and sounding structure of the speaker 100 may also apply the structure of the radiation device 10 of the present invention.

Figure 11:
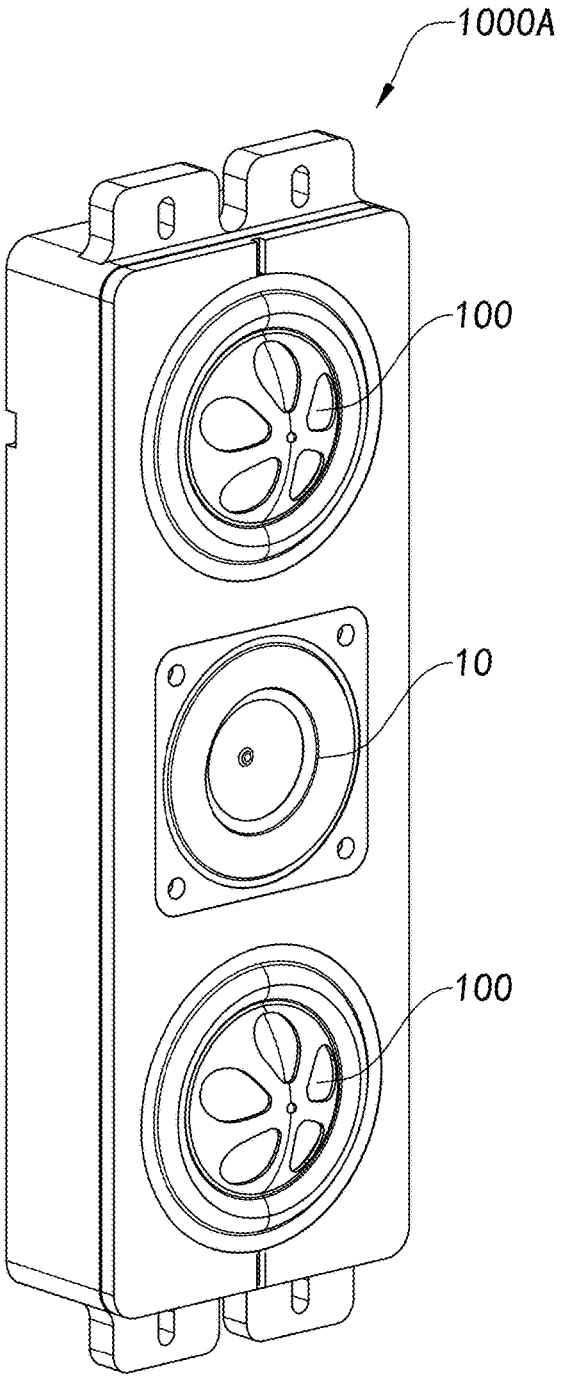
FIG. 11 is a perspective view illustrating another loudspeaker box made with the radiation device according to the above first preferred embodiment of the present invention.

FIG. 11 illustrated a first alternative mode of the loudspeaker box equipped with the radiation device of the present invention. According to this first alternative mode, the loudspeaker box 1000A comprises two speakers 100 and one radiation device 10, wherein the radiation device 10 is arranged to positioned between the two speakers 100. When the two speakers 100A produce sound wave, the radiation device 10 responds to the low frequency portion of the sound wave to vibrate so as to enhance the low frequency sound effect. Accordingly, the design and arrangement of the loudspeaker box 1000, 1000A of the present invention allows a relatively small box body to perform better bass effect.

Similarly, the speaker 100 may also comprise components made with the radiation device 10, such as the structure illustrated in FIGS. 6 and 8. Certainly, at least one of the speakers 100 of the loudspeaker box 1000A may also be replaced by a traditional speaker. The radiation device 10 can still be integrally installed in the box body of the loudspeaker box 1000A or be formed as a part of the loudspeaker box 1000A. In other words, the radiation device 10 and the first suspension edge member 121 and the body frame 112 can be connected to the box body. Therefore, the box body serves as the outer supporting frame 111 so that the specific outer supporting frame 111 is not required.

Figure 12:
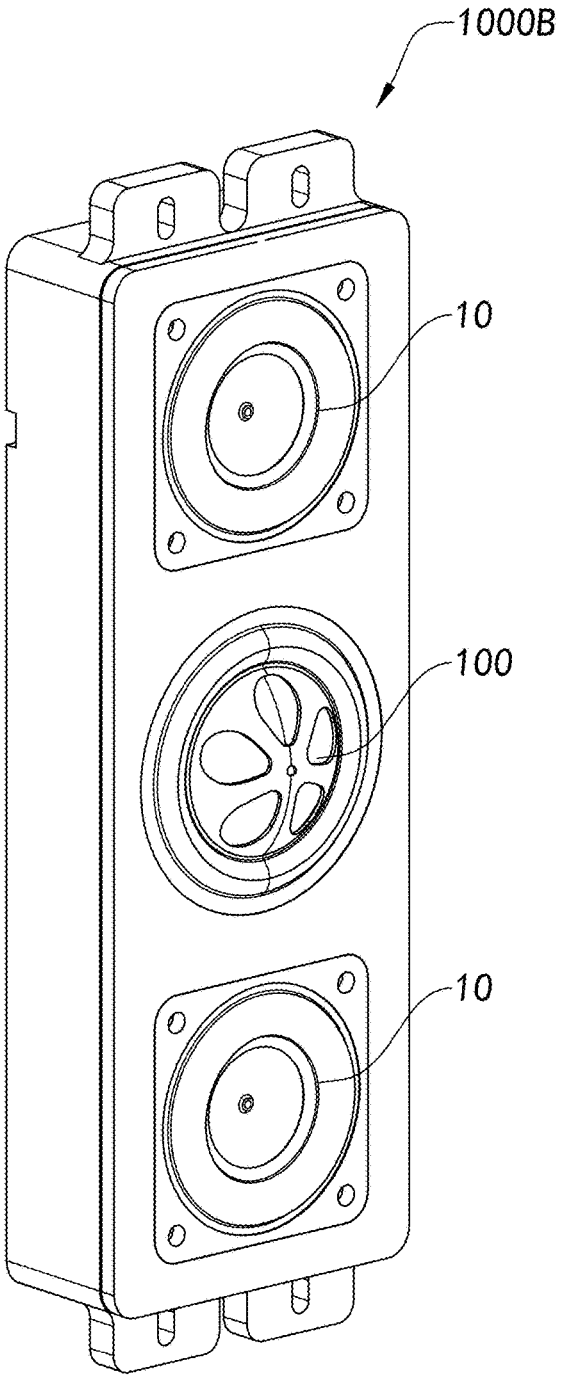
FIG. 12 is a perspective view illustrating another loudspeaker box made with the radiation device according to another alternative mode of the above first preferred embodiment of the present invention.

FIG. 12 illustrated a second alternative mode of the loudspeaker box equipped with the radiation device of the present invention. According to this second alternative mode, the loudspeaker box 1000B comprises only one speaker 100 and two radiation devices 10, wherein the single speaker 100 is arranged and positioned between the two radiation devices 10. When the speaker 100B produces sound wave, both the two radiation devices 10 respond to the low-frequency sound wave of produced by the speaker 100B so as to further enhance the low-frequency sound quality and to allow the loudspeaker box 1000B to provide better low frequency sound quality.

According to this second alternative mode of the present invention, the two radiation devices 10 and the one speaker 100 are coordinated and equipped with each other to create, define and form the loudspeaker box 1000B. Nevertheless, according to other embodiments, the present invention may also be implemented in other manners. For example, It can comprise two radiation devices 10 and two speakers 100, three radiation devices 10 and one speakers 100, and etc. Person skilled in the art should be able to understand that the quantity and arrangement of the radiation device 10 and the speaker 100 shall not be limits of the present invention.

Figure 13:
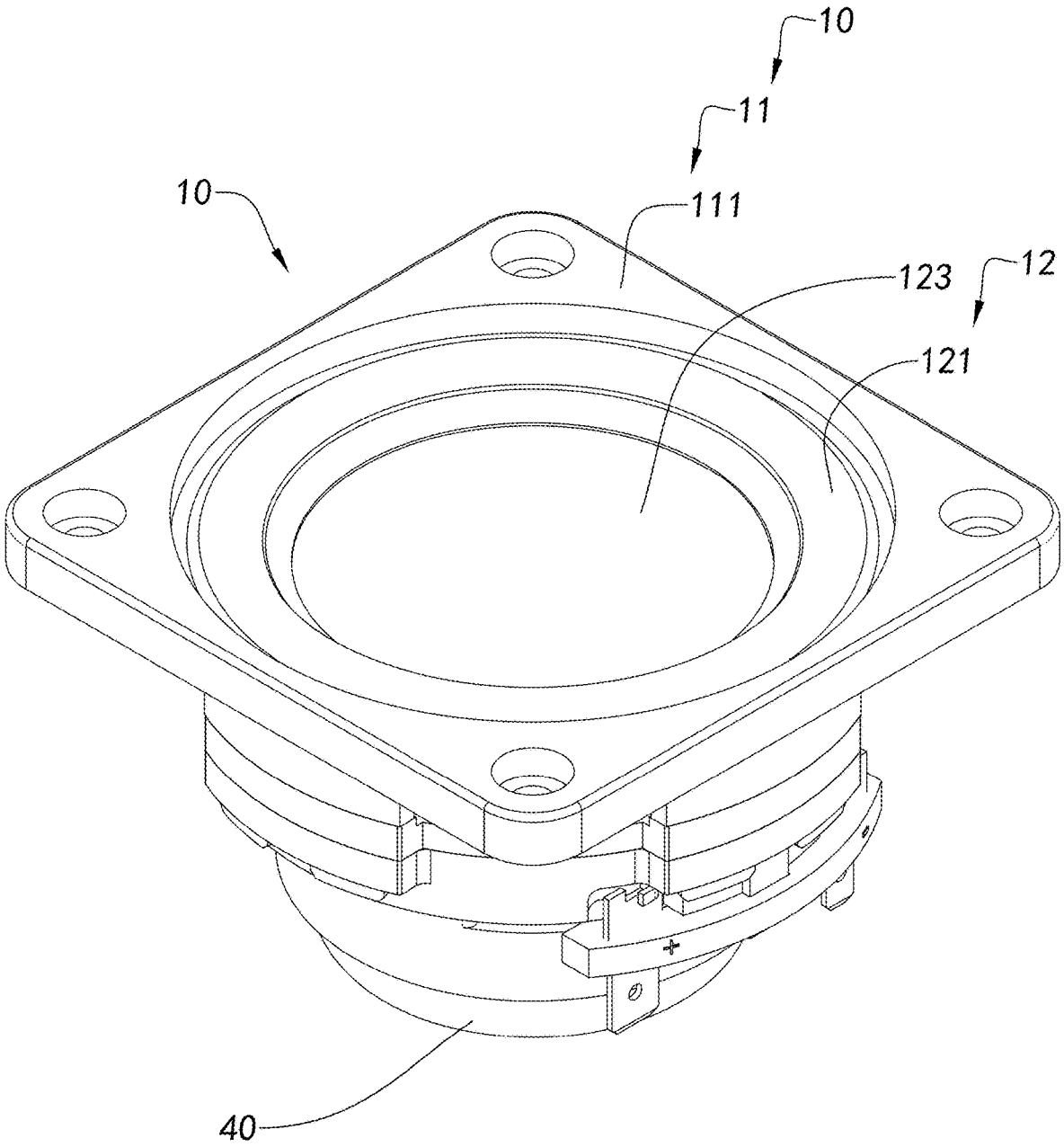
FIG. 13 is a perspective view of a dual suspension edge loudspeaker according to a second preferred embodiment of the present invention.
Figure 14:
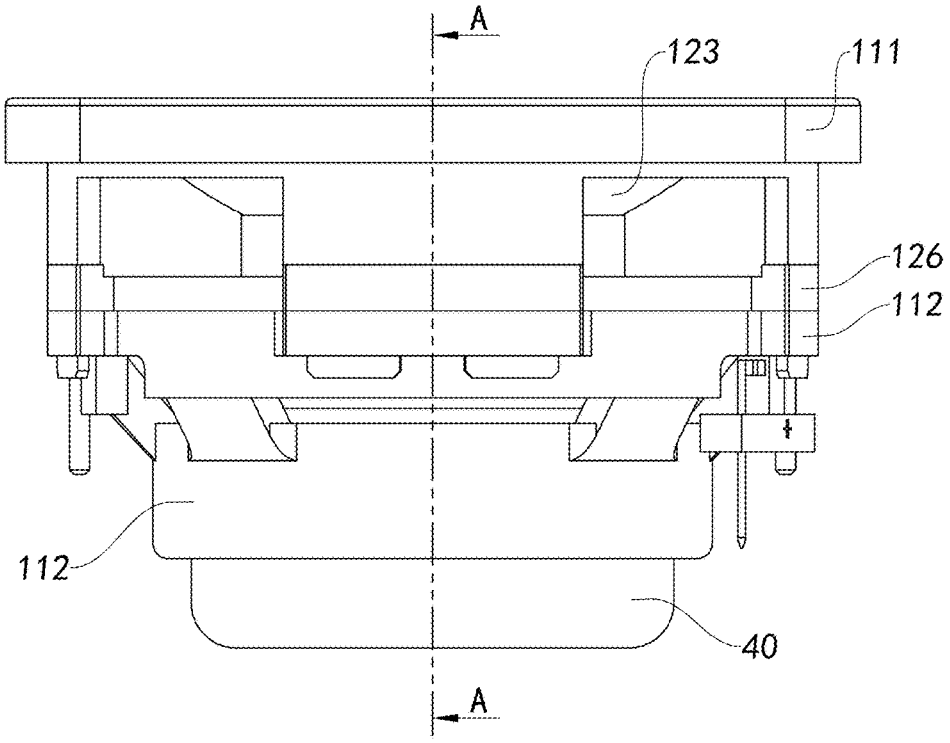
FIG. 14 is a front view of the dual suspension edge loudspeaker according to the above second preferred embodiment of the present invention.
Figure 15:
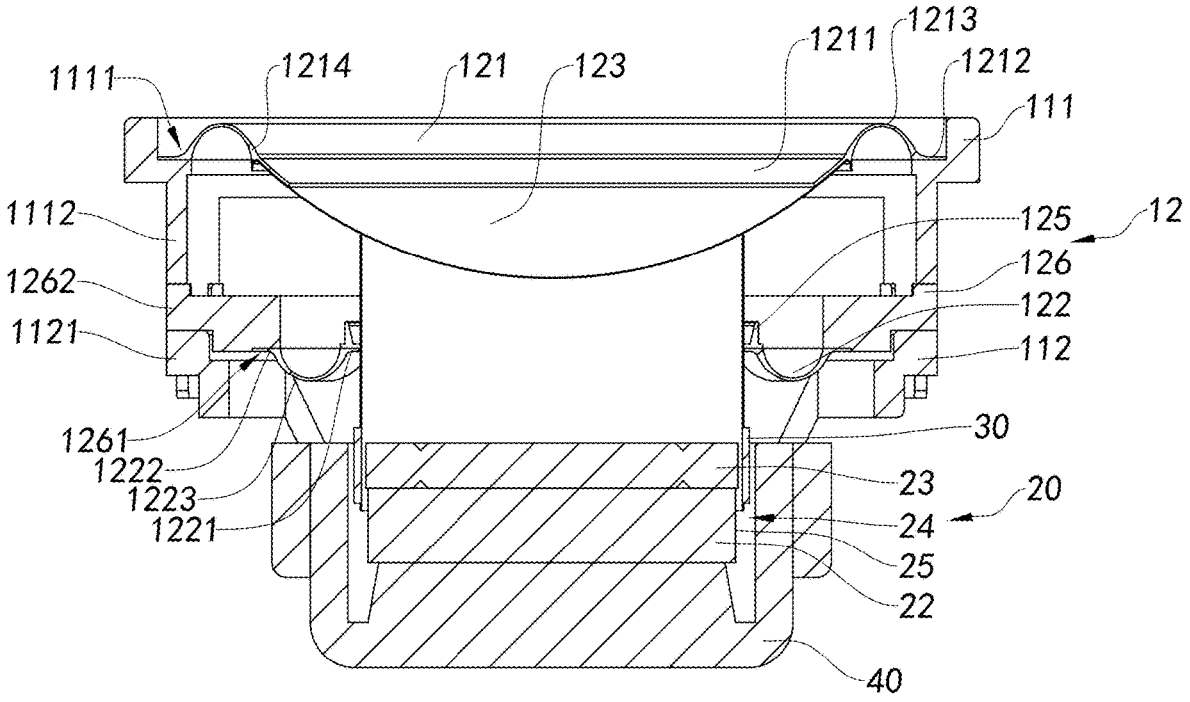
FIG. 15 is a sectional view of the dual suspension edge loudspeaker according to the above second preferred embodiment of the present invention.
Figure 16:
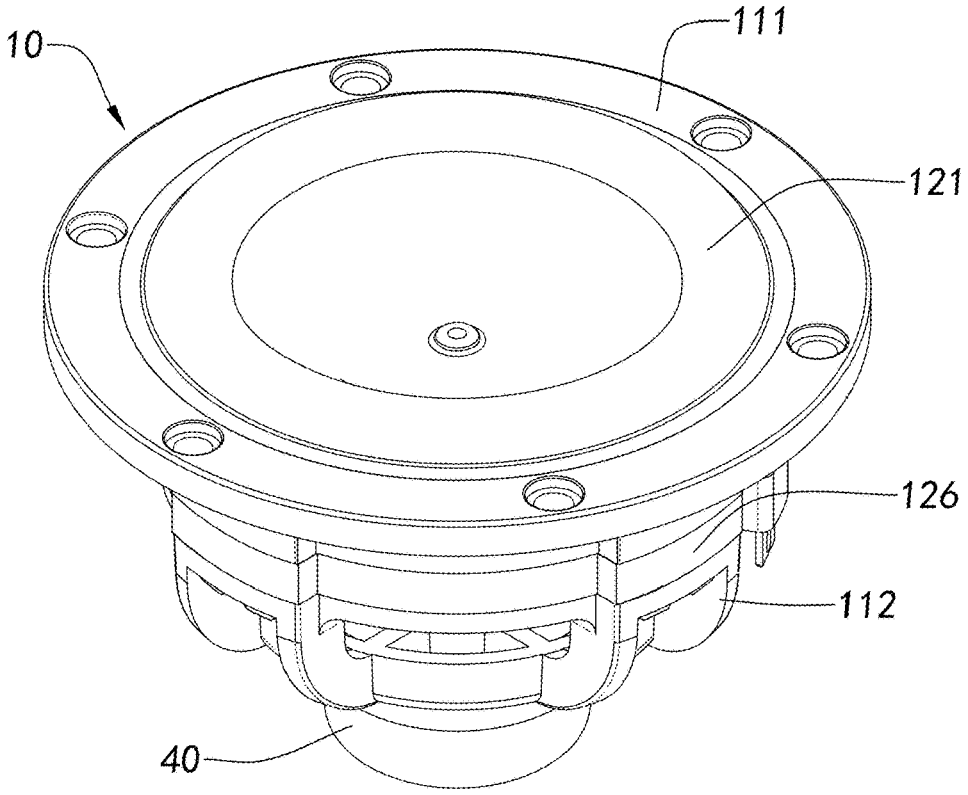
FIG. 16 is a perspective view of a dual suspension edge loudspeaker according to a first alternative mode of the above second preferred embodiment of the present invention.
Figure 17:
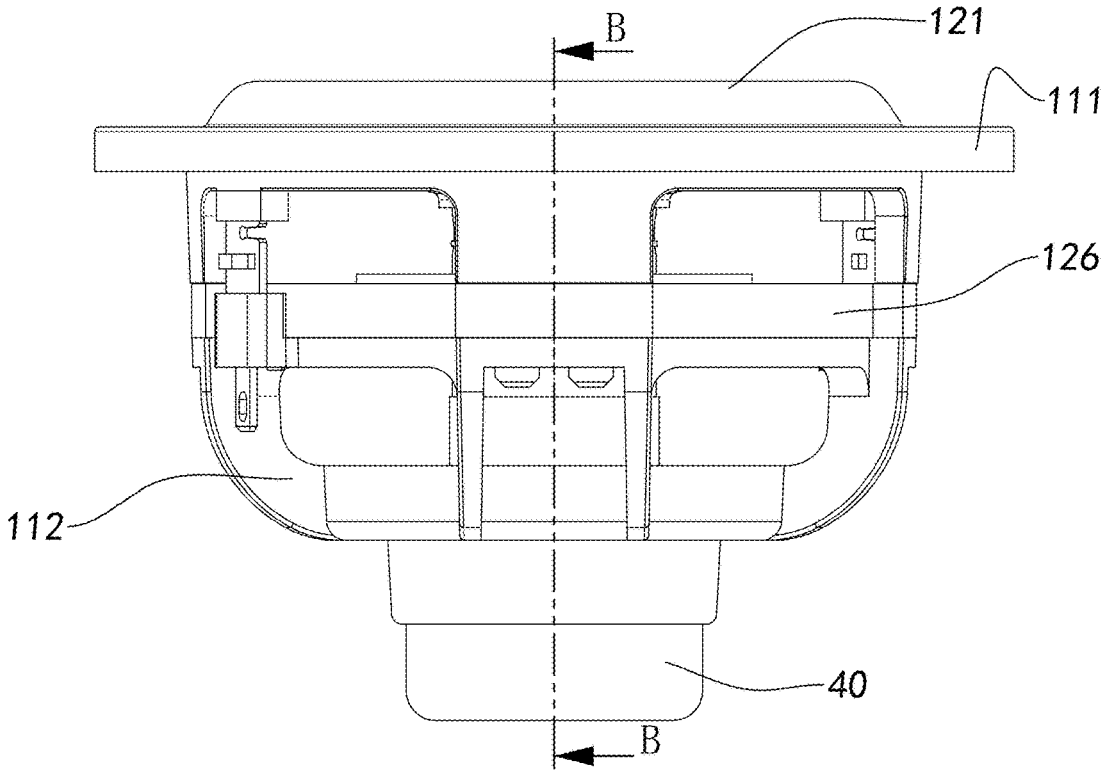
FIG. 17 is a front view of the dual suspension edge loudspeaker according to the above first alternative mode of the above second preferred embodiment of the present invention.

Referring to FIGS. 13-15, a dual suspension edge loudspeaker according to a second preferred embodiment of the present invention is illustrated, which comprises at least a radiation device 10, at least a magnetic system 20, at least a voice coil 30, and at least a vibration framework 40. One end of the voice coil 30 is connected with the radiation device 10 while the other end of the voice coil 30 is coupled with the magnetic system 20. The vibration framework 40 accommodates the magnetic system 20 therein and the voice coil 30 is installed between the radiation device 10 and the magnetic system 20. Furthermore, the voice coil 30 reciprocatingly moves under the influence of the electromagnetic driving force of the magnetic system 20, so as to drive and bring the radiation device 10 to move back and forth along an axial direction thereof to agitate the air in and around the dual suspension edge loudspeaker to produce sound.

According to this second preferred embodiment of the present invention, the radiation device 10 comprises a frame assembly 11 and a vibration assembly 12. The vibration assembly 12 is supported by the frame assembly 11 while the frame assembly 11 is adapted for mounting the radiation device 10 on the vibration framework 40. In this manner, the voice coil 30 can be connected with the radiation device 10 and coupled with the magnetic system 20, such that the radiation device 10 can be driven by the voice coil 30 to vibrate to produce sound.

The frame assembly 11 comprises a ring-shaped outer supporting frame 111 and a basket-shaped body frame 112. The vibration assembly 12 comprises a ring-shaped first suspension edge member 121, a ring-shaped second suspension edge member 122, a circular vibration element 123, an inner holding frame 125, and an outer holding frame 126.

The outer supporting frame 111 is adapted for supporting the first suspension edge member 121 and also for mounting the dual suspension edge loudspeaker in the loudspeaker box. The first suspension edge member 121 is arranged between the outer supporting frame 111 and the vibration element 123. In other words, the vibration element 123 is connected with outer supporting frame 111 through the first suspension edge member 121. When the vibration element 123 and the voice coil 30 vibrate, the displacement of the vibration element 123 from its original position will generate offset force which is transmitted to the outer supporting frame 111 through the first suspension edge member 121 that substantially provides a cushioning and buffering effect, such as a pulling force. Correspondingly, the first suspension edge member 121 also provides a reaction force with respect to the vibration element 123 for restoring the original position of the vibration element 123. Accordingly, the first suspension edge member 121 is a medium for the interaction between the vibration element 123 and the outer supporting frame 111. The first suspension edge member 121 and the vibration element 123 are made of resilience material, so as to ensure a gentle and soft transmission of the acting force and reaction force for the first suspension edge member 121 while the first suspension edge member 121 is transferring such acting force and reaction force, and that it also reduce the acting force applied to the outer supporting frame 111, such that the outer supporting frame 111 suffers less adverse influence due to the vibration of the vibration element 123.

According to this second preferred embodiment of the present invention, the second suspension edge member 122 is connected between the inner holding frame 125 and the outer holding frame 126. The body frame 112 affixes the outer holding frame 126 on the outer supporting frame 111. In other words, the outer holding frame 126 is positioned between the outer supporting frame 111 and the body frame 112. It is worth mentioning that the second suspension edge member 122 is fixed on the outer supporting frame 111 and the body frame 112 through the outer holding frame 126.

Further, the first suspension edge member 121 and the second suspension edge member 122 form the modularized radiation device 10 through the coupling of the outer supporting frame 111 and the body frame 112. The outer supporting frame 111 comprises at least one or more supporting frame coupling portions 1112. The body frame 112 comprises a body frame coupling portion 1121. The outer holding frame 126 comprises a support supporting frame coupling portion 1262. When there is only one supporting frame coupling portion 1112, it forms a closed circular wall, and when there is a plurality of supporting frame coupling portions 1112, they form an open supporting wall. The present second preferred embodiment is embodied to utilize an open supporting wall as an example for illustration. Nevertheless, this shall not be considered as a limitation to the present invention.

The supporting frame coupling portion 1112 is coupled with the support supporting frame coupling portion 1262, and the support supporting frame coupling portion 1262 is coupled with the body frame coupling portion 1121, such that the radiation device 10 is made. The supporting frame coupling portion 1112, the support supporting frame coupling portion 1262, and the body frame coupling portion 1121 can be coupled, joined or connected by various means, such as by matched buckling components, screw components, hot welding, ultrasonic bonding, and etc. In addition, the supporting frame coupling portion 1112 and the support supporting frame coupling portion 1262 and the body frame coupling portion 1121 form corresponding engaging grooves respectively, which can be a protruding step-shape and an indenting step-shape for ease of assemble and alignment. Besides, the support supporting frame coupling portion 1262 and the body frame coupling portion 1121 respectively have the same multiple perforations, so as to allow the supporting frame coupling portion 1112 to penetrate the support supporting frame coupling portion 1262 and the body frame coupling portion 1121 for ease of assemble and alignment.

According to this second preferred embodiment of the present invention, the first suspension edge member 121 can be made by means of integral injection molding technology and be connected with the vibration element 123 at the same time. Specifically, while the first suspension edge member 121 is integrally formed by injection molding, it may also be made integrally connecting with the outer supporting frame 111 simultaneously. In other words, the first suspension edge member 121, the vibration element 123 and the outer supporting frame 111 are integrated into an integral element by means of integral injection molding. In other words, the first suspension edge member 121 is made by embedding and injection molding technology, wherein the outer supporting frame 111 and the vibration element 123 are placed in the molding mould, and then the raw material in liquid form for manufacturing the first suspension edge member 121 is injected into the molding mould, wherein the material of the first suspension edge member 121 is extended and attached to the outer supporting frame 111 and the vibration element 123 to fix the outer supporting frame 111 and the vibration element 123 integrally after cooling and solidification to form an integral component.

Hence, it is appreciated that the second suspension edge member 122 can also be integrally formed by means of injection molding technology. In other words, the second suspension edge member 122, the inner holding frame 125, and the outer holding frame 126 are integrated into an integral component through integral injection molding. In other words, the inner holding frame 125 and the outer holding frame 126 are placed in the molding mould, and then the raw material in liquid form for manufacturing the second suspension edge member 122 is injected into the molding mould, wherein the material of the second suspension edge member 122 is extended and attached to the inner holding frame 125 and the outer holding frame 126 to affix the inner holding frame 125 and the outer holding frame 126 integrally after cooling and solidification to form an integral component.

According to this second preferred embodiment of the present invention, when the vibration element 123 responds to the sound of the voice coil 30 and vibrates, such as responding to a low frequency acoustic sound wave and then resonating and transmitting the sound wave through the surrounding air and etc., the low frequency acoustic sound wave and etc. is enhanced. Specifically, the vibration element 123 is embodied as a vibration diaphragm. It is worth mentioning that the vibration element 123 is made of metal material, such as aluminum material and etc. In other words, the vibration element 123 can be a metal diaphragm, such as aluminum diaphragm and the like. The first suspension edge member 121 is made with elastic material such as rubber which is integrally coupled and formed with the vibration element 123 so that the first suspension edge member 121 is arranged between the vibration element 123 and the outer supporting frame 111. Hence, it is appreciated that the first suspension edge member 121 and the vibration element 123 can be made of different materials. For instance, the first suspension edge member 121 is made of softer material while the vibration element 123 is made of harder material, that can substantially prevent rapid transmission of the pulling stress effectively and ensure the vibration of the vibration element 123 being more regularly.

Further, the first suspension edge member 121 is arranged surrounding around the vibration element 123, while the outer supporting frame 111 is arranged surrounding around the first suspension edge member 121. In other words, the vibration element 123, the first suspension edge member 121, and the outer supporting frame 111 are integrally formed as an annular track-like structure that each of the vibration element 123, the first suspension edge member 121, and the outer supporting frame 111 forms an individual track. In addition, the second suspension edge member 122 is arranged surrounding around the inner holding frame 125 and the outer holding frame 126 is arranged surrounding around the second suspension edge member 122. In other words, each of the second suspension edge member 122, the inner holding frame 125, and the outer holding frame 126 forms an annular track-like structure.

The annular structure can be an oval ring shape, a circular ring, a rectangular ring shape, or other similar ring shape structure. According to this second embodiment of the present invention, the annular structure is embodied as a circular ring shape. Nevertheless, according to other embodiments of the present invention, the annular structure can be embodied as a closed ring in various shapes, such as square, triangle, and etc. Person skilled in the art should understand that specific structural shape of the outer supporting frame 111, the first suspension edge member 121 and the vibration element 123, as well as the structure of the second suspension edge member 122, the inner holding frame 125 and the outer holding frame 126 shall not be considered as limitations of the present invention.

In other words, the outer supporting frame 111 is a ring-shape hollow panel, wherein the first suspension edge member 121 is positioned inside the hollow panel and the radiation device 10 is supported by the outer supporting frame 111. Specifically, in one embodiment of the present invention, the first suspension edge member 121 is embedded in the outer supporting frame 111. Further, the outer supporting frame 111 has a circular inner supporting groove 1111, located at an inner edge of the hollow panel, which is a circular indented from an upper surface of the outer supporting frame 111 for fittingly receiving an outer edge of the first suspension edge member 121 therein. Besides, the outer holding frame 126 is also a ring shaped hollow panel and the second suspension edge member 122 is positioned in the inside of the hollow panel. The outer holding frame 126 also has a circular outer support groove 1261, located at an inner edge of the hollow panel of the outer holding frame 126 for fittingly receiving an outer edge of the second suspension edge member 122 therein.

According to other embodiments of the present invention, the outer supporting frame 111 may also be formed through other components, such as the front panel of the loudspeaker box. That is the first suspension edge member 121 and the vibration element 123 can be directly mounted on the front panel of the loudspeaker box without the need to make an independent outer supporting frame 111, i.e. utilizing the front panel of the loudspeaker box as the outer supporting frame 111.

According to this second preferred embodiment of the present invention, the first suspension edge member 121, having a curved cross section, is curvedly extended and connected between the outer supporting frame 111 and the vibration element 123, instead of being extended between the outer supporting frame 111 and the vibration element 123 in a planar manner, so as to better cushion and buffer the offset force of the vibration element 123 during vibration. In other words, the first suspension edge member 121 reduces the influence of the vibration of the vibration element 123 on the outer supporting frame 111. In particular, the first suspension edge member 121 comprises an annular first inner connection portion 1211, an annular first outer connection portion 1212 and an annular first suspension body 1213 extended between the first inner connection portion 1211 and the first outer connection portion 1212. Further, the first outer connection portion 1212 is formed and shaped to be fittingly placed in the supporting groove 1111 of the outer supporting frame 111 while the first inner connection portion 1211 and the vibration element 123 are integrally molded to be formed and connected. In addition, according to other embodiments, the first suspension body 1213 is protruded/indented or further folded between the first inner connection portion 1211 and the first outer connection portion 1212 in form of pleat(s), arch(es), or wave(s) structure, according to the design and modification based on actual needs. Therefore, it should be understood that the scope of the present invention shall not be limited with the shape of the first suspension body 1213. In other words, a cross sectional shape of the first suspension edge member 121 can be selected from the group consisting of arch shape, W-shape, M-shape, S-shape, inverted S-shape, V-shape, inverted V-shape, U-shape, inverted U-shape, wavy, and zigzag. Besides, according to other embodiments, a plurality of resilient ribs is able to be spacedly formed along a circumferential direction on the first suspension body 1213, wherein the resilient ribs can be radially, evenly and uniformly arranged so as to limit the displacement direction of the first suspension body 1212 in the axial direction thereof. It is worth mentioning that the resilient ribs may also be in form of protrusions or indentions. In addition, a reinforcement joint portion 1214 is further formed between the first inner connection portion 1211 and the first suspension body 1213. The end of the vibration element 123 connected with the first inner connection portion 1211 matches the shape of the reinforcement joint portion 1214 and is coupled with the first inner connection portion 1211, such that a firmer connection between the first suspension edge member 121 and the vibration element 123 is achieved. It is appreciated that the second suspension edge member 122 is curvedly connected between the inner holding frame 125 and the outer holding frame 126 in a smooth and curve surface manner, instead of in a plane manner. Specifically, the shape of the second suspension edge member 122 is the same or similar with the shape of the first suspension edge member 121 symmetrically. In other words, when the first suspension edge member 121 is protruded outwardly, the second suspension edge member 122 is indented inwardly. Accordingly, when the voice coil 30 drives and brings the vibration element 123 to move, the first suspension edge member 121 and the second suspension edge member 122 are interacting with each other to further cancel out the shaking tendency due to the vibration of the vibration element 123. It is worth mentioning that a cross sectional shape of the second suspension edge member 122 is selected from the group consisting of arch shape, W-shape, M-shape, S-shape, inverted S-shape, V-shape, inverted V-shape, U-shape, inverted U-shape, wavy, and zigzag.

Further, the second suspension edge member 122 is curvedly connected between the inner holding frame 125 and the outer holding frame 126 in a smooth and curve surface manner, instead of in a plane manner, so as to better cushion and buffer the offset force of the vibration element 123 during vibration. Further, the second suspension edge member 122 comprises a second inner connection portion 1221, a second outer connection portion 1222 and a second suspension body 1223 positioned between the second inner connection portion 1221 and the second outer connection portion 1222. Further, the second outer connection portion 1222 is fittingly received in the external support groove 1261 of the outer holding frame 126. The second inner connection portion 1221 and the inner holding frame 125 are integrally formed and connected. In addition, the second suspension body 1223 is protruded/indented or further folded between the second inner connection portion 1221 and the second outer connection portion 1222 in form of pleat(s), arch(es), or wave(s) structure, according to the design and modification based on actual needs. Of course, according to the actual needs, the second suspension body 1223 may also be in plane shape and the like. Hence, the scope of the present invention shall not be limited with the shape of the second suspension body 1223. Besides, a plurality of resilient ribs is able to be provided along an annular direction on the second suspension body 1223, wherein the resilient ribs can be radially, evenly and uniformly arranged so as to limit the displacement direction of the first suspension body 1212 in the axial direction thereof. It is worth mentioning that the resilient ribs may also be in form of protrusions or indentions.

According to this second embodiment of the present invention, the vibration element 123 is connected with the first suspension edge member 121 in a curvedly extending manner. Specifically, each of the arch shaped first suspension edge member 121 and the arch shaped second suspension edge member 122 has a protruding convex side and a concave side defining an opening, wherein the openings of first suspension edge member 121 and the second suspension edge member 122 are arranged facing opposite directions. That is, the arch shaped first suspension edge member 121 and the arch shaped second suspension edge member 122 are arranged protruding in opposite directions, so that by means of the mechanical characteristics of the arch shape structure, the pulling force generated during the vibration of the vibration element 123 is cushioned and buffered by the arch shaped first and second suspension edge members 121, 122. Accordingly, the shapes and structures of the first suspension edge member 121 and the second suspension edge member 122 can be designed to coordinate with each other based on the actual condition and requirement.

According to the present embodiment of the present invention, the vibration element 123 is connected with the first suspension edge member 121 in a curvedly extending manner, wherein the curving direction of the vibration element 123 and the curving direction of the first suspension edge member 121 are in opposite directions, so as to better cushioning and buffering the acting force of the vibration element 123. More specifically, the vibration element 123 is concavely and downwardly curved towards the second suspension edge member 122 and the first suspension edge member 121 is convexly and upwardly curved away from the second suspension edge member 122. More specifically, the first suspension edge member 121 is protruded convexly and upwardly in arch shape and the vibration element 123 is indented concavely and downwardly in arch shape, so that two opposing arched structures are formed for better cushioning and buffering the vibrating force of the vibration element 123 and providing a gentle and flexible restoring force for the vibration element 123. According to another embodiment of the present invention, the first suspension edge member 121 may be made in concave arch shape and the vibration element 123 may be made in convex arch shape corresponding to provide a better cushioning and buffering for the acting force of the vibration element 123.

According to this embodiment of the present invention, the first suspension edge member 121 is integrally and curvedly connected to an outer side of the vibration element 123.

According to the present embodiment of the present invention, the outer holding frame 126 is positioned between the body frame 112 and the outer supporting frame 111 and the outer supporting frame 111 is assembled and connected with the body frame 112. In other words, the outer holding frame 126 is clamped and held in position by and between the body frame 112 and the outer supporting frame 111. The second suspension edge member 122 is connected between the inner holding frame 125 and the outer holding frame 126, while the outer holding frame 126 is assembled and connected with the body frame 112. Further, when the outer supporting frame 111 is used to merely affix the outer holding frame 126, as shown in FIG. 15, the concave sides of the suspension edge member 121 and the second suspension edge member 122 of the radiation device 10 are opposingly facing each other. Particularly, it is appreciated that such opposing arch structure as described above is not only adaptable for the embodiments of the present invention, but also adaptable for being utilized in other types of the vibration system or the audio system.

The second suspension edge member 122 is extended and connected between the body frame 112 and the voice coil 30 in a curved manner and the curving direction of the second suspension edge member 122 is opposite to the curving direction of the first suspension edge member 121. According to the present embodiment of the present invention, the first suspension edge member 121 is convexly and outwardly curved the second suspension edge member 122 is concavely and inwardly curved so as to cooperatively cushion and buffer the acting forces of the vibration element 123 to the outer supporting frame 111 and the body frame 112 and provides a soft and gentle restoring force for the vibration element 123. In addition, the second suspension edge member 122 is connected between the inner holding frame 125 and the outer holding frame 126, wherein the second suspension edge member 122 is connected with the voice coil 30 through the inner holding frame 125 and connected with the body frame 112 through the outer holding frame 126. Preferably, the second inner connection portion 1221 and the second outer connection portion 1222 of the second suspension edge member 122, i.e. the inner and outer fringes thereof, are respectively attached on the bottom surfaces of the inner holding frame 125 and the outer holding frame 126, so that the inner and outer fringes of the second suspension edge member 122 can provide more attaching area than simply the end contacting, such that the second suspension edge member 122 can be firmly and steady connected with the inner holding frame 125 and the outer holding frame 126.

Besides, when the radiation device 10 is connected to the voice coil 30, the voice coil 30 vibrates under the driving of the electromagnetic driving force of the magnetic system 20 and the radiation device 10 is driven to vibrate correspondingly. During the vibration process, when the vibration element 123 generates an inward movement, a downward pulling force is generated to the first suspension edge member 121. However, the arch shaped structure of the first suspension edge member 121 substantially reduces the pulling force rapidly and gently provides a restoring force to the vibration element 123, so as to avoid the outer supporting frame 111 from being affected by the vibration element 123. Also, due to the concave sides of both the arch shaped first suspension edge member 121 and second suspension edge member 122 are facing with each other in opposite direction, when the first suspension edge member 121 produces a downward acting force, the vibration directions of the first suspension edge member 121 and the second suspension edge member 122 are opposite, so as to avoid undesirable tendency, such as shaking, shifting, and etc., from occurring when the dual suspension edge loudspeaker is vibrating to produce sound, such that a purer sound effect of the dual suspension edge loudspeaker can be ensured.

It is worth mentioning that the dual suspension edge member low frequency responding structure constructed by the first suspension edge member 121 and the second suspension edge member 122 of the present invention is different from conventional single suspension edge member passive member and performs better in low frequency responding than the conventional single suspension edge member passive member too. As for the conventional single suspension edge member passive member, the vibrating diaphragm is connected with the bracket through a suspension edge member. If the vibrating diaphragm is too thin, the durability will be relatively poor and the vibration of the vibrating diaphragm is uneven and generates noise like "papa . . . " easily. Nevertheless, according to the preferred second embodiment of the present invention, due to the interaction between the two opposing suspension edge members, the shaking generated when the vibration element 123 is driven by the voice coil 30 to vibrate is cancelled out, ensuring the stress applied to the vibration element 123 is even and uniform. Accordingly, even if the vibration element 123 has a thinner thickness, the vibration element 123 can still produce a relatively even and uniform movement without generating such "papa . . . " noise. Also, based on the supports of the voice coil 30 and the inner holding frame 125, the first suspension edge member 121 and the second suspension edge member 122 can be made with relatively softer and lighter material while meeting the motion requirements of the vibration element 123. When the vibration element 123 can be made with relatively lighter and thinner material and responds to sound wave to vibrate naturally, the vibration element 123 can produce larger amplitude, so as to enhance the quality of low-frequency response to the sound wave. In addition, when the first suspension edge member 121 and the second suspension edge member 122 are made with more soft and gentle material, due to the better resilience provided, the vibration element 123 would produce larger vibration amplitude.

It is worth mentioning that, according to this embodiment of the present invention, the vibration element 123 is in circular shape: however, according to other embodiments of the present invention, the vibration element 123 may also be in other shapes, such as rectangle, triangle, and etc. Certainly, the shapes of the first suspension edge member 121 and the second suspension edge member 122 can be modified correspondingly according to the shape of the vibration element 123. Person skilled in the art should understand that the shapes of the vibration element 123, the first suspension edge member 121 and the second suspension edge member 122 shall not be considered as limitation to the scope of the present invention.

According to some embodiments of the present invention, alternatively, the outer supporting frame 111 of the radiation device 10 can also be connected to the vibration framework 40. In other words, the vibration framework 40 is embodied as the body frame 112 of the radiation device 10 for directly mounting the second suspension edge members 122 of the radiation device 10 to the vibration framework 40. Specifically, the radiation device 10 and the magnetic system 20 and the voice coil 30 and the vibration framework 40 are arranged correspondingly to form the dual suspension edge loudspeaker and define an enclosed space therein.

According to this second preferred embodiment of the present invention, the magnetic system 20 comprises at least a permanent magnetic member 22 and at least a magnetic conductor 23. The permanent magnetic member 22 is arranged below the magnetic conductor 23 and in the vibration framework 40. Also, a magnetic gap 24 is formed between the permanent magnetic member 22 and the vibration framework 40. One end of the voice coil 30 is connected with the vibration element 123 of the vibration assembly 12 of the radiation device 10, while the other end of the voice coil 30 is coupled within the magnetic gap 24 of the magnetic system 20. The vibration framework 40 may have a conventional U-shape metal structure, while the magnetic conductor 23 may have a conventional polar structure. The vibration framework 40 and the magnetic conductor 23 direct the magnetic field of the permanent magnetic member 22 in the magnetic gap 24, so as to enable the magnetic system 20 to interact with the voice coil 30 arranged in the magnetic gap 24. In other words, the vibration framework 40, the permanent magnetic member 22, and the magnetic conductor 23 jointly form the magnetic field loops and coordinate with the voice coil 30 to generate vibration.

According to this second preferred embodiment of the present invention, the permanent magnetic member 22 may be various kinds of magnet, ferrimagnet or magnet steel, including metal magnet, ferrite magnet, rare earths magnet, and etc. According to this preferred embodiment of the present invention, the permanent magnetic member 22 can be an NdFeB magnet, which provides magnetic energy in the magnetic system 20 and forms magnetic field loops in the magnetic gap 24.

Besides, the magnetic system 20 may also be embodied in other manners. For example, the magnetic system 20 also comprises a connector 25 connected with the vibration framework 40, the permanent magnetic member 22 and the magnetic conductor 23 so as to form an integral structure. In other words, no adhesive is required for adhering connection and the magnetic system 20 is made an integral structure through the connector 25, wherein each component is arranged at its appropriate position to provide the magnetic field loops. Preferably, the connector 25 is embedded in position by means of injection molding technology. In other words, the vibration framework 40, the permanent magnetic member 22, and the magnetic conductor 23 are placed in the molding mould and then the raw material in liquid form for manufacturing the connector 25 is injected into the molding mould. The material of the connector 25 is attached on the vibration framework 40, the permanent magnetic member 22 and the magnetic conductor 23, wherein after cooling and solidification, the connector 25 is affixed with the vibration framework 40, the permanent magnetic member 22 and the magnetic conductor 23.

It is appreciated that the components of the magnetic system 20 can be connected by adhesive to form an integral structure through the conventional adhesive bonding technique. Alternatively, the magnetic system 20 may also be integrally made through injection molding technology. More specifically, the vibration framework 40, the permanent magnetic member 22 and the magnetic conductor 23 can be molded to form the integral structure by means of injection molding.

Referring to FIGS. 16-18B, a first alternative mode of the above second preferred embodiment of the present invention is illustrated, wherein a different structure of the vibration assembly 12 is embodied and illustrated.

The vibration assembly 12 comprises a first suspension edge member 121, a second suspension edge member 122, a vibration element 123, an inner holding frame 125, and an outer holding frame 126.

The vibration element 123 is attached to the first suspension edge member 121, while the first suspension edge member 121 is configured with the outer supporting frame 111. The first suspension edge member 121 integrally comprises a disc-shaped first inner connection portion 1211, an annular first outer connection portion 1212 and an annular first suspension body 1213 positioned between the first inner connection portion 1211 and the first outer connection portion 1212. The vibration element 123 is in disc shape adapted to be completely and fittingly attached to the disc-shaped first inner connection portion 1211 of the first suspension edge member 121. In other words, the first inner connection portion 1211 covers the entire surface of the vibration element 123.

In addition, a reinforcement joint portion 1214 is further formed in a middle portion of the first inner connection portion 1211, wherein a middle portion of the vibration element 123 which is connected with the first inner connection portion 1211 and the reinforcement joint portion 1214 are made to have the same shape correspondingly to attach with each other, so as to provide a firmer connection between the first suspension edge member 121 and the vibration element 123.

Figure 18A:
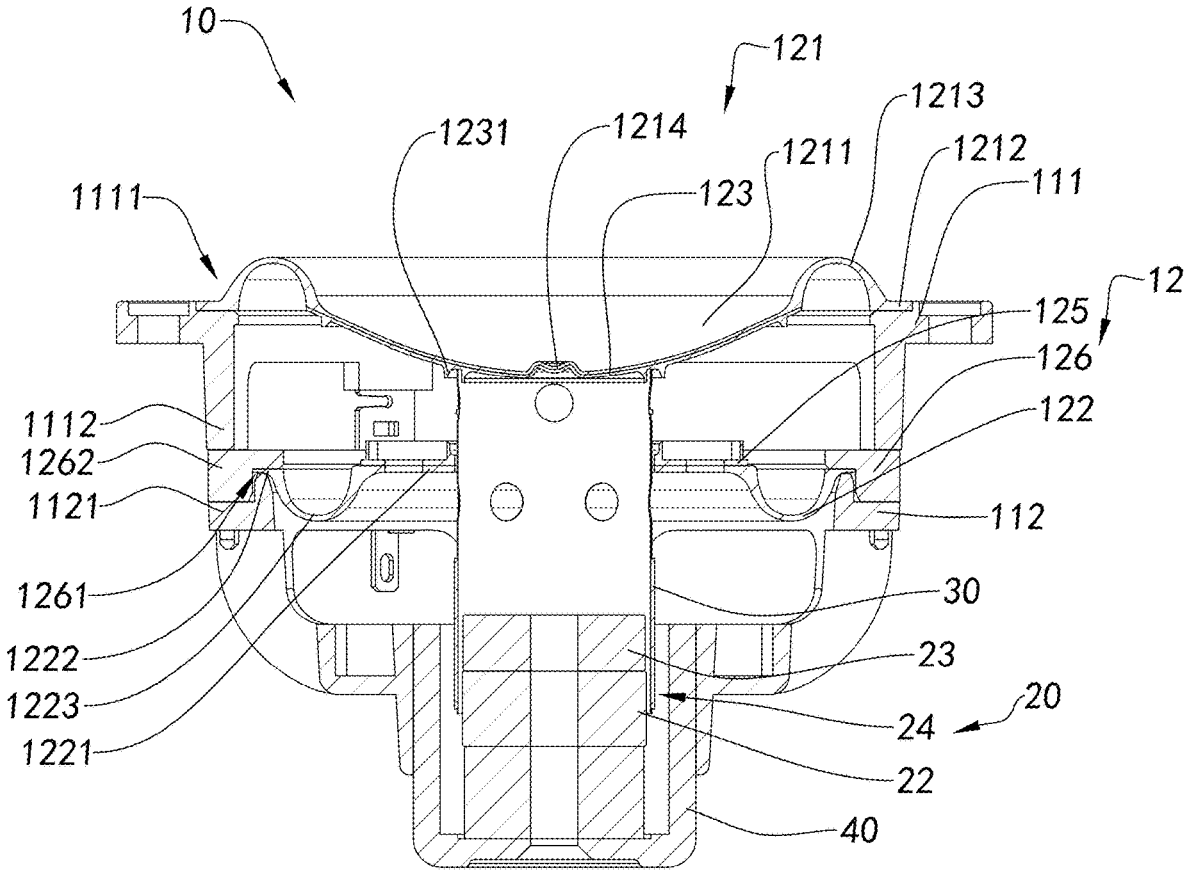
FIG. 18A is a sectional view of the dual suspension edge loudspeaker according to the above first alternative mode of the above second preferred embodiment of the present invention.
Figure 18B:
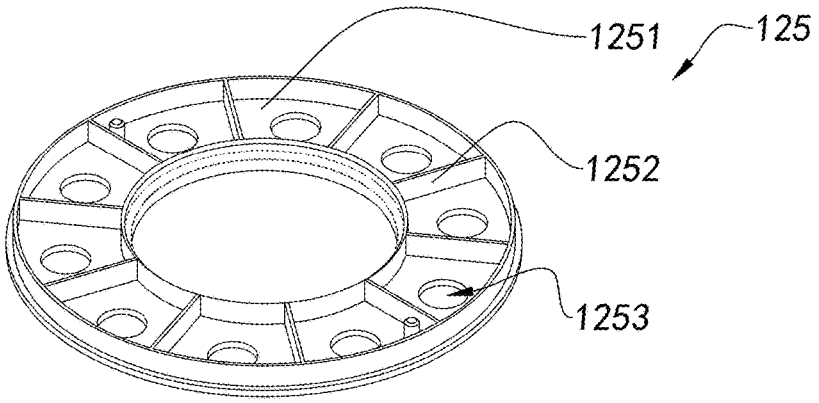
FIG. 18B is a perspective view of an inner holding frame of the dual suspension edge loudspeaker according to the above first alternative mode of the above second preferred embodiment of the present invention.

In addition, the second suspension edge member 122 is connected between the inner holding frame 125 and the outer holding frame 126. The body frame 112 affixes the outer holding frame 126 on the outer supporting frame 111. In other words, the outer holding frame 126 is positioned between the outer supporting frame 111 and the body frame 112. It is understandable that the second suspension edge member 122 is affixed on the outer supporting frame 111 and the body frame 112 through the outer holding frame 126. Specifically, as shown in FIG. 18B, according to the first alternative mode of the second preferred embodiment, the inner holding frame 125 has a plurality of grooves 1251 radially and circumferentially and a plurality of perforations 1253 radially formed in the plurality of grooves 1251 respectively, wherein a rib 1252 is formed between every two grooves 1251, such that the action of the second suspension edge member 122 will not be affected when the inner holding frame 125 having a larger size is utilized. It is worth mentioning that when the size of the first suspension edge member 121 is larger than the size of the second suspension edge member 122, the sizes of the inner holding frame 125 and the outer holding frame 126 can be designed correspondingly to adjust the relative position of the second suspension edge member 122 with respect to the first suspension edge member 121. In other words, when the inner diameter or inner caliber of the outer holding frame 126 is larger, the second suspension edge member 122 would be arranged relatively closer to the first suspension edge member 121. On the contrary, when the inner diameter or inner caliber of the outer holding frame 126 is smaller, the second suspension edge member 122 would be arranged relatively farther away from the first suspension edge member 121. It is apparent that the first suspension edge member 121 and the second suspension edge member 122 would be made to have the same size.

Besides, the vibration element 123 also comprises a voice coil coupling portion 1231, which extends from the vibration element 123 towards the voice coil to form a annular coupling groove for mounting and restricting the voice coil in position. Accordingly, one end of the voice coil 30 is connected with the voice coil coupling portion 1231 of the vibration element 123 of the vibration assembly 12 of the radiation device 10, while the other end of the voice coil 30 is coupled with the magnetic system 20. Such that, the voice coil 30 moves reciprocatingly under the influence of the electromagnetic driving force of the magnetic system 20, so as to drive and bring the radiation device 10 to move back and forth along its axial direction to agitate and vibrate the air inside and around the dual suspension edge loudspeaker to produce sound.

Figure 19:
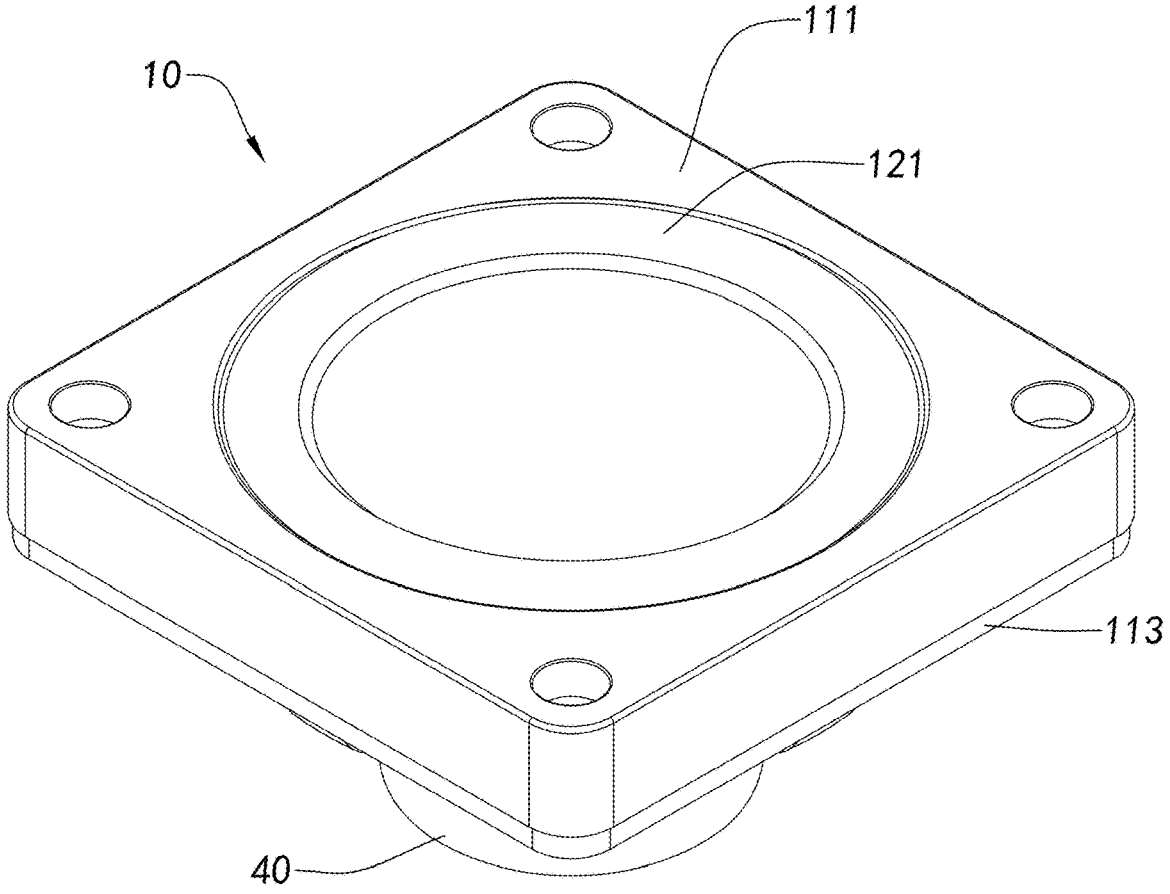
FIG. 19 is a perspective view of a dual suspension edge loudspeaker according to a second alternative mode of the above second preferred embodiment of the present invention.
Figure 20:
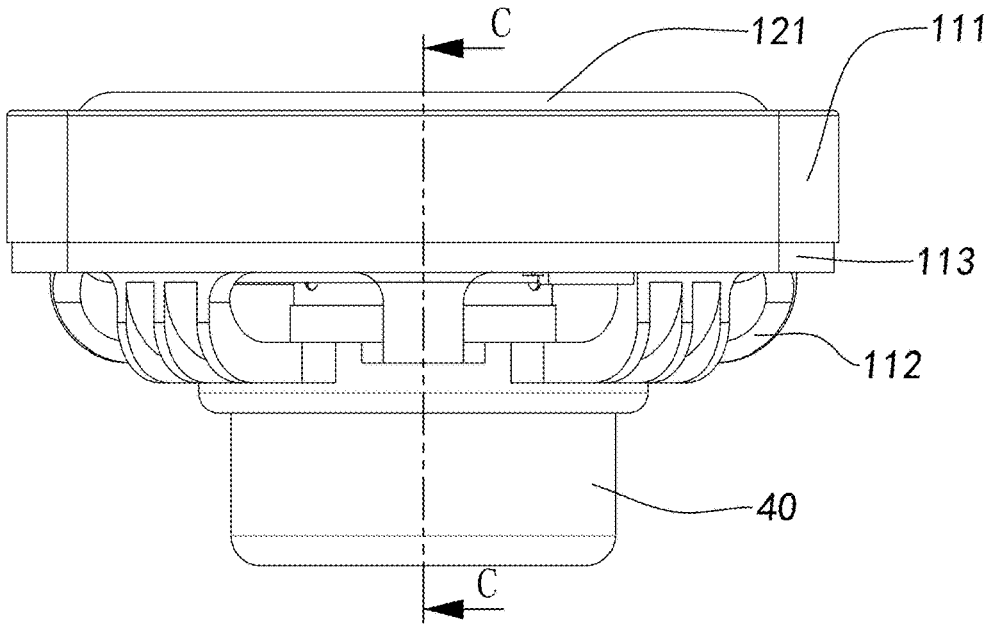
FIG. 20 is a front view of the dual suspension edge loudspeaker according to the above second alternative mode of the above second preferred embodiment of the present invention.

Referring to FIGS. 19-21, a second alternative mode of the above second preferred embodiment of the present invention is illustrated, wherein different structure of the vibration assembly 12 is embodied and illustrated.

The vibration assembly 12 comprises a first suspension edge member 121, a second suspension edge member 122, an inner holding frame 125, an outer holding frame 126, a suspension edge member inner holding frame 127, and a suspension edge member outer holding frame 128.

The first suspension edge member 121 is connected between the suspension edge member inner holding frame 127 and the suspension edge member outer holding frame 128. The second suspension edge member 122 is connected between the inner holding frame 125 and the outer holding frame 126. The body frame 112 and the outer supporting frame 111 clamp and hold the outer holding frame 126 and the suspension edge member outer holding frame 128 therebetween. In other words, the outer holding frame 126 and the suspension edge member outer holding frame 128 are positioned between the outer supporting frame 111 and the body frame 112. Specifically, the outer holding frame 126 and the suspension edge member outer holding frame 128 can be assembled and affixed in position through the outer supporting frame 111 and the body frame 112. In addition, according to another implementation as shown in this second alternative mode of the second preferred embodiment of the present invention, the frame assembly 11 may also comprise an affixing frame 113 for affixing the outer supporting frame 111 and the body frame 112. In other words, the outer supporting frame 111 and the body frame 112 are only used for supporting and enclosing the outer holding frame 126 and the suspension edge member outer holding frame 128 while the outer supporting frame 111 and the body frame 112 is affixed by affixing frame.

According to this second alternative mode of the second preferred embodiment of the present invention, the first suspension edge member 121 can be made by means of integral injection molding technology and be connected with the suspension edge member inner holding frame 127 and the suspension edge member outer holding frame 128 at the same time. In other words, the first suspension edge member 121, the suspension edge member inner holding frame 127 and the suspension edge member outer holding frame 128 are integrated into an integral component through integral injection molding technology. It is understandable that the first suspension edge member 121 is embedded in position by means of the injection molding technology. In other words, the suspension edge member inner holding frame 127 and the suspension edge member outer holding frame 128 are placed in the molding mould and then the raw material in liquid form for manufacturing the first suspension edge member 121 is injected into the molding mould, wherein the material of the first suspension edge member 121 would attach on the suspension edge member inner holding frame 127 and the suspension edge member outer holding frame 128 to affix the suspension edge member inner holding frame 127 and the suspension edge member outer holding frame 128 after cooling and solidification to form the integral component.

Similarly, according to second alternative mode of the second preferred embodiment of the present invention, the second suspension edge member 122 can also be made by means of integral injection molding technology and be connected with the inner holding frame 125 and the outer holding frame 126 at the same time. In other words, the second suspension edge member 122, the inner holding frame 125 and the outer holding frame 126 are integrated into an integral component through integral injection molding technology. It is understandable that the second suspension edge member 122 is embedded in position by means of injection molding technology. In other words, the inner holding frame 125 and the outer holding frame 126 are placed in the molding mould and then the material in liquid form for manufacturing the second suspension edge member 122 is injected into the molding mould, wherein the material of the second suspension edge member 122 would attach on the inner holding frame 125 and the outer holding frame 126 to affix the inner holding frame 125 and the outer holding frame 126 after cooling and solidification to form the integral component.

It is worth mentioning that the outer holding frame 126 and the suspension edge member outer holding frame 128 can be pre-assembled so as to construct a dual suspension edge member device by the first suspension edge member 121 and the second suspension edge member 122. The outer holding frame 126 and the suspension edge member outer holding frame 128 of the dual suspension edge member device can be coupled, joined or connected by various means, such as through matched buckling components, screw components, hot welding, ultrasonic bonding, and etc. Besides, the outer holding frame 126 and the suspension edge member outer holding frame 128 may also be affixed through the outer supporting frame 111 and the body frame 112 or, alternatively, combining the first suspension edge member 121 and the second suspension edge member 122 into a dual suspension edge member device that has a framework as the radiation device 10. The outer supporting frame 111 and the body frame 112 can be coupled, joined or connected by various means, such as through matched buckling components, screw components, hot welding, ultrasonic bonding, and etc. The above two types of dual suspension edge member device can be considered as a modular structure for utilizing in various types of the audio system or the vibration system.

Furthermore, through the coupling of the outer supporting frame 111 and the body frame 112, the first suspension edge member 121 and the second suspension edge member 122 form the modularized dual suspension edge member device. The outer supporting frame 111 comprises one or more supporting frame coupling portions 1112. The body frame 112 comprises a body frame coupling portion 1121. When there is only one supporting frame coupling portion 1112, it forms a closed circular supporting wall. When there are multiple supporting frame coupling portions 1112, they form an opened circular supporting wall. The present embodiment utilizes a closed supporting wall as an example for illustration purpose but not intending to limit the scope of the present invention.

The supporting frame coupling portion 1112 and the body frame coupling portion 1121 are connected to form the radiation device 10. The supporting frame coupling portion 1112 and the body frame coupling portion 1121 can be coupled, joined or connected by various means, such as through matched buckling components, screw components, hot welding, ultrasonic bonding, and etc. In addition, engagement grooves are formed in the supporting frame coupling portion 1112 and the body frame coupling portion 1121 respectively and correspondingly, wherein one of the engagement grooves can be embodied as having a protruding step shape and the other engagement groove can be embodied as having a sunken step shape adapted for fittingly coupling with each other for ease of assembling and aligning. It is worth mentioning that whether it is protruding step shaped or sunken step shaped, it is preferred to be in multi-level step shape adapted for not only connecting the outer supporting frame 111 and the body frame 112 but also configuring the outer holding frame 126 and the suspension edge member outer holding frame 128.

It is worth mentioning that, unlike the above embodiments, the vibration element 123 of the vibration assembly 12 as illustrated in the above embodiments is substituted by a circular and planar first inner connection portion 1211 of the first suspension edge member 121. In other words, the first suspension edge member 121 comprises the first inner connection portion 1211, a first outer connection portion 1212 and a first suspension body 1213 positioned between the first inner connection portion 1211 and the first outer connection portion 1212. The first inner connection portion 1211 of the first suspension edge member 121 forms a complete plane surface and functions as the vibration element 123, wherein the suspension edge member inner holding frame 127 is completely attached on the first inner connection portion 1211 while the voice coil 30 is connected with the suspension edge member inner holding frame 127. Further, the suspension edge member inner holding frame 127 also comprises a voice coil joint portion 1271, extended from the suspension edge member inner holding frame 127 towards the voice coil 30 to form a joint groove for the voice coil 30 to couple with the suspension edge member inner holding frame 127 and to further restrict and limit the position of the voice coil 30.

Figure 21A:
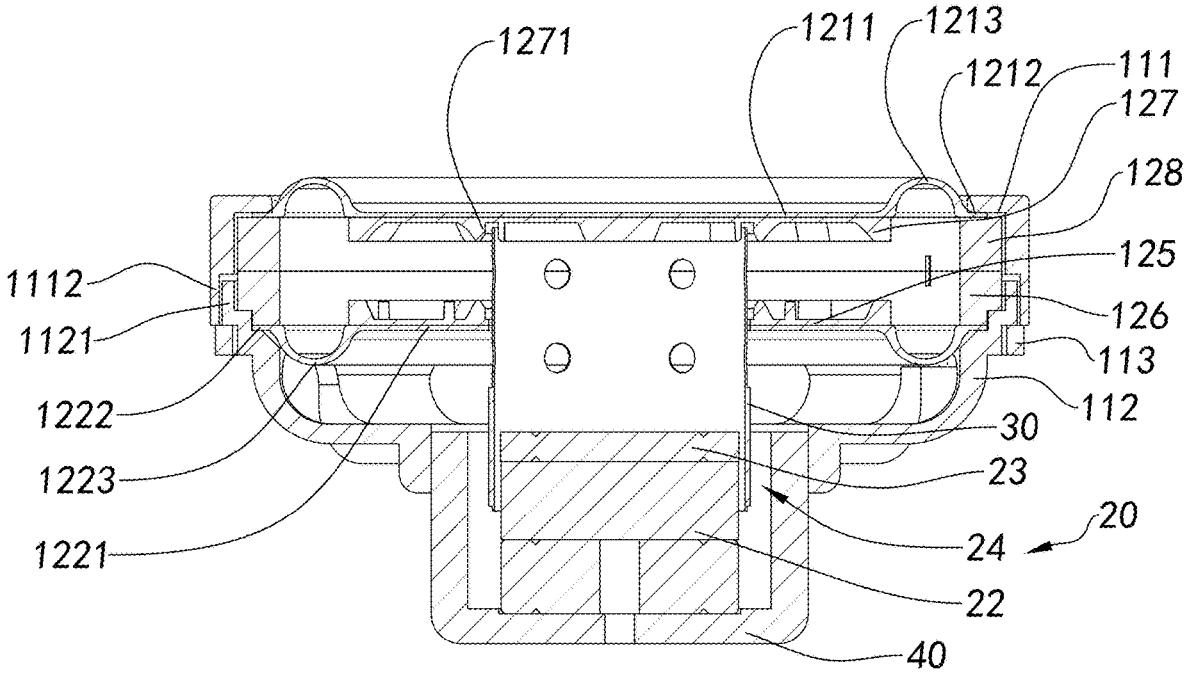
FIG. 21A is a sectional view of the dual suspension edge loudspeaker according to the above second alternative mode of the above second preferred embodiment of the present invention.
Figure 21B:
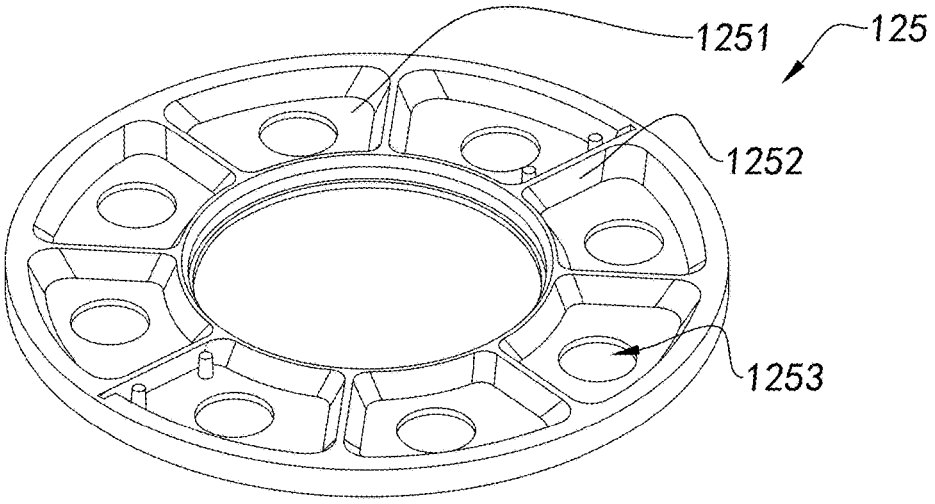
FIG. 21B is a perspective view of an inner holding frame of the dual suspension edge loudspeaker according to the above second alternative mode of the above second preferred embodiment of the present invention.

Besides, as shown in FIGS. 21A and 21B, each of the symmetrically inner holding frame 125 and the suspension edge member inner holding frame 127 has a plurality of grooves 1251 radially and intervally formed while a rib 1252 is formed between every two of the grooves 1251, such that wherein the inner holding frame 125 or the suspension edge member inner holding frame 127 having a larger size is utilized, the actions of the first suspension edge member 121 and the second suspension edge member 122 would not be affected.

It is worth mentioning that the first suspension body 1213 of the first suspension edge member 121 can be made to form a protruding (convex), sunken (concave) or plane structure or to further form a folding, arch or wavy shaped structure between the first inner connection portion 1211 and the first outer connection portion 1212. In addition, the first suspension body 1213 may also comprise a plurality of resilient ribs spacedly, radially and uniformly arranged along the annular direction, so as to limit the displacement direction of the first suspension body 1212 in the axial direction thereof. Similarly, the second suspension body 1213 of the second suspension edge member 122 can be made to form a protruding, sunken or plane structure or to further form a folding, arch or wavy structure between the second inner connection portion 1211 and the second outer connection portion 1212. In addition, the second suspension body 1213 may also comprise a plurality of resilient ribs spacedly, radially, and uniformly arrange along the annular direction, so as to limit the displacement direction of the second suspension body 1213 in the axial direction thereof.

Furthermore, in other embodiments, the first suspension edge member 121 and the second suspension edge member 122 of the dual suspension edge member device can also be the same structure. That is, two first suspension edge members 121 are used to form the dual suspension edge member device or two second suspension edge member 122 are used to construct the dual suspension edge member device, wherein the entire producing process can be easier and simpler and the manufacturing cost can be lower too. Specifically speaking, the first suspension edge member 121 is symmetrical to the second suspension edge member 122 where the sizes of the two suspension edge members are the same.

Figure 22:
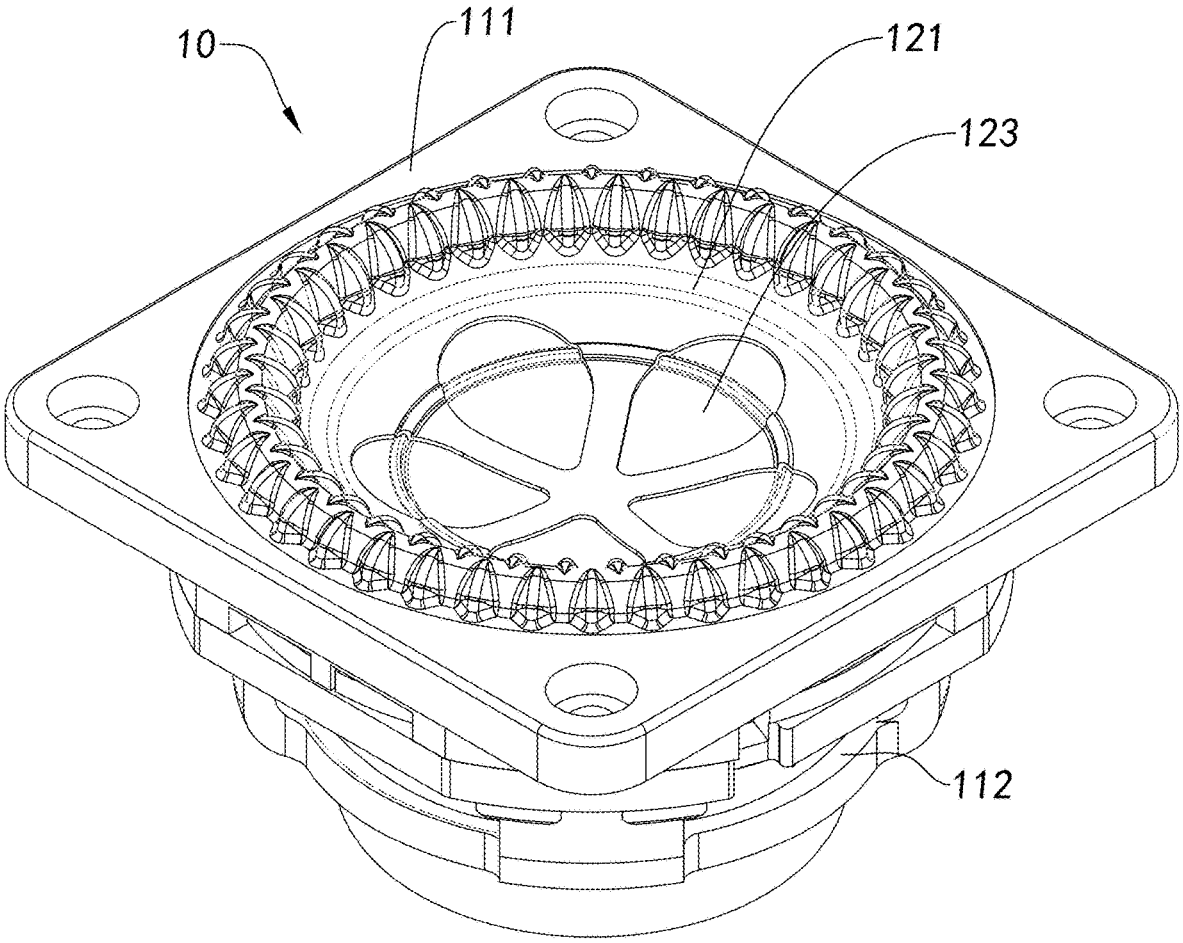
FIG. 22 is a perspective view of a dual suspension edge loudspeaker according to a third alternative mode of the above second preferred embodiment of the present invention.
Figure 23:
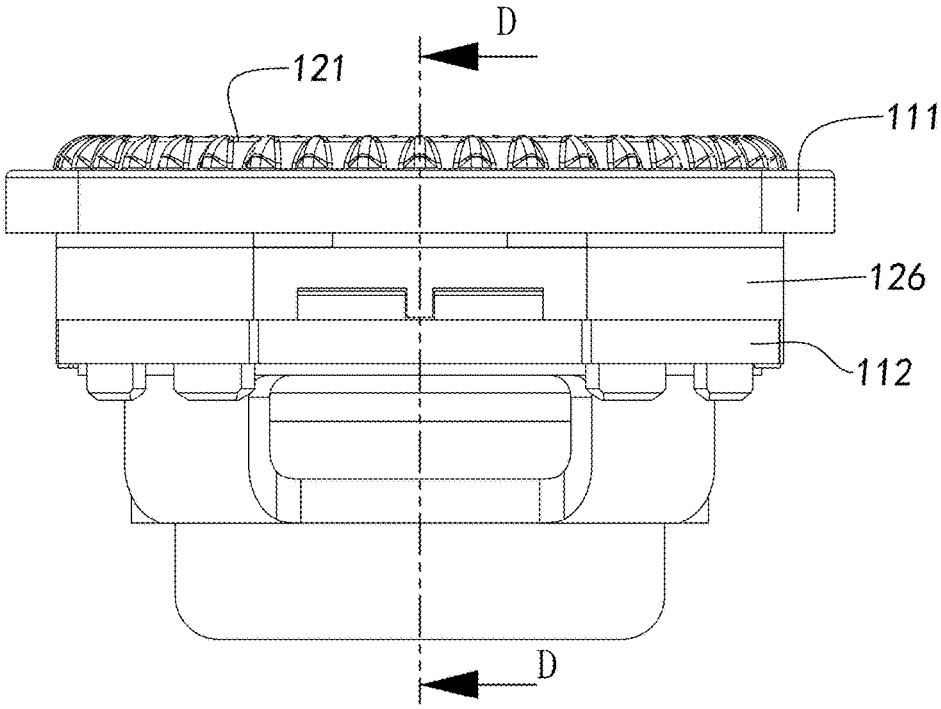
FIG. 23 is a front view of the dual suspension edge loudspeaker according to the above third alternative mode of the above second preferred embodiment of the present invention.
Figure 24:
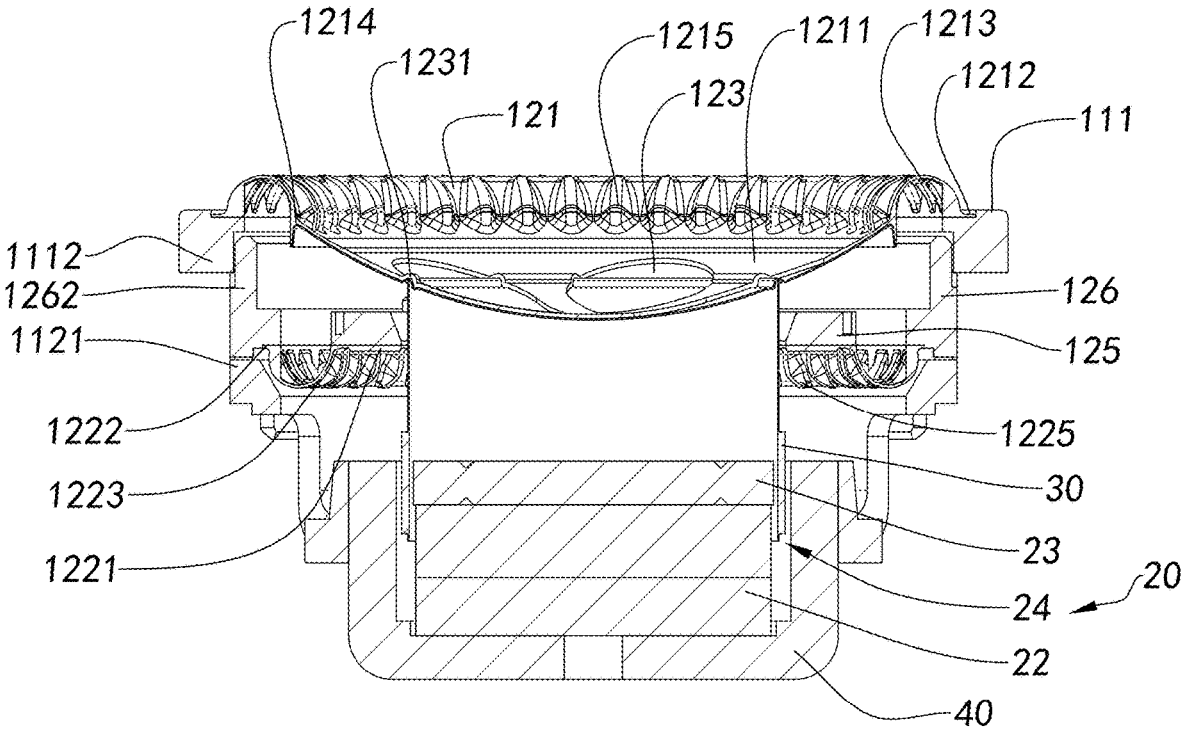
FIG. 24 is a sectional view of the dual suspension edge loudspeaker according to the above third alternative mode of the above second preferred embodiment of the present invention.

Referring to FIGS. 22-24, a third alternative mode of the above second preferred embodiment of the present invention is illustrated, wherein a different structure of the vibration assembly 12 is embodied and disclosed.

The vibration assembly 12 comprises an annular first suspension edge member 121, an annular second suspension edge member 122, a vibration element 123, an annular outer supporting frame 111, a ring-shaped inner holding frame 125, and a ring-shaped outer holding frame 126.

The vibration element 123 is attached to the first suspension edge member 121, while the first suspension edge member 121 is configured with the outer supporting frame 111. The first suspension edge member 121 integrally comprises a disc-shaped first inner connection portion 1211, an annular first outer connection portion 1212 and an annular first suspension body 1213 positioned between the first inner connection portion 1211 and the first outer connection portion 1212. The vibration element 123 is in disc shape adapted to be completely and fittingly attached to the disc-shaped first inner connection portion 1211 of the first suspension edge member 121. In other words, the first inner connection portion 1211 covers the entire surface of the vibration element 123.

In addition, a reinforcement joint portion 1214 is further formed between the first inner connection portion 1211 and the first suspension body 1213, wherein an end portion of the vibration element 123 connected with the first inner connection portion 1211 is made to have the same shape of the reinforcement joint portion 1214 for connection. In other words, the reinforcement joint portion 1214 forms a groove shaped structure while the end portion of the vibration element 123 also matches with the reinforcement joint portion 1214 to form a groove shaped structure too, such that the two groove shaped structures of the reinforcement joint portion 1214 and the vibration element 123 are correspondingly matched to ensure a firmer connection between the first suspension edge member 121 and the vibration element 123. In addition, the first inner connection portion 1211 can provide a plurality of through holes adapted for reducing the weight of the first suspension edge member 121.

Also, the vibration element 123 comprises a voice coil coupling portion 1231 which forms a coupling groove for mounting and restricting the voice coil in position. Specifically, since the vibration element 123 is attached with the first inner connection portion 1211 of the first suspension edge member 121, the first inner connection portion 1211 also forms a coupling groove having the same shape to match the coupling portion 1231 of the vibration element 123. Besides, an end of the voice coil 30 is connected with the voice coil coupling portion 1231 of the vibration element 123 of the vibration assembly 12 of the radiation device 10 while the other end of the voice coil 30 is coupled with the magnetic system 20. Accordingly, the voice coil 30 moves reciprocatingly under the influence of the electromagnetic driving force of the magnetic system 20, so as to drive and causes the radiation device 10 to move back and forth along the axial direction thereof to agitate the air in and around the dual suspension edge loudspeaker to produce sound.

In addition, the second suspension edge member 122 is connected between the inner holding frame 125 and the outer holding frame 126. The body frame 112 affixes the outer holding frame 126 on the outer supporting frame 111. In other words, the outer holding frame 126 is positioned between the outer supporting frame 111 and the body frame 112. It is understandable that the second suspension edge member 122 is affixed on the outer supporting frame 111 and the body frame 112 through the outer holding frame 126.

According to this third alternative mode of the second preferred embodiment of the present invention, the first suspension edge member 121 and the second suspension edge member 122 form the modularized radiation device 10 through coupling the outer supporting frame 111, the outer holding frame 126 and the body frame 112. The outer supporting frame 111 comprises one or more supporting frame coupling portions 1112. The body frame 112 comprises a body frame coupling portion 1121. The outer holding frame 126 comprises a support supporting frame coupling portion 1262. When there is only one supporting frame coupling portion 1112, it forms a closed circular supporting wall. When there are two or more supporting frame coupling portions 1112, they form an opened circular supporting wall. The present embodiment is embodied to have the closed circular supporting wall as an example for illustration purpose with no intention to limit the scope of the present invention.

The supporting frame coupling portion 1112 is coupled with the support supporting frame coupling portion 1262, and the support supporting frame coupling portion 1262 is coupled with the body frame coupling portion 1121, so as to form the radiation device 10. The supporting frame coupling portion 1112, the support supporting frame coupling portion 1262 and the body frame coupling portion 1121 can be coupled, joined or connected by various means, such as through matched buckling components, screw components, hot welding, ultrasonic bonding, and etc. In addition, the supporting frame coupling portion 1112 and the support supporting frame coupling portion 1262 as well as the support supporting frame coupling portion 1262 and the body frame coupling portion 1121 each forms an engagement groove correspondingly for ease of assembling and aligning, wherein it would be realized that when one of the engagement grooves is in a protruding step-shape, the corresponding engagement groove to be coupled is in a sunken step-shape relatively adapted for engaging with each other. Besides, a plurality of perforations is formed in both the support supporting frame coupling portion 1262 and the body frame coupling portion 1121 adapted for the supporting frame coupling portion 1112 to penetrate the support supporting frame coupling portion 1262 and the body frame coupling portion 1121 for aligning and affixing purposes.

The first suspension edge member 121 further comprises a plurality of first resilient ribs 1215, wherein the first resilient ribs 1215 are spacedly and intervally provided along an annular direction on the arch shaped first suspension body 1213. In particular, the first resilient ribs 1215 are integrally protruded from the first suspension body 1213, wherein each of the first resilient ribs 1215 has a base portion protruded from the edge of the first suspension body 1213 and extended upwardly to the peak of the first suspension body 1213 to form a tip portion of the first resilient rib 1215, wherein the width of each of the first resilient ribs 1215 gradually reduces from the base portion to the tip portion thereof to form an arrow shape. A predetermined number of the plurality of first resilient ribs 1215 are radially arranged between the outer edge and the peak of the first suspension body 1213 as outer first resilient ribs 1215 evenly spaced apart and a predetermined number of the plurality of first resilient ribs 1215 are radially arrange between the inner edge and the peak of the first suspension body 1213 as inner first resilient ribs 1215 evenly spaced apart. Preferably, the tip portion of each of the first resilient ribs 1215 is preferred to be positioned between two tip portions of two adjacent first resilient ribs 1215, so as to not only reinforce the structure of the first suspension edge member 121, but also limit the displacement direction of the first suspension edge member 121 in its axial direction thereof. Accordingly, when the first suspension edge member 121 is about to have an axial deviation displacement toward a predetermined direction, the first resilient rib(s) 1215 provided in the opposite direction would provide a limiting and restricting effect to prevent the first suspension edge member 121 from further displacement. It is worth mentioning that the shape of the protruding first resilient rib 1215 would be designed in various alternative shapes for desired purposes, for example the cross section of the first resilient rib 1215 can be in the shape of bow, arch, triangle, quadrangle, polygon, semicircle, semi oval, inverted U, inverted V, and etc.

The second suspension edge member 122 further comprises a plurality of second resilient ribs 1225, wherein the second resilient ribs 1225 are spacedly and intervally provided along an annular direction on the arch shaped second suspension body 1223. In particular, just like the first resilient ribs 1215 that the second resilient ribs 1225 are integrally protruded from the second suspension body 1223, wherein each of the second resilient ribs 1225 has a base portion protruded from the edge of the second suspension body 1223 and extended upwardly to the peak of the second suspension body 1223 to form a tip portion of the second resilient rib 1225, wherein the width of each of the second resilient ribs 1225 gradually reduces from the base portion to the tip portion thereof to form an arrow shape. A predetermined number of the plurality of second resilient ribs 1225 are radially arranged between the outer edge and the peak of the second suspension body 1223 as outer second resilient ribs 1225 evenly spaced apart and a predetermined number of the plurality of second resilient ribs 1225 are radially arrange between the inner edge and the peak of the second suspension body 1223 as inner second resilient ribs 1225 evenly spaced apart. Preferably, the tip portion of each of the second resilient ribs 1225 is preferred to be positioned between two tip portions of two adjacent second resilient ribs 1225, so as to not only reinforce the structure of the second suspension edge member 122, but also limit the displacement direction of the second suspension edge member 122 in its axial direction thereof. Accordingly, when the second suspension edge member 122 is about to have an axial deviation displacement toward a predetermined direction, the second resilient rib(s) 1225 provided in the opposite direction would provide a limiting and restricting effect to prevent the second suspension edge member 122 from further displacement. It is worth mentioning that, similar to the second resilient ribs 1215, the shape of the protruding second resilient rib 1225 would be designed in various alternative shapes for desired purposes, for example the cross section of the second resilient rib 1225 can be in the shape of bow, arch, triangle, quadrangle, polygon, semicircle, semi oval, inverted U, inverted V, and etc.

Referring to FIGS. 25A-30 of the present invention, a loudspeaker box 1000C according to a third preferred embodiment of the present invention is illustrated. The loudspeaker box 1000C comprises a main vibration speaker 100C, at least a radiation device 10 and a mounting shell 90.

In particular, the mounting shell 90 has a vibration chamber 91 therein. The radiation device 10 comprises at least a first passive vibrator 13 and at least a second passive vibrator 14. The main vibration speaker 100C and the first passive vibrator 13 of the radiation device 10 are arranged on one side of the mounting shell 90 and the second passive vibrator 14 of the radiation device 10 is arranged on another opposing side of the mounting shell 90, such that the main vibration speaker 100C, the first passive vibrator 13 and the second passive vibrator 14 of the radiation device 10 share the vibration chamber 91.

The main vibration speaker 100C is capable of responding to audio signal input and vibrating to produce sound. The first passive vibrator 13 and the second passive vibrator 14 of the radiation device 10 are both able to vibrate in responsive to the vibration of the main vibration speaker 100C to produce auxiliary sound effects, so as to enhance the bass sound effect of the loudspeaker box 1000C. When the first passive vibrator 13 and the second passive vibrator 14 are responding to the vibration of the main vibration speaker 100C to vibrate, the vibration directions of the first passive vibrator 13 and the second passive vibrator 14 are in opposite directions to each other, so as to prevent the loudspeaker box 1000C from adverse situations, such as shaking, shifting, and etc., while the loudspeaker box 1000C vibrates to produce sound, ensuring a purer sound effect of the loudspeaker box 1000C.

Figure 27:
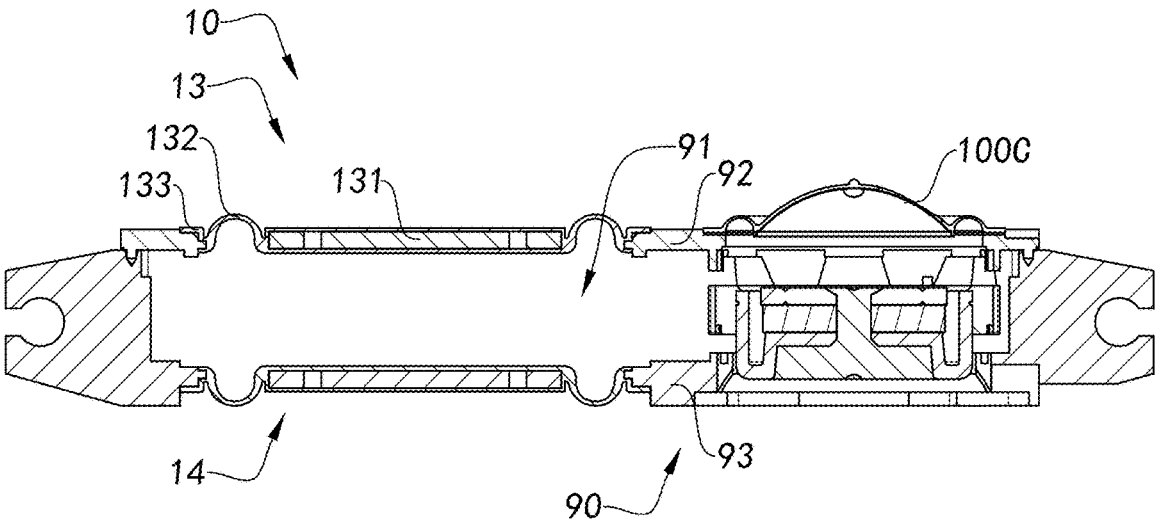
FIG. 27 is a sectional view illustrating the internal structure of the loudspeaker box according to the above third preferred embodiment of the present invention being sectioned along the middle position.
Figure 28A:
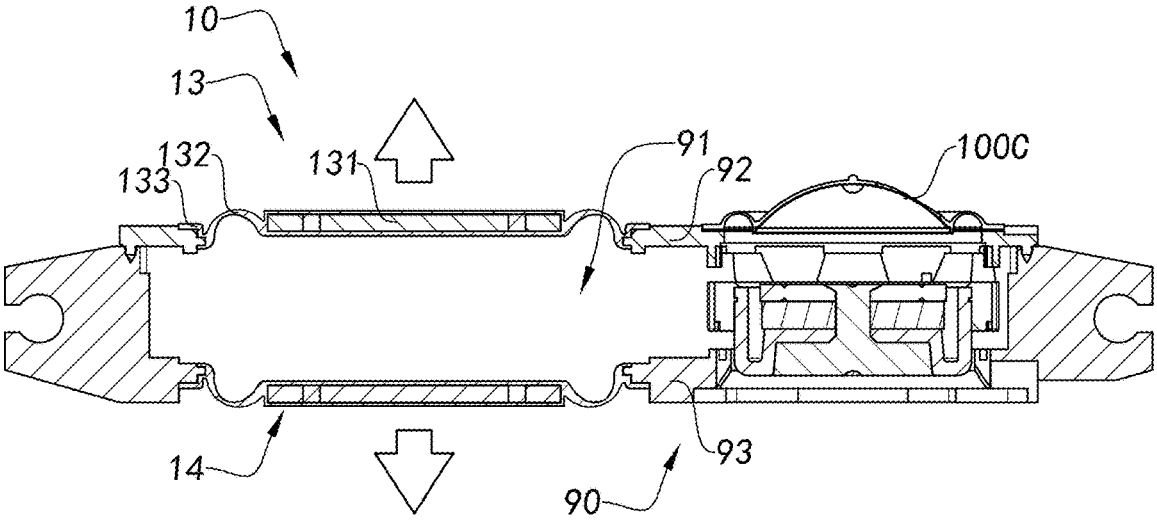
FIG. 28A is a sectional view illustrating the loudspeaker box in a sounding state according to the above third preferred embodiment of the present invention.
Figure 28B:
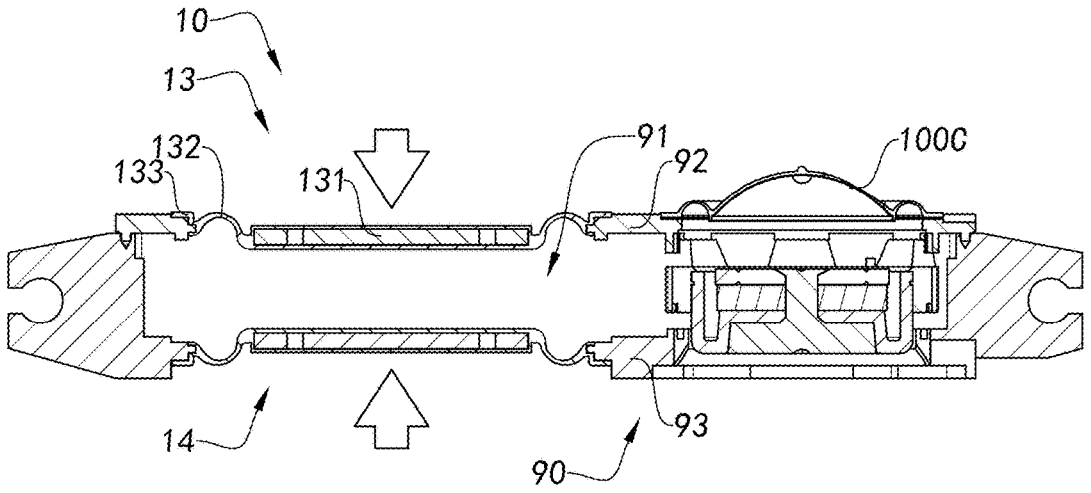
FIG. 28B is a sectional view illustrating the loudspeaker box in another sounding state according to the above third preferred embodiment of the present invention.

For example, referring to FIG. 27, the first and second passive vibrator 13, 14 are preferred to be arranged symmetrically in back to back configuration, such that when the first passive vibrator 13 and the second passive vibrator 14 vibrate respectively in response to the vibration of the main vibration speaker 100C, the vibration directions of the first passive vibrator 13 and the second passive vibrator 14 are opposite. Specifically, when the first passive vibrator 13 responds to the vibration of the main vibration speaker 100C to vibrate upward, the second passive vibrator 14 responds to the vibration of the main vibration speaker 100C to vibrate downward. On the contrary, when the first passive vibrator 13 responds to the vibration of the main vibration speaker 100C to vibrate downward, the second passive vibrator 14 responds to the vibration of the main vibration speaker 100C to vibrate upward. In other words, both the first and second passive vibrator 13, 14 would vibrate outwardly (as shown in FIG. 28A) or inwardly (as shown in FIG. 28B) in a symmetrical and synchronous manner.

Figure 25A:
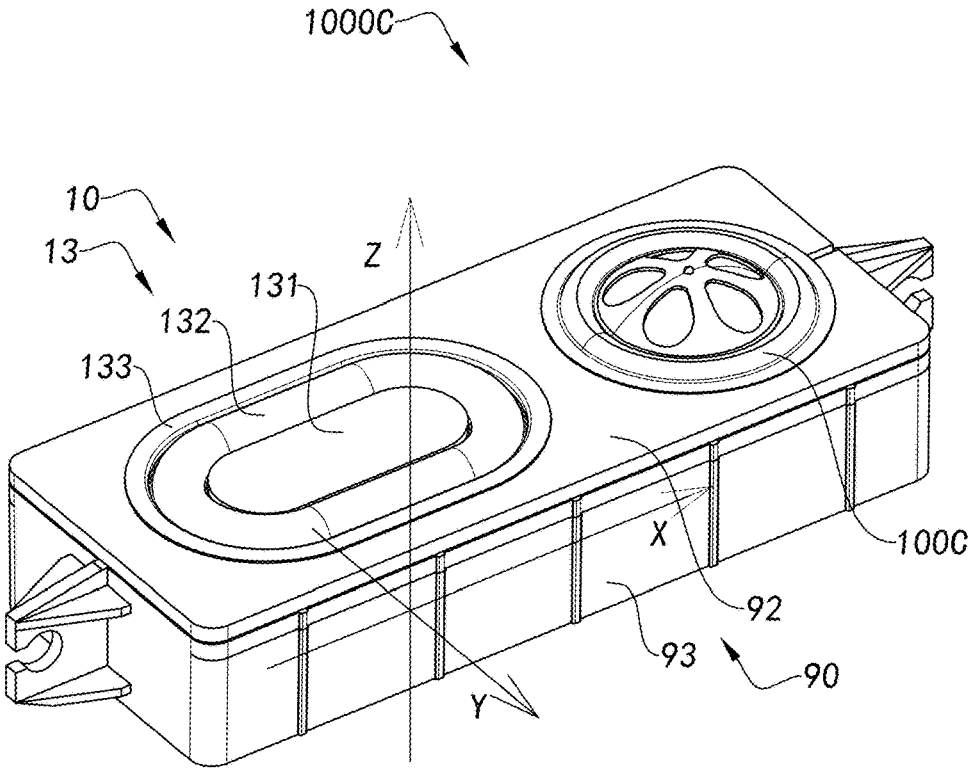
FIG. 25A is a perspective view illustrating from an angle of view of a loudspeaker box according to a third preferred embodiment of the present invention.

More specifically, when the first passive vibrator 13 vibrates in response to the vibration of the main vibration speaker 100C and moves upward along the Z-axis direction as illustrated in FIG. 25A, the first passive vibrator 13 has a tendency to bring the loudspeaker box 1000C to displace upward. At the same time, the second passive vibrator 14 vibrates in response to the vibration of the main vibration speaker 100C and moves downward along the Z-axis direction, as illustrated in FIG. 25A, that the second passive vibrator 14 also has a tendency to bring the loudspeaker box 1000C to displace downward, as illustrated in FIG. 28A. Therefore, the tendency of the upwardly moving displacement of the first passive vibrator 13 and the tendency of the downwardly moving displacement of the second passive vibrator 14 will be counter-balanced and cancelled out. As a result, while the first passive vibrator 13 is moving upwards during vibration, the second passive vibrator 14 is moving downwards during vibration simultaneously, so that the loudspeaker box 1000C would remain still without shaking or shifting and thus the sound quality of the loudspeaker box 1000C can be guaranteed.

Correspondingly, when the first passive vibrator 13 vibrates in response to the vibration of the main vibration speaker 100C and moves downward along the Z-axis direction as illustrated in FIG. 25A, the first passive vibrator 13 has a tendency to bring the loudspeaker box 1000C to displace downward. At the same time, the second passive vibrator 14 vibrates in response to the vibration of the main vibration speaker 100C and moves upward along the Z-axis direction, as illustrated in FIG. 25A, that the second passive vibrator 14 has a tendency to bring the loudspeaker box 1000C to displace upward, as illustrated in FIG. 28B. Therefore, the downwardly moving displacement of the first passive vibrator 13 and the upwardly moving displacement of the second passive vibrator 14 are counter-balanced and cancelled out. As a result, while the first passive vibrator 13 is moving downwards during vibration, the second passive vibrator 14 is moving upwards during vibration simultaneously, so that the loudspeaker box 1000C would remain still without shaking or shifting and thus the sound quality of the loudspeaker box 1000C can be guaranteed.

In other words, when the first passive vibrator 13 vibrates in response to the vibration of the main vibration speaker 100C and moves upward along the Z-axis direction as illustrated in FIG. 25A, the first passive vibrator 13 provides a pulling force to draw the loudspeaker box 1000C to tend to displace upwardly along the Z-axis direction. At the meantime, the second passive vibrator vibrates in response to the vibration of the main vibration speaker 100C and moves downward along the Z-axis direction, as illustrated in FIG. 25A, that the second passive vibrator 14 provides a pulling force in the opposite direction to draw the loudspeaker box 1000C to tend to displace downwardly along the Z-axis direction. As a result, the pulling forces of in two opposing directions are counter-balanced and cancelled out with each other to keep the loudspeaker box 1000C staying still. On the contrary, when the first passive vibrator 13 vibrates in response to the vibration of the main vibration speaker 100C and moves downward along the Z-axis direction as illustrated in FIG. 25A, the first passive vibrator 13 provides a pulling force to draw the loudspeaker box 1000C to tend to displace downwardly along the Z-axis direction. At the meantime, the second passive vibrator vibrates in response to the vibration of the main vibration speaker 100C and moves upward along the Z-axis direction, as illustrated in FIG. 25A, that the second passive vibrator 14 provides a pulling force in the opposite direction to draw the loudspeaker box 1000C to tend to displace upwardly along the Z-axis direction. As a result, the pulling forces of in two opposing directions are counter-balanced and cancelled out with each other to keep the loudspeaker box 1000C staying still.

According to the present embodiment as shown in FIGS. 25A-30, the radiation device 10 comprises one first passive vibrator 13 and one second passive vibrator 14. The first passive vibrator 13 and the main vibration speaker 100C are adjacently arranged on one side of the mounting shell 90 while the second passive vibrator 14 is arranged on another opposing side of the mounting shell 90, wherein the main vibration speaker 100C, the first passive vibrator 13 and the second passive vibrator 14 share the same vibration chamber 91 defined in the mounting shell 90 and that the first passive vibrator 13 and the second passive vibrator 14 are symmetrically arranged in a back-to-back configuration to ensure the vibration directions of the first passive vibrator 13 and the second passive vibrator 14 being in opposite directions.

Preferably, the types and sizes of the first passive vibrator 13 and the second passive vibrator 14 are the same, so that when the first passive vibrator 13 and the second passive vibrator 14 are mounted on two side of the mounting shells 90, the first and second passive vibrators 13, 14 are symmetrical with each other. In other words, the first passive vibrator 13 and the second passive vibrator 14 can be symmetrically arranged on two opposing sides of the mounting shell 90.

When both the first passive vibrator 13 and the second passive vibrator 14 vibrate together in response to the vibration of the main vibration speaker 100C, the first passive vibrator 13 and the second passive vibrator 14 are able to respectively produce vibrations with the same amplitude in opposite directions. Hence, the tendency of shifting and displacement of the loudspeaker box 1000C in one direction brought by the vibration of the first passive vibrator 13 in that direction can be counter-balanced and cancelled out by the tendency of shifting and displacement of the loudspeaker box 1000C to the other opposite direction brought by the vibration of the second passive vibrator 14 to that opposite direction, so that the unpleasant situation, such as shaking, shifting and etc., of the loudspeaker box 1000C during producing sound can be avoided so as to ensure the sound quality of the loudspeaker box 1000C.

According to this third embodiment of the loudspeaker box 1000C of the present invention, the vibration direction of the main vibration speaker 100C and the vibration direction of the first passive vibrator 13 are consistent. In other words, the vibration direction of the main vibration speaker 100C and the vibration direction of the second passive vibrator 14 are opposite.

In some other embodiments of the loudspeaker box 1000C of the present invention, the quantity of the first passive vibrator 13 of the radiation device 10 can be more than the quantity of the second passive vibrator 14. Then, the size of the first passive vibrator 13 can be smaller than the size of the second passive vibrator 14, such that the tendency and magnitude of shifting of the loudspeaker box 1000C to a direction along the Z axis as illustrated in FIG. 25A caused by the vibration and shifting of the plurality of first passive vibrators 13 in that direction in response to the vibration of the main vibration speaker 100C is arranged to be consistent to the tendency and magnitude of shifting of the loudspeaker box 1000C to the opposite direction along the Z axis as illustrated in FIG. 25A caused by the vibration and shifting of the second passive vibrators 14 in that opposite direction in response to the vibration of the main vibration speaker 100C, so as to avoid the loudspeaker box 1000C from shaking or shifting while producing sound. It is understandable that, alternatively, in other embodiments of the loudspeaker box 1000C of the present invention, the quantity of the first passive vibrator 13 of the radiation device 10 can also be less than the quantity of the second passive vibrator 14.

Figure 31:
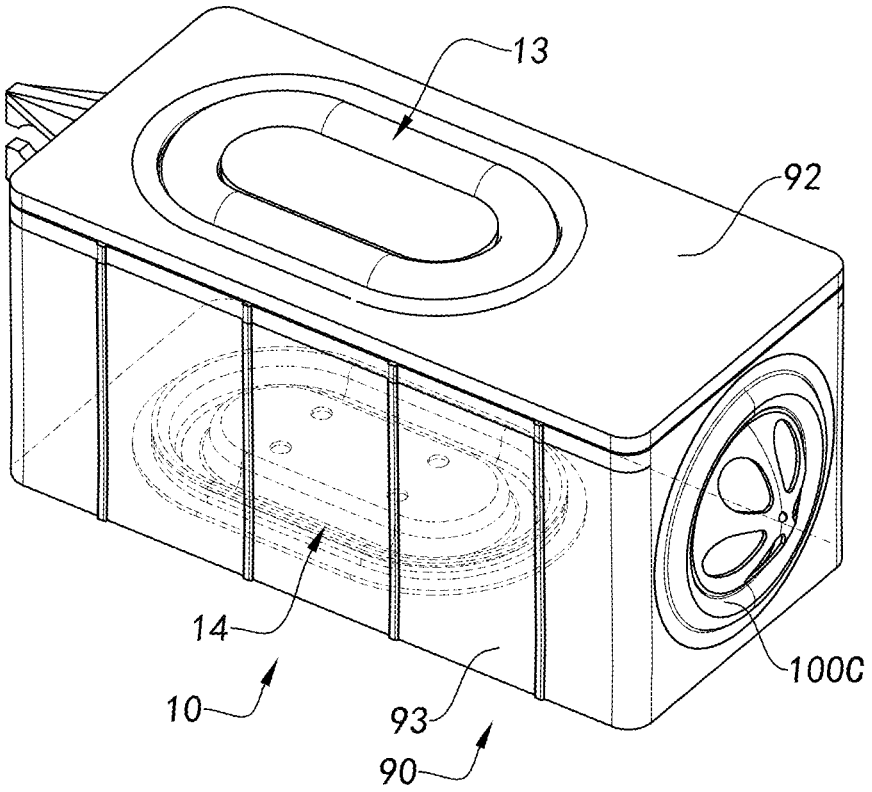
FIG. 31 is a perspective view of a loudspeaker box according to a second alternative mode of the above third preferred embodiment of the present invention.

According to an alternative mode of the loudspeaker box 1000C as illustrated in FIG. 31, the vibration direction of the main vibration speaker 100C is arranged perpendicular to the vibration direction of the first passive vibrator 13 and the vibration direction of the second passive vibrator 14.

Specifically, the main vibration speaker 100C can be arranged on an end of the mounting shell 90, while the first passive vibrator 13 and the second passive vibrator 14 are respectively arranged on the two opposing sides 92 of the mounting shell 90 in a back-to-back configuration, such that the vibration direction of the main vibration speaker 100C is perpendicular to the vibration direction of the first passive vibrator 13 and the vibration direction of the second passive vibrator 14. Preferably, the first passive vibrator 13 and the second passive vibrator 14 mounted on the two opposing sides of the mounting shell 90 in back to back configuration are symmetrical with each other, such that the vibrating first passive vibrator 13 and the vibrating second passive vibrator 14 can completely counter-balance and cancel out the vibration generated by the loudspeaker box 1000C.

Alternatively, the main vibration speaker 100C can be arranged on one side of the mounting shell 90, while the first passive vibrator 31 and the second passive vibrator 32 are respectively arranged on two ends of the mounting shell 90, such that the vibration direction of the main vibration speaker 100C is perpendicular to the vibration direction of the first passive vibrator 13 and the vibration direction of the second passive vibrator 14. Preferably, the first passive vibrator 13 and the second passive vibrator 14 which are respectively arranged on the two ends of the mounting shell 90 in back to back manner are symmetrical with each other, such that the vibrating first passive vibrator 13 and the vibrating second passive vibrator 14 can completely counter-balance and cancel out the vibration generated by the loudspeaker box 1000C.

Preferably, the main vibration speaker 100C of the loudspeaker box 1000C can be embodied as a tweeter or a middle tweeter. Therefore, when the main vibration speaker 100C responds to the audio signal input, it can produce high frequency or medium high frequency sound effects, such that when the first passive vibrator 13 and the second passive vibrator 14 vibrate in response to the vibration of the main vibration speaker 100C, they can produce low frequency sound effects, so that the loudspeaker box 1000C of the present invention is capable of producing sound effect in full range of low, medium, and high frequencies.

It is worth mentioning that, due to the producing of auxiliary sound effect by the vibrations of the first passive vibrator 13 and the second passive vibrator 14 in opposite directions simultaneously in response to the vibration of the main vibration speaker 100C, the loudspeaker box 1000C is able to perform bass in even lower frequency so as to strengthen the low frequency sound effect of the loudspeaker box 1000C. Moreover, due to the opposite vibrating directions of the first passive vibrator 13 and the second passive vibrator 14, the loudspeaker box 1000C is prevented from shifting and even shaking while producing low frequency sound, so as to improve the sound quality of the loudspeaker box 1000C.

Figure 28C:
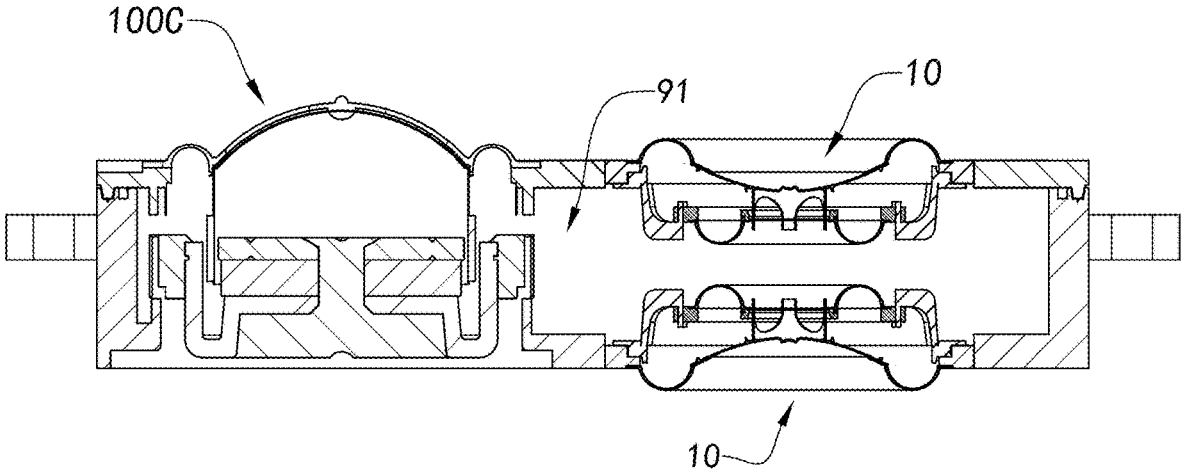
FIG. 28C is a sectional view of a loudspeaker box according to a first alternative mode of the above third preferred embodiment of the present invention.

It is appreciated that, the two passive vibrators may be embodied as the two radiation devices 10 as shown in FIG. 28C that each of the radiation devices 10 has two suspension edge members according to the above embodiments. Accordingly, the radiation device 10 having two dual suspension edge members is capable of completely counterbalancing and cancelling out the vibration produced by the loudspeaker box 1000C and enhancing the sound effect quality.

Further, the mounting shell 90 comprises a first shell 92 and a second shell 93, wherein the first shell 92 and the second shell 93 are adapted to be coupled together to define the vibration chamber 91 therebetween. The main vibration speaker 100C and the first passive vibrator 13 of the radiation device 10 are arranged on the first shell 92. The second passive vibrator 14 of the radiation device 10 is arranged on the second shell 93. Therefore, when the first shell 92 and the second shell 93 are coupled together to form the mounting shell 90, the main vibration speaker 100C and the first passive vibrator 13 and the second passive vibrator 14 of the radiation device 10 share the vibration chamber 91 of the mounting shell 90. In addition, the first passive vibrator 13 and the second passive vibrator 14 are correspondingly and symmetrically arranged on the first shell 92 and the second shell 93 respectively, ensuring the first passive vibrator 13 and the second passive vibrator 14 in a back-to-back configuration.

Figure 26:
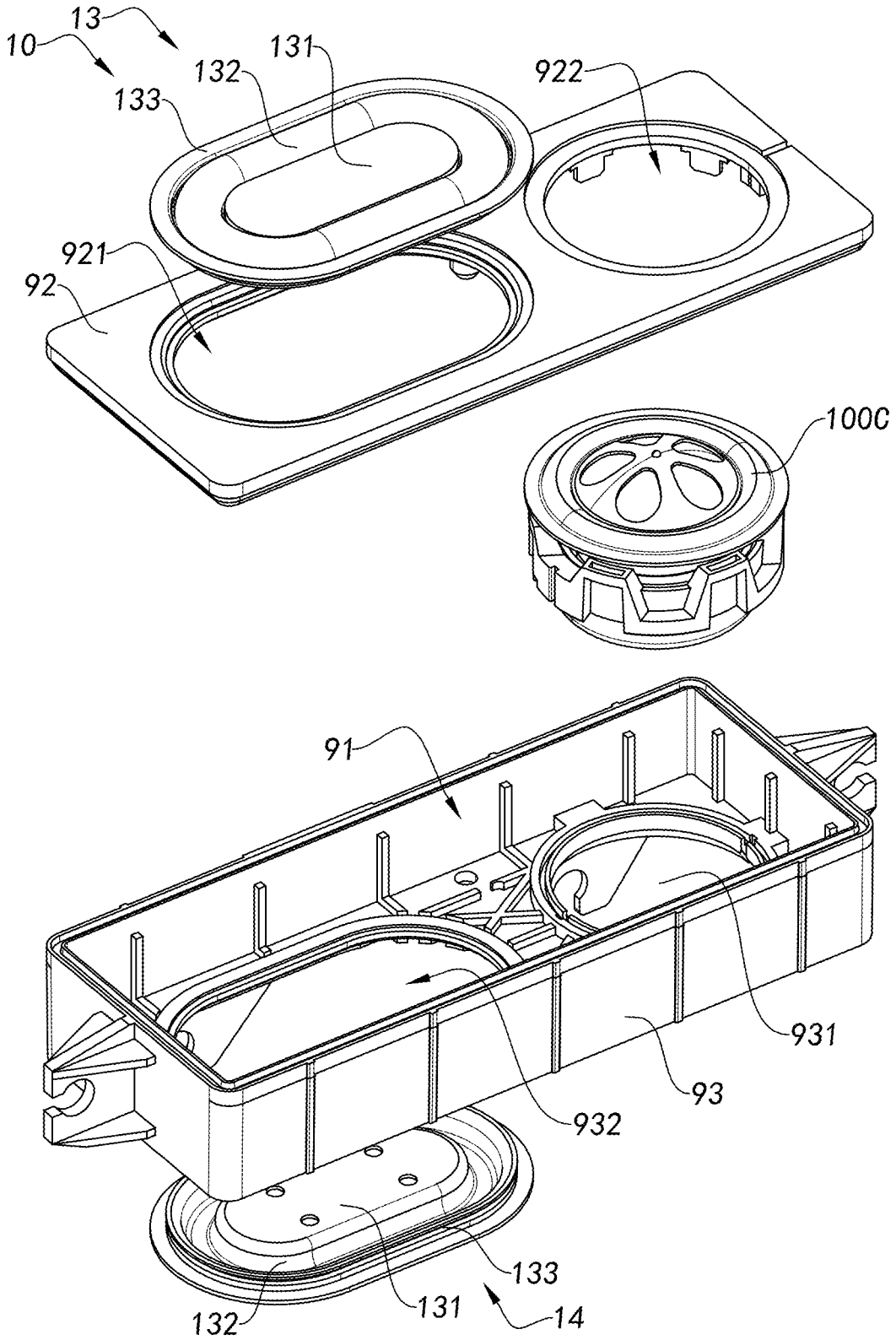
FIG. 26 is an exploded view of the loudspeaker box according to the above third preferred embodiment of the present invention.

Preferably, the free end of the main vibration speaker 100C arranged on the first shell 92 can be extended and affixed on the second shell 93, so as to avoid unpleasant situation like shaking when the main vibration speaker 100C responds to the audio signal input to vibrate and produce sound, so that the loudspeaker box 1000C is prevented from generating noise. For example, according to the embodiment of the loudspeaker box 1000C of the present invention, as shown in FIG. 26, the second shell 93 has an anchoring through hole 931 provided therein. When the first shell 92 and the second shell 93 are coupled to form the mounting shell 90, the free end of the main vibration speaker 100C mounted on the first shell 92 is affixed and anchored in the anchoring through hole 931 of the second shell 93, so as to avoid the main vibration speaker 100C and the second shell 93 from moving relatively when the main vibration speaker 100C responds to the audio signal input to vibrate to produce sound. Accordingly, the loudspeaker box 1000C is prevented from generating noise due to any impact between the main vibration speaker 100C and the second shell 93.

It is worth mentioning that the structures of the first passive vibrator 13 and the second passive vibrator 14 of the radiation device 10 are identical. Therefore, the first passive vibrator 13 is described in the following as an example to illustrate the structures of the first passive vibrator 13 and the second passive vibrator 14 as well as the relationship between the first passive vibrator 13 and the mounting shell 90 and the relationship between the second passive vibrator 14 and the mounting shell 90.

Figure 29:
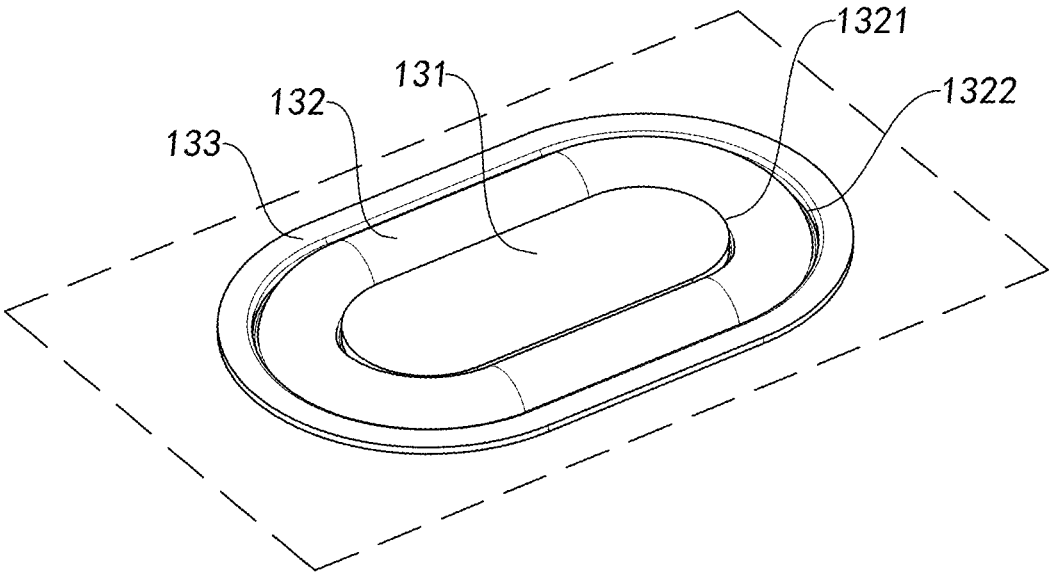
FIG. 29 is a perspective view illustrating a passive vibrator of the loudspeaker box according to the above third preferred embodiment of the present invention.
Figure 30:
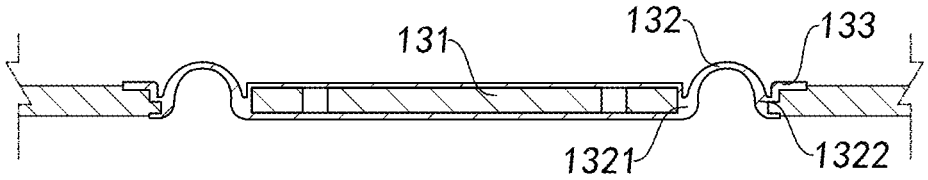
FIG. 30 is a partial sectional view illustrating an internal structure of the passive vibrator according to the above third preferred embodiment of the present invention, being sectioned along a middle position.

Specifically, referring to FIGS. 29 and 30, the first passive vibrator 13 further comprises a vibration element 131, an annular suspension edge member 132 and an annular framework 133, wherein the vibration element 131 is in positioned the middle and the framework 133 is mounted on the first shell 92, or that the framework 133 forms at least a portion of the first shell 92 or the second shell 93 of the mounting shell 90. The suspension edge member 132 is extended between the vibration element 131 and the framework 133, adapted for restricting and limiting the vibration direction of the vibration element 131. In particular, the suspension edge member 132 is utilized to limit the vibration element 131 to reciprocatingly move up and down along the Z-axis direction as illustrated in FIG. 25A, so as to avoid the vibration element 131 from offsetting or shifting during the up and down motion.

More specifically, the suspension edge member 132 has an inner fringe 1321 and an outer fringe 1322. The inner fringe 1321 of the suspension edge member 132 is adapted to be integrally extended from an outer edge of the vibration element 131, or that the inner fringe 1321 of the suspension edge member 132 is attached to the outer edge of the vibration element 131 through glue or other adhesive. The outer fringe 1322 of the suspension edge member 132 is adapted to be integrally extended from an inner edge of the framework 133, or that the outer fringe 1322 of the suspension edge member 132 is attached to the inner edge of the framework 133 through glue or other adhesive. As a result, the suspension edge member 132 is extended between the vibration element 131 and the framework 133. It is worth mentioning that the suspension edge member 132 may also extend to cover the outer surface(s) of the vibration element 131.

The suspension edge member 132 has an elastic ability. For instance, the suspension edge member 132 can be made of elastic material, for example but not limited to, rubber materials and etc. Therefore, when the vibration element 131 vibrates in response to the vibration of the main vibration speaker 100C, if the vibration element 131 moves upward along the Z-axis direction as illustrated in FIG. 25A, the suspension edge member 132 pulls the vibration element 131 downward along the Z-axis direction as illustrated in FIG. 25A, providing a tendency and shifting force to drive the vibration element 131 to displace and return back to its original condition. Correspondingly, if the vibration element 131 moves downward along the Z-axis direction as illustrated in FIG. 25A, the suspension edge member 132 pulls the vibration element 131 upward along the Z-axis direction as illustrated in FIG. 25A, that also provides a tendency and shifting force to drive the vibration element 131 to displace and return back to its original condition.

Figure 25B:
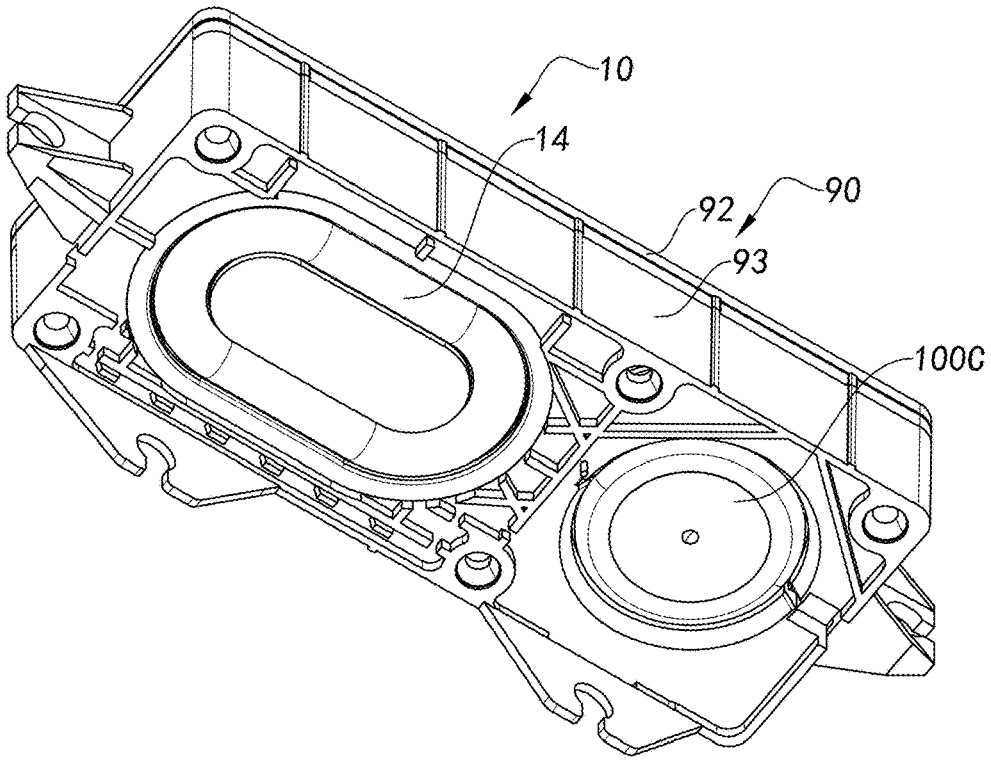
FIG. 25B is a perspective view illustrating from another angle of view of the loudspeaker box according to the above third preferred embodiment of the present invention.

Besides, when the vibration element 131 is vibrating upward or downward along the Z-axis direction as illustrated in FIG. 25, the suspension edge member 132 ensures that the vibration element 131 only moves upward or downward along the Z-axis direction, such that the suspension edge member 132 does prevent the vibration element 131 from offsetting displacement so as to ensure the sound effect and quality of the loudspeaker box 1000C.

It is worth mentioning that, even though the vibration elements 131 of the first passive vibrator 13 and the second passive vibrator 14 as illustrated in the FIGS. 25A to 30 are in form of annular track-like shape, according to the loudspeaker box 1000C of other embodiments of the present invention, the shape of the vibration element 131 can also be embodied as other shapes, for example but not limited to, circular shape, oval shape, square shape, other polygonal shape, and etc.

In other words, in one embodiment of the loudspeaker box 1000C of the present invention, the first passive vibrator arranged in the first shell 92 13 can be independently made and then installed on the first shell 92, and the second passive vibrator 14 arranged on the second shell 93 can be independently manufactured and then installed on the second shell 93. In another embodiment of the loudspeaker box 1000C of the present invention, the first passive vibrator 13 arranged on the first shell 92 can be integrally coupled with the first shell 92, and the second passive vibrator 14 arranged in the second shell 93 can be integrally coupled with the second shell 93 as well.

In particular, as shown in FIG. 26, the first shell 92 has a first mounting through hole 921 provided therein. The framework 133 of the first passive vibrator 13 is adapted to be mounted on the first shell 92 at the first mounting through hole 921, so that the vibration element 131 and the suspension edge member 132 of the first passive vibrator 13 are held and retained in position at the first mounting through hole 921 of the first shell 92. As a result, the first passive vibrator 13 is arranged in the first shell 92. It is understandable that the framework 133 of the first passive vibrator 13 can be mounted on the first shell 92 through glue or other adhesive, such that after the glue or other adhesive are solidified, a bonding layer is formed between the framework 133 of the first passive vibrator 13 and the first shell 92 in order to retain the vibration element 131 and the suspension edge member 132 of the first passive vibrator 13 in the first mounting through hole 921 of the first shell 92.

Correspondingly, the second shell 93 comprises a second mounting through hole 932 arranged thereon. The framework 133 of the second passive vibrator 14 is adapted to be mounted on the second shell 32 at the second mounting through hole 932, so that the vibration element 131 and the suspension edge member 132 of the second passive vibrator 14 are held and retained at the second mounting through hole 932 of the second shell 93. As a result, the second passive vibrator 14 is arranged in the second shell 93. It is understandable that, similarly, the framework 133 of the second passive vibrator 14 can be mounted on the second shell 93 through glue or other adhesive, such that after the glue or other adhesive are solidified, a bonding layer is formed between the framework 133 of the second passive vibrator 14 and the second shell 93 in order to retain the vibration element 131 and the suspension edge member 132 of the second passive vibrator 14 in the second mounting through hole 932 of the second shell 93.

In other embodiments of the loudspeaker box 1000C of the present invention, the first shell 92 having the first mounting through hole 921 is prepared first, and then the first shell 92 and the vibration element 131 for retaining in the first mounting through hole 921 of the first shell 92 are both placed in the molding mould. Also, both the fringe of the first shell 92 for forming the first mounting through hole 921 and the outer edge of the vibration element 131 are extended in the forming space of the molding mould. Next, a raw forming material is filled into the forming space of the molding mould to cover, enclose and package the fringe of the first shell 92 for forming the first mounting through hole 921 and the outer edge of the vibration element 131 positioned in the forming space of the molding mould, so as to integrally combine with first shell 92 and the vibration element 131 to form the suspension edge member 132 after the forming material is solidified. As a result, the vibration element 131 and the suspension edge member 132 of the first passive vibrator 13 are retained in the first mounting through hole 921 of the first shell 92. It is appreciated that a portion of the first shell 92 substantially forms the framework 133 of the first passive vibrator 13.

Correspondingly, by means of the method described above, the second passive vibrator 14 and the second shell 93 can be integrally made while a portion of the second shell 93 forming the framework 133 of the second passive vibrator 14.

In addition, the first shell 92 has a main speaker mounting through hole 922 for mounting the main vibration speaker 100C, so as to install the main vibration speaker 100C on the first shell 92. Certainly, person skilled in the art should be able to understand that, in other embodiments of the loudspeaker box 1000C of the present invention, the main vibration speaker 100C may also integrally couple with the first shell 92 or that a portion of the main vibration speaker 100C can be integrally couple with the first shell 92.

Then, the first shell 92 and the second shell 93 are assembled together and define the vibration chamber 91 between the first shell 92 and the second shell 93, wherein the main vibration speaker 100C and the first passive vibrator 13 arranged on the first shell 92 and the second passive vibrator 14 arranged on the second shell 93 share the vibration chamber 91. Accordingly, when the main vibration speaker 100C vibrates in response to the audio signal input to produce sound, both the first passive vibrator 13 and the second passive vibrator 14 vibrate simultaneously in response to the vibration of the main vibration speaker 100C to produce auxiliary sound effects for enhancing the low frequency sound effect of the loudspeaker box 1000C.

Referring to FIGS. 29 and 30, each of the suspension edge member 132 of the first passive vibrator 13 and the second passive vibrator 14 has an arch shaped cross section. That is, the suspension edge member 132 has a protruding side 1323 and an indenting side 1324. The protruding side 1323 and the indenting side 1324 of the suspension edge member 132 are configured in a correspondence manner. It is understandable that the protruding side 1323 and the indenting side 1324 of the suspension edge member 132 are integrally formed at the same time when the suspension edge member 132 is made. Preferably, the indenting side 1324 of the suspension edge member 132 of the first passive vibrator 13 is arranged correspondingly with the indenting side 1324 of the suspension edge member 132 of the second passive vibrator 14 in a face to face manner. In other words, the protruding side 1323 of the suspension edge member 132 of the first passive vibrator 13 faces the outside of the first shell 92 as well as the protruding side 1323 of the suspension edge member 132 of the second passive vibrator 14 faces the outside of the second shell 93.

Figure 32:
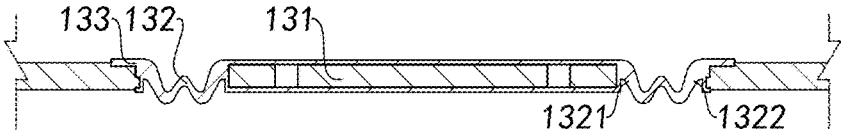
FIG. 32 is a sectional view illustrating an alternative mode of a passive vibrator of the loudspeaker box according to the above preferred embodiments of the present invention.
Figure 33:
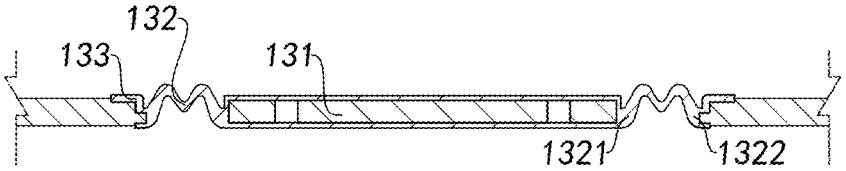
FIG. 33 is a sectional view illustrating another alternative mode of a passive vibrator of the loudspeaker box according to the above preferred embodiments of the present invention.
Figure 34:
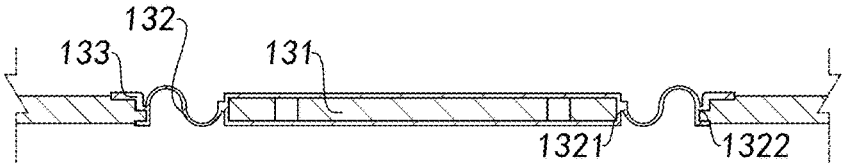
FIG. 34 is a sectional view illustrating another alternative mode of a passive vibrator of the loudspeaker box according to the above preferred embodiments of the present invention.
Figure 35:
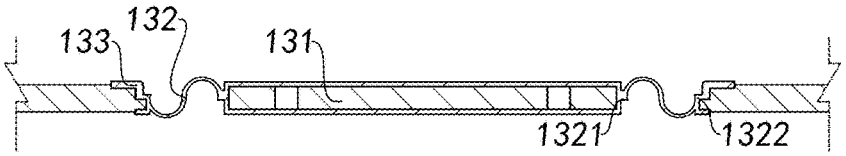
FIG. 35 is a sectional view illustrating a passive vibrator of the loudspeaker box according to the second alternative mode of the above preferred embodiments of the present invention.
Figure 36:
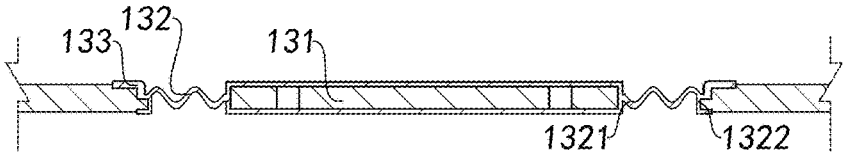
FIG. 36 is a sectional view illustrating another alternative mode of a passive vibrator of the loudspeaker box according to the above preferred embodiments of the present invention.
Figure 37:
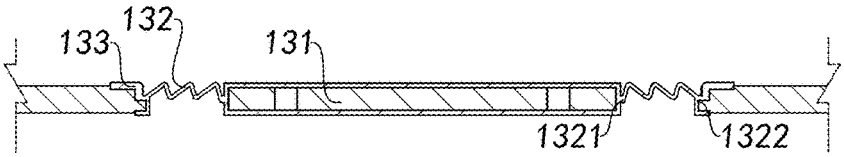
FIG. 37 is a sectional view illustrating another alternative mode of a passive vibrator of the loudspeaker box according to the above preferred embodiments of the present invention.

It is worth mentioning that, according to an alternative mode of the loudspeaker box 1000C as illustrated in FIG. 32, the cross-sectional shape of the suspension edge member 132 of the first passive vibrator 13 and the second passive vibrator 14 can also be made in a W shape. According to another alternative mode of the loudspeaker box 1000C as illustrated in FIG. 33, the cross-sectional shape of the suspension edge member 132 of the first passive vibrator 13 and the second passive vibrator 14 can also be made in an M shape. According to another alternative mode of the loudspeaker box 1000C as illustrated in FIG. 34, the cross-sectional shape of the suspension edge member 132 of the first passive vibrator 13 and the second passive vibrator 14 can also be made in an S shape. According to another alternative mode of the loudspeaker box 1000C as illustrated in FIG. 35, the cross-sectional shape of the suspension edge member 132 of the first passive vibrator 13 and the second passive vibrator 14 can also be made in an inverted S shape. According to another alternative mode of the loudspeaker box 1000C as illustrated in FIG. 36, the cross-sectional shape of the suspension edge member 132 of the first passive vibrator 13 and the second passive vibrator 14 can also be made in a wavy shape. According to another alternative mode of the loudspeaker box 1000C as illustrated in FIG. 37, the cross-sectional shape of the suspension edge member 132 of the first passive vibrator 13 and the second passive vibrator 14 can also be made in a zigzag shape. Nevertheless, person skilled in the art should be able to understand that, for the loudspeaker box 1000C of other embodiments, the cross sectional shapes of the suspension edge member 132 may also include V-shape, inverted V-shape, U-shape, inverted U-shape, and etc.

Figure 38:
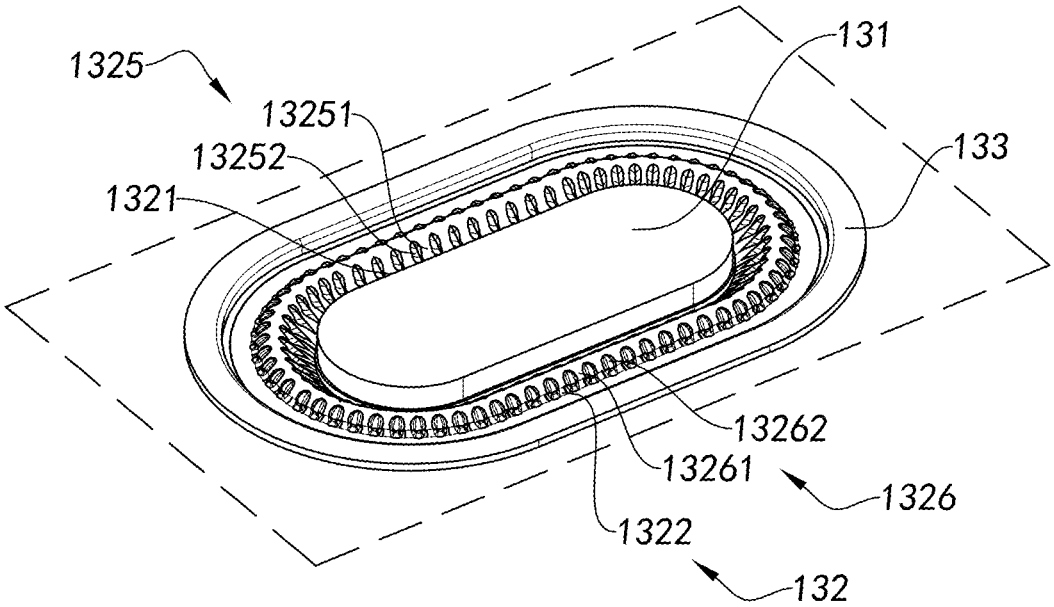
FIG. 38 is a perspective view of a passive vibrator of the loudspeaker box according to another alternative mode of the above preferred embodiments of the present invention.
Figure 39:
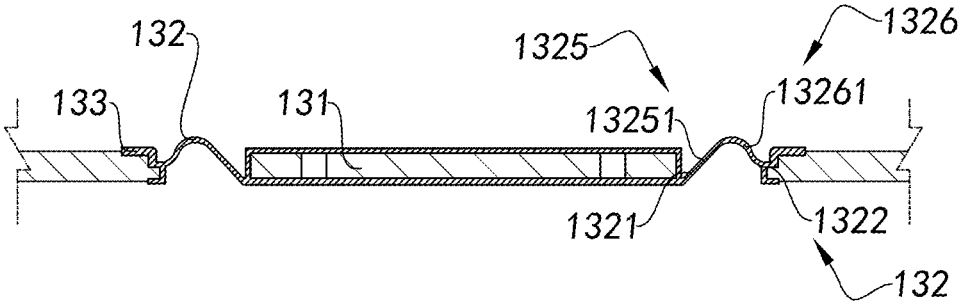
FIG. 39 is a sectional view illustrating another alternative mode a passive vibrator of the loudspeaker box according to the above preferred embodiments of the present invention.

According to another alternative mode of the loudspeaker box 1000C as illustrated in FIGS. 38 and 39, the suspension edge member 132 further comprises an inner suspension edge member portion 1325 and an outer suspension edge member portion 1326. The inner suspension edge member portion 1325 and the outer suspension edge member portion 1326 of the suspension edge member 132 are integrally formed, wherein the cross-sectional shape of the suspension edge member 132 is able to be made in an arch shape or other shapes. The free fringe of the inner suspension edge member portion 1325 of the suspension edge member 132 forms the inner fringe 1321 of the suspension edge member 132. The free fringe of the outer suspension edge member portion 1326 of the suspension edge member 132 forms the outer fringe 1322 of the suspension edge member 132.

The inner suspension edge member portion 1325 of the suspension edge member 132 comprises an inner suspension body 13251 and a plurality of inner resilient ribs 13252. The inner resilient ribs 13252 are spacedly and annularly provided on the inner suspension body 13251. Alternatively, the inner resilient ribs 13252 are spacedly, annularly and integrally arranged along the inner suspension body 13251. Also, the inner resilient ribs 13252 protrude from the surface of the inner suspension body 13251, such that the inner resilient ribs 13252 form first protruding bodies 132521 on a side of the inner suspension edge member portion 1325 respectively and form first grooves 132522 on the other side of the inner suspension edge member portion 1325 respectively. In other words, each of the inner resilient ribs 13252 protrudes from the plane surface of the inner suspension body 13251 at the side of the inner suspension edge member portion 1325 and indents from the plane surface of the inner suspension body 13251 at the other side of the inner suspension edge member portion 1325.

It is worth mentioning that each of the inner resilient ribs 13252 may also downwardly protrudes from the plane surface of the inner suspension body 13251, so as to form the first protruding body 132521 on the lower side of the inner suspension edge member portion 1325 and form the first groove 132522 on the upper side of the inner suspension edge member portion 1325, alternatively.

Preferably, two adjacent inner resilient ribs 13252 are spacedly arranged with each other and a plurality of the inner resilient ribs 13252 are radially and evenly arranged around the vibration element 131, so as to limit the up and down vibration direction of the vibration element in the axial direction thereof (the Z-axis direction as illustrated in FIG. 25A illustrated). Correspondingly, the outer suspension edge member portion 1326 of the suspension edge member 132 comprises an outer suspension body 13261 and a plurality of outer resilient ribs 13262. The outer resilient ribs 13262 are spacedly and annularly provided on the outer suspension body 13261. Alternatively, the outer resilient ribs 13262 are spacedly, annularly and integrally arranged on the outer suspension body 13261. The outer resilient ribs 13262 protrude from the surface of the outer suspension body 13261, such that the outer resilient ribs 13262 form the second protruding bodies 132621 on a side of the outer suspension edge member portion 1326 respectively and form second grooves 132622 on the other side of the outer suspension edge member portion 1326 respectively. In other words, each of the outer resilient ribs 13262 protrudes from the plane surface of the outer suspension body 13261 at the side of the outer suspension edge member portion 1326 and indents from the plane surface of the outer suspension body 13261 at the other side of the outer suspension edge member portion 1326.

It is worth mentioning that each of the outer resilient ribs 13262 may also downwardly protrudes from the plane surface of the outer suspension body 13261, so as to form the second protruding body 132621 on the lower side of the outer suspension edge member portion 1326 and form the second groove 132622 on the upper side of the outer suspension edge member portion 1326, alternatively.

Preferably, two adjacent outer resilient rib 13262 are spacedly arranged with each other and a plurality of the outer resilient ribs 13262 are radially and evenly arranged around the vibration element 131, so as to limit the up and down vibration direction of the vibration element in the axial direction of the vibration element 131 (the Z-axis direction as illustrated in FIG. 25A).

It is worth mentioning that the inner resilient ribs 13252 and the outer resilient ribs 13262 can be arranged in a corresponding one-to-one manner. In other words, the inner resilient ribs 13252 of the inner suspension edge member portion 1325 of the suspension edge member 132 and the outer resilient ribs 13262 of the outer suspension edge member portion 1326 are arranged and matched respectively and correspondingly with each other in a corresponding one-to-one manner. Such that, the suspension edge member 132 can comprise many sets of resilient ribs, wherein each set of the resilient ribs respectively comprises one inner resilient rib 13252 of the inner suspension edge member portion 1325 and one outer resilient rib 13262 of the outer suspension edge member portion 1326. The resilient ribs are alternately and spacedly arranged along an annular direction. It is understandable that each set of the resilient ribs is arranged and shaped corresponding and consistent with the shape of the suspension edge member 132. For example, when the suspension edge member 132 is in approximately annular shape, the resilient ribs may be arranged along a radial direction.

Figure 40:
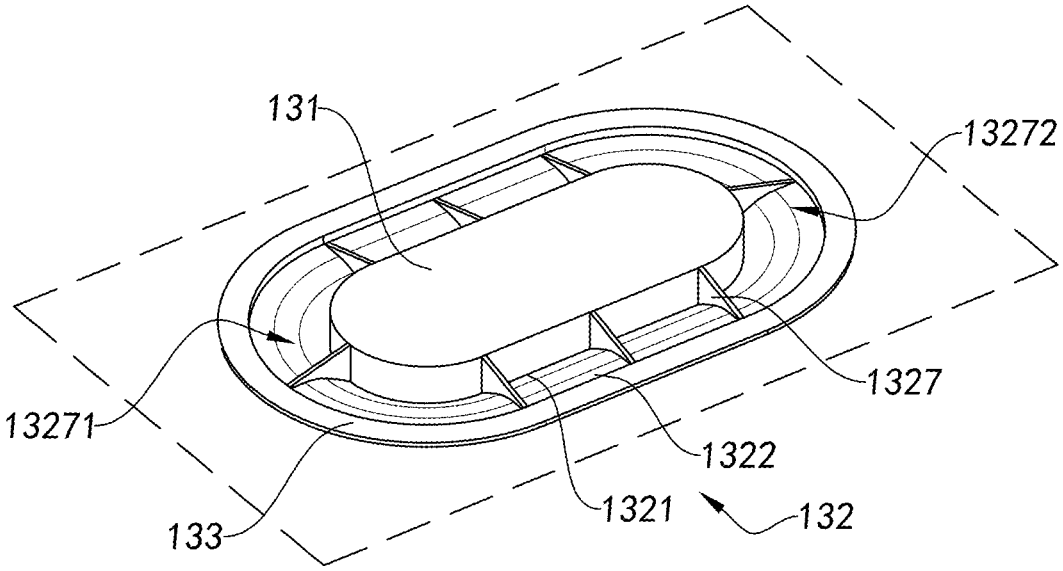
FIG. 40 is a perspective view illustrating another alternative mode of a passive vibrator of the loudspeaker box according to the above preferred embodiments of the present invention.
Figure 41:
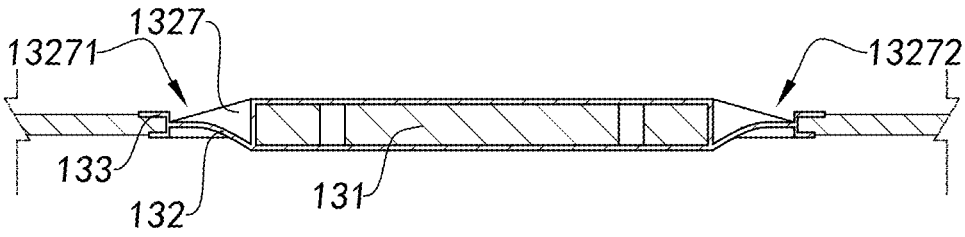
FIG. 41 is a sectional view illustrating another alternative mode of a passive vibrator of the loudspeaker box according to the above preferred embodiments of the present invention.

According to another alternative mode of the loudspeaker box 1000C as illustrated in FIGS. 40 and 41, the suspension edge member 132 has a plurality of spacing and enforcing ribs 1327 arranged on the surface thereof. Each of the spacing and enforcing ribs 1327 integrally extends between the vibration element 131 and the framework 133, so as to form an ups and downs structure between the vibration element 131 and the framework 133.

The spacing and enforcing ribs 1327 of the suspension edge member 132 are arranged for reinforcing a restricting and limiting function of the suspension edge member 132, so as to prevent the vibration element 131 from deviating from an axial direction of the vibration element 131 (the Z-axis direction as illustrated in FIG. 25A) during vibrating. Specifically, when the vibration element 131 vibrating along its axial direction (the Z-axis direction as illustrated in FIG. 25A) is going to deviate from the Z axis and be offsetting and displacing, the corresponding spacing and enforcing ribs 1327 would provide an opposite pulling force to counterbalance and cancel out the offset force of the vibration element 131.

It is worth mentioning that the spacing and enforcing ribs 1327 are able to be extended along a perpendicular direction to an outer peripheral surface of the corresponding vibration element 131 and an inner peripheral surface of the corresponding framework 133, as illustrated in FIG. 40. In other embodiments, the spacing and enforcing ribs 1327 may also be extended obliquely or along the radial direction of the vibration element 131. Such arrangements of the spacing and enforcing ribs 1327 may provide corresponding pulling forces along these directions, so as to prevent the vibration element 131 from offsetting to and displacing from these directions.

It is also worth mentioning that the spacing and enforcing ribs 1327 can be evenly arranged around the vibration element 131 and symmetrically arranged to regard the vibration element 131 as the center. According to the embodiment as illustrated in FIG. 40, the spacing and enforcing rib 1327 comprises a left spacing and enforcing rib 13271 and a right spacing and enforcing rib 13272. When the vibration element 131 moves reciprocatingly up and down along its axial direction (the Z-axis direction as FIG. 25A illustrated), if the vibration element 131 is going to be offsetting or shifting to the left, an opposite pulling force will be applied through the right spacing ribs 13272 to counter-balance and cancel out the offsetting or shifting of the vibration element 131, such that the left offsetting or shifting of the vibration element 131 can be prevent. On the contrary, if the vibration element 131 is offsetting or shifting to the right, a pulling force in the opposite direction will be applied through the left spacing and enforcing ribs 13271, such that the left offset or shift of the vibration element 131 can be prevented. Accordingly, the suspension edge member 132 can effectively restrict and limit the vibration direction of the vibration element 131 along its axial direction (the Z-axis direction as illustrated in FIG. 25A).

Figure 42:
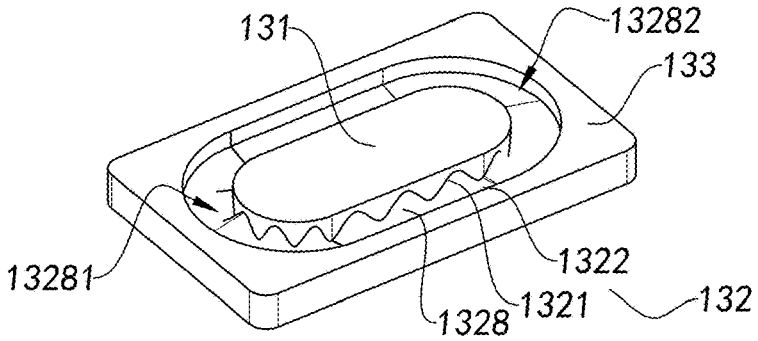
FIG. 42 is a perspective view illustrating another alternative mode of a passive vibrator of the loudspeaker box according to the above preferred embodiments of the present invention.
Figure 43:
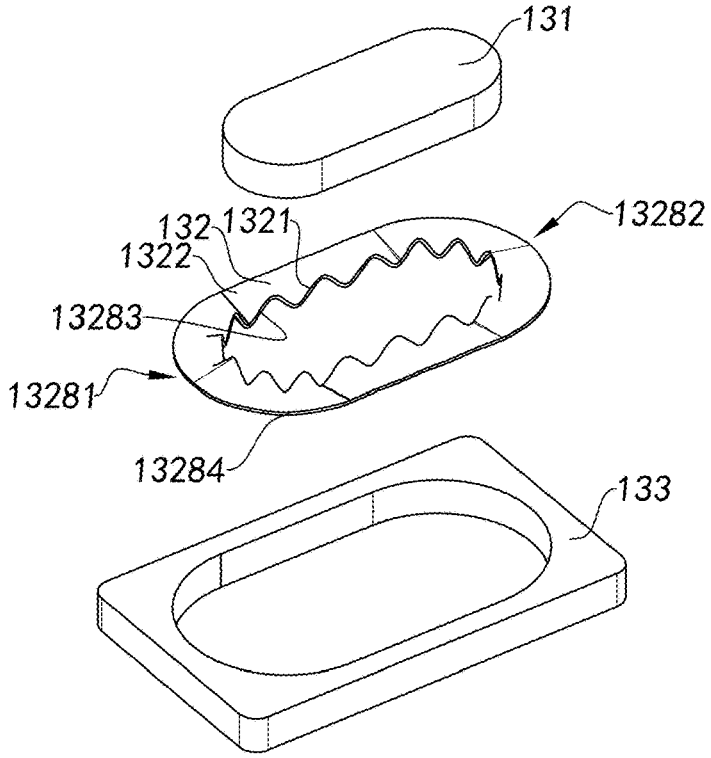
FIG. 43 is an exploded view of the passive vibrator of the loudspeaker box according to the above alternative mode of the above preferred embodiments of the present invention.
Figure 44:
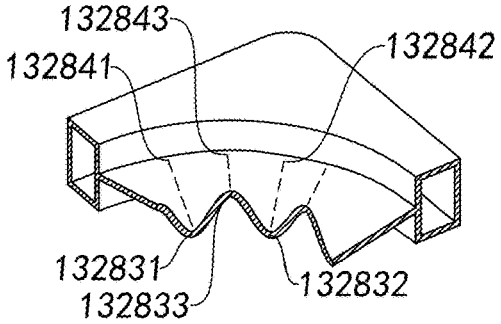
FIG. 44 is a partially sectional perspective view of a portion of the passive vibrator of the loudspeaker box according to the above alternative mode of the above preferred embodiments of the present invention.

According to another alternative mode of the loudspeaker box 1000C as illustrated in FIGS. 42-44, the suspension edge member 132 is in wavy shape and comprises a plurality of wavy spacing segments 1328 continuously arranged along a circumference direction of the suspension edge member 132, such that the wavy spacing segments 1328 integrally connect with each other to form a wavy structure around the vibration element 131.

The wavy spacing segments 1328 of the suspension edge member 132 are adapted for restricting and limiting function to prevent the vibration element 131 from offsetting or deviating when it is vibrating along its axial direction (the Z-axis direction as illustrated in FIG. 25A). In particular, when the vibration element 131 is going to deviate from the axial direction (the Z-axis direction) of and offset or shift toward another direction, one or more the corresponding wavy spacing segments 1328 will provide an opposite pulling force to counter-balance and cancel out the offset force of the vibration element 131. It is worth mentioning that the wavy spacing segment 1328 can be evenly arranged around the vibration element 131 and symmetrically arranged to regard the vibration element 131 as the center.

Referring to FIG. 42, the wavy spacing segments 1328 of the suspension edge member 132 comprises a left wavy spacing segment 13281 and a right wavy spacing segment 13282. When the first passive vibrator 13 responds to the vibration of the main vibration speaker 100C to be driven to vibrate, the vibration element 131 will move reciprocatingly up and down along its axial direction (the Z-axis direction as FIG. 25A illustrated). If the vibration element 131 is going to be offsetting or shifting to the left, an opposite pulling force is applied through the right wavy spacing segment 13282 to counter-balance and cancel out the offsetting or shifting of the vibration element 131, such that the left offsetting or shifting of the vibration element 131 can be prevent. On the contrary, if the vibration element 131 is offsetting or shifting to the right, a pulling force in the opposite direction will be applied through the left wavy spacing segment 13281, such that the left offset or shift of the vibration element 131 can be prevented. Accordingly, the suspension edge member 132 can effectively restrict and limit the vibration direction of the vibration element 131 along its axial direction (the Z-axis direction as illustrated in FIG. 25A).

Besides, each of the wavy spacing segments 1328 of the suspension edge member 132 comprises a vibration element coupling end 13283 and a framework coupling end 13284. The cross-sectional shape of the vibration element coupling end 13283 along the circumference direction can be in arch shape. In addition, the vibration element coupling end 22283L is connected with the outer edge of the vibration element 131, wherein the framework coupling end 13284 is utilized for connecting with the framework 133.

Further, the vibration element coupling end 13283 has two lower junctions 132831, 132832 and an upper junction 132833, wherein the connecting lines among the two lower junctions 132831, 132832 and the upper junction 132833 can be in a triangular shape. Then, there are three junctions 132841, 132842 and 132843 provided through extending the two lower junctions 132831, 132832 and the upper junction 132833 toward the fringe of the framework 133. These three junctions 132841, 132842, and 132843 are all formed on the framework coupling end 13284. Besides, the connecting lines among these three junctions 132841, 132842 and 132843 are extended along the fringe of the framework 133 in a curvy manner. In other words, according to this embodiment, the wavy spacing segment 1328 has an inner periphery and an outer periphery. The inner periphery connected with the outer edge of the vibration element 131 has a wavy or arch shape. The outer periphery connected with the fringe of the framework 133 has a curvy shape and is on the same plane to the central axis that is perpendicular to the vibration element 131.

Figure 45:
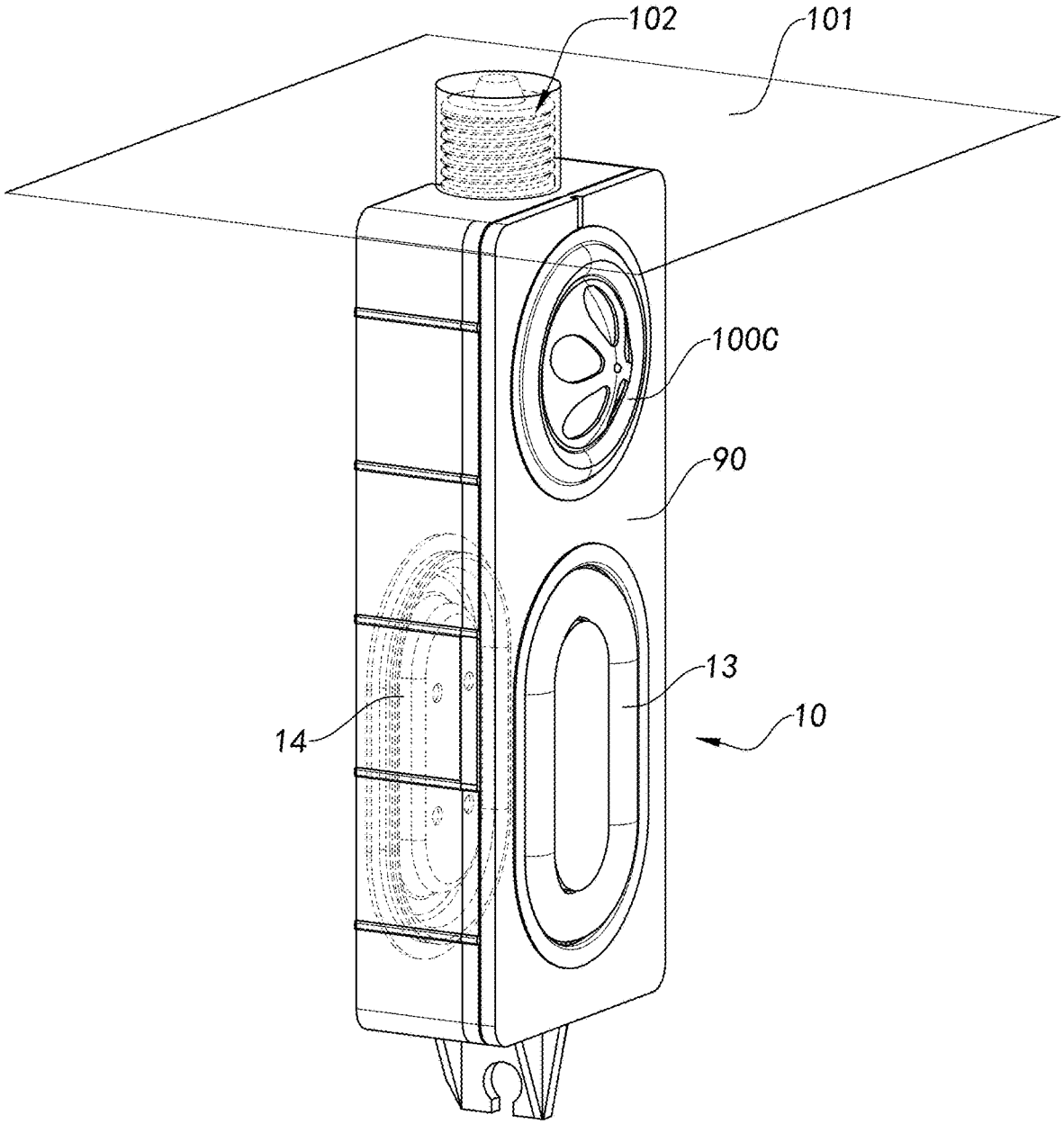
FIG. 45 is a perspective view of a loudspeaker box in a working condition according to the above preferred embodiments of the present invention.

FIG. 45 illustrates a specific manner of the application of the loudspeaker box 1000C, wherein the loudspeaker box 1000C is able to be mounted on an attaching member 101 through hanging. The attaching member 101 may be embodied to be, for example but not limited to, a ceiling and etc., so as to affix the loudspeaker box 1000C in an utilizing environment.

Specifically, the attaching member 101 may comprise an electric power supplying mechanism 102 adapted to affix the loudspeaker box 1000C to the attaching member 101 by mounting the loudspeaker box 1000C on the electric power supplying mechanism 102. In one embodiment, the electric power supplying mechanism 102 may be embodied to be, for example but not limited to, the electric power supplying mechanism of a lamp, such that the electric power supplying mechanism 102 is capable of supplying external electric power to the loudspeaker box 1000C after the loudspeaker box 1000C was installed with the electric power supplying mechanism 102. In one embodiment, the electric power supplying mechanism 102 can be an electric power supplying mechanism specifically designed for the loudspeaker box 1000C, such that when the loudspeaker box 1000C is mounted on the electric power supplying mechanism 102, the electric power supplying mechanism 102 is capable of not only supplying external electric power to the loudspeaker box 1000C, but also inputting audio signals to the main vibration speaker 100C of the loudspeaker box 1000C, so as to allow the main vibration speaker 100C responding to the audio signal input to vibrate and produce sound. At this time, the first passive vibrator 13 and the second passive vibrator 14 of the radiation device 10 vibrate in response to the vibration of the main vibration speaker 100C so as to produce auxiliary sound effects. When the first passive vibrator 13 and the second passive vibrator 14 of the radiation device 10 of the present invention are responding to the vibration of the main vibration speaker 100C to vibrate at the same time, the vibration directions of the first passive vibrator 13 and the second passive vibrator 14 are opposite to each other, so as to counter-balance and cancel out the shifting and displacement tendency from occurring on the loudspeaker box 1000C and to avoid shaking from occurring on the loudspeaker box 1000C, such that a purer sound effect of the loudspeaker box 1000C can be ensured.

More specifically, when the first passive vibrator 13 responds to the vibration of the main vibration speaker 100C to move upward along its axial direction (the Z-axis direction as illustrated in FIG. 25A), the first passive vibrator 13 has a tendency to bring the loudspeaker box 1000C to move upward. At the meantime, the second passive vibrator 14 responds to the vibration of the main vibration speaker 100C to move downward along its axial direction (the Z-axis direction as illustrated in FIG. 25A), the second passive vibrator 14 has a tendency to bring the loudspeaker box 1000C to move downward. As a result, the tendency of the first passive vibrator 13 to bring the loudspeaker box 1000C to move upward and the tendency of the second passive vibrator 14 to bring the loudspeaker box 1000C to move downward will counter-balance and cancel out with each other, which avoids the loudspeaker box 1000C from unpleasant situation like shaking and shifting, such that the purity of sound of the loudspeaker box 1000C can be guaranteed.

It is understandable that when the loudspeaker box 1000C is directly placed on a desk or countertop for use, this configuration and arrangement of the first passive vibrator 13 and the second passive vibrator 14 provided by the radiation device 10 allows the loudspeaker box 1000C to avoid unpleasant situation like shifting due to shaking, so as to ensure the purity of sound of the loudspeaker box 1000C.

Figure 46:
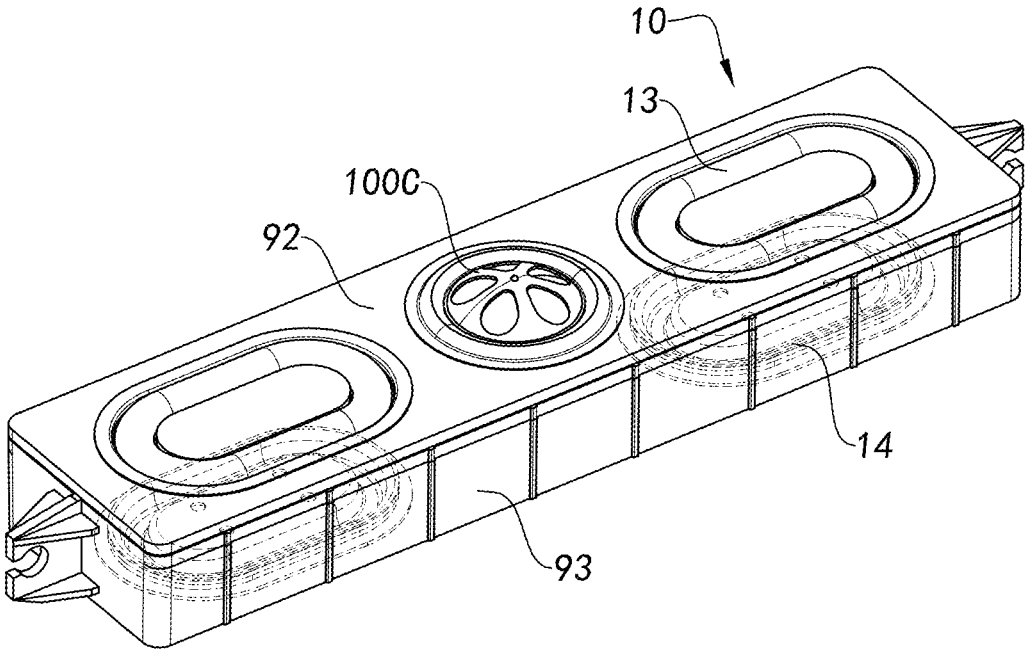
FIG. 46 is a perspective view of a loudspeaker box according to a third alternative mode of the above third preferred embodiment of the present invention.

According to an alternative mode of the loudspeaker box 1000C as illustrated in FIG. 46, the quantity of the radiation device 10 can be embodied as two or more, wherein the radiation devices 10 can be symmetrically arranged on two sides of the main vibration speaker 100C. For example, according to the embodiment as illustrated in FIG. 46, the main vibration speaker 100C can be arranged in the middle of the mounting shell 90, while the two radiation devices 10 are respectively arranged on two sides of the mounting shell 90 to have the two radiation devices 10 symmetrically arranged on two sides of the main vibration speaker 100C.

Figure 47:
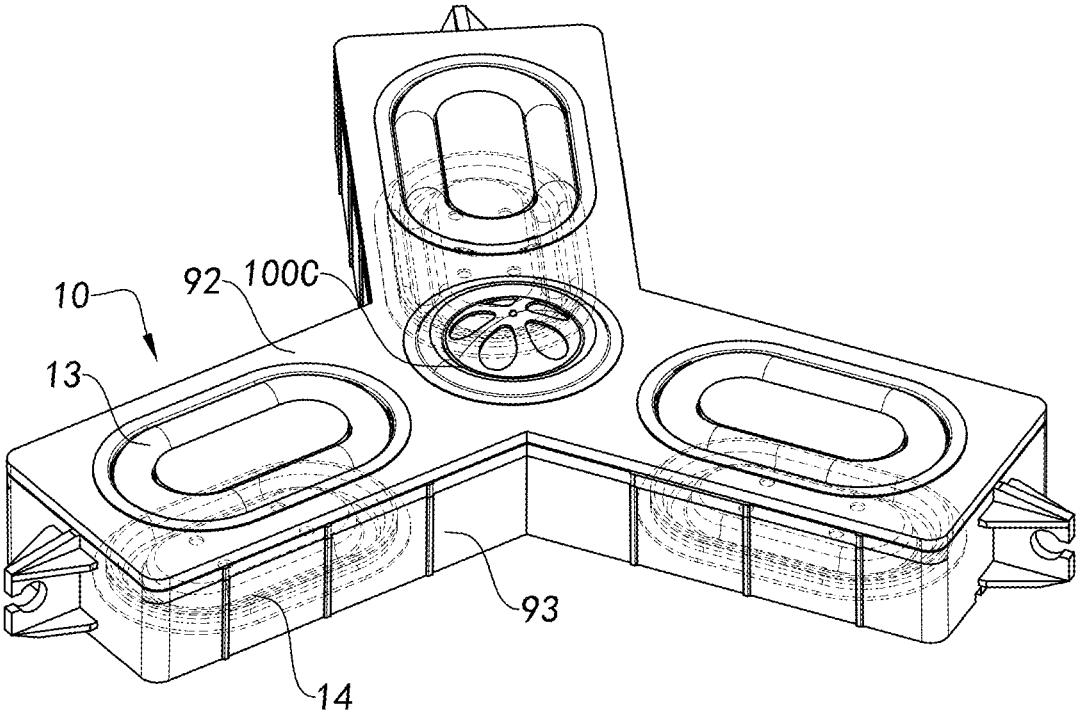
FIG. 47 is a perspective view of a loudspeaker box according to a fourth alternative mode of the above third preferred embodiment of the present invention.

According to another alternative mode of the loudspeaker box 1000C as illustrated in FIG. 47, the quantity of the radiation device 10 can be embodied as three or more, wherein the radiation devices 10 are respectively arranged around a periphery of the main vibration speaker 100C. Preferably, the distance between each of the radiation devices 10 and the main vibration speaker 100C is equal. Optionally, the distances between adjacent radiation devices 10 are equal as well.

Figure 48:
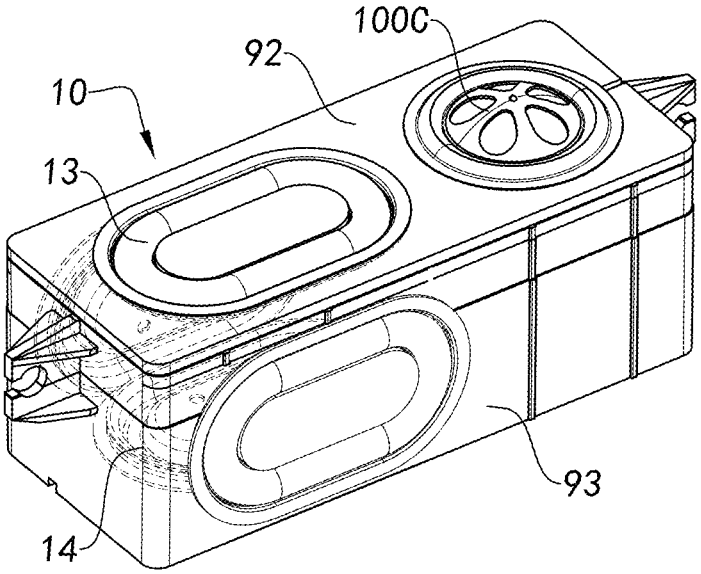
FIG. 48 is a perspective view of a loudspeaker box according to a fifth alternative mode of the above third preferred embodiment of the present invention.

According to an alternative mode of the loudspeaker box 1000C as illustrated in FIG. 48, the first passive vibrator 13 and the second passive vibrator 14 of one of the radiation device 10 are arranged in a back-to-back manner on the upper side and lower side of the mounting shell 90 respectively, while the first passive vibrator 13 and the second passive vibrator 14 of another one of the radiation device 10 are arranged in a back-to-back manner on the left side and right side of the mounting shell 90 respectively, such that the main vibration speaker 100C and the first passive vibrators 13 and the second passive vibrators 14 of both the radiation devices 10 share the vibration chamber 91. Accordingly, when the main vibration speaker 100C responds to the audio signal input to vibrate to produce sound, the first passive vibrators 13 and the second passive vibrators 14 of both the radiation devices 10 all respond to the vibration of the main vibration speaker 100C to vibrate to produce auxiliary sound effects. In addition, during this process, the vibration directions of the first passive vibrators 13 and the second passive vibrators 14 of each of the radiation devices 10 are opposite, so as to counter-balance and cancel out the shifting and displacement tendencies of the loudspeaker box 1000C rendered by the vibrations and avoid the loudspeaker box 1000C from shaking, such that the sound effect of the loudspeaker box 1000C can be ensured.

Person skilled in the art should be able to understand that the above embodiments are just examples and the features of different embodiments may also be exchanged and combined, so as to obtain obvious implementations that have not been specified in the drawings according to the disclosed content of the present invention.

According to another aspect of the present invention, the present invention further provides a manufacturing method of a loudspeaker box 1000C, which comprises the following steps:

(a) respectively providing a main vibration speaker 100C and at least two passive vibrators 21 and 22; and (b) arranging the main vibration speaker 100C and the passive vibrators 21, 22 to share a vibration chamber 91, wherein the vibration direction of at least one of the passive vibrators 21 or 22 is opposite to the vibration direction of the other passive vibrators 21 or 22.

According to another aspect of the present invention, the present invention further provides an operating method of a loudspeaker box, which comprises the following steps:

(A) inputting an audio signal to a main vibration speaker 100C, so as to enable the main vibration speaker 100C to respond to the audio signal input to vibrate and produce sound; and (B) enabling two passive vibrators 21 and 22, arranged in a back-to-back manner, to simultaneously respond to the vibration of the main vibration speaker 100C to vibrate in opposite directions to produce auxiliary sound effect.

One skilled in the art will understand that the embodiment of the present invention as shown in the drawings and described above is exemplary only and not intended to be limiting.

Objectives of the present invention are completely and effectively implemented. Notions of the functions and structures of the present invention have been shown and described in the embodiments, whereas implementations of the present invention may have modifications or changes in any ways without going against the above notions.

What is claimed is:

1. A radiation device for vibrating to produce sound, comprising:

at least an annular outer supporting frame;

at least a vibration element;

at least an annular first suspension edge member made of resilient material and extended between said vibration element and said outer supporting frame so as to connect said vibration element with said outer supporting frame;

at least an inner frame, connected with said vibration element; and at least an annular second suspension edge member made of resilient material and connected between said inner frame and said outer supporting frame, wherein said first suspension edge member and said second suspension edge member are symmetrically and coaxially arranged in a back to back manner, such that when said vibration element is vibrating reciprocatingly, said first and second suspension edge members cushion and buffer any offset force of said vibration element during vibration to retain said vibration element moving back and forth along an axial direction thereof, wherein said outer supporting frame comprises a supporting frame coupling portion connecting with an annular outer edge of said first suspension edge member, an annular outer holding frame connected with an annular outer edge of said second suspension edge member, and a body frame extended between said supporting frame coupling portion and said outer holding frame, so as to support said second suspension edge member in a back to back manner with said first suspension edge member along coaxially.

2. The radiation device, as recited in claim 1, wherein said inner frame is a hollow body having one end connected to a bottom side of said vibration element, wherein said second suspension edge member surrounds around an outer side wall of said inner frame.

3. The radiation device, as recited in claim 2, wherein said inner frame comprises at least a connecting portion and at least an inner holding frame, wherein said connecting portion is connected with said bottom side of said vibration element, wherein said inner holding frame is laterally extended to said connecting portion, wherein said second suspension edge member is extended between said inner holding frame and said outer holding frame.

4. The radiation device, as recited in claim 2, wherein said inner frame is supported between said first and second suspension edge members, wherein said first suspension edge member surrounds around a fringe of said vibration element and said second suspension edge member surrounds around said inner frame.

5. The radiation device, as recited in claim 3, wherein said inner frame is supported between said first and second suspension edge members, wherein said first suspension edge member surrounds around a fringe of said vibration element and said second suspension edge member surrounds around said inner frame.

6. The radiation device, as recited in claim 1, wherein a cross section of each of said first and second suspension edge members has an arch shape defining a protruding side and an indenting side, wherein said indenting sides of said first suspension edge member and said second suspension edge member are arranged in a face to face manner along an axis of said vibration element.

7. The radiation device, as recited in claim 1, wherein each of said first and second suspension edge members has a curvy shape selected from the group consisting of W-shape, M-shape, S-shape, inverted S-shape, V-shape, inverted V-shape, U-shape, inverted U-shape, wavy, and zigzag.

8. A radiation device for vibrating to produce sound, comprising:

at least an annular outer supporting frame;

at least a vibration element;

at least an annular first suspension edge member made of resilient material and extended between said vibration element and said outer supporting frame so as to connect said vibration element with said outer supporting frame;

at least one inner frame, connected with said vibration element, which is a hollow body having one end connected to a bottom side of said vibration element, wherein said at least one inner frame comprises at least a connecting portion and at least an inner holding frame, wherein said connecting portion is connected with said bottom side of said vibration element, wherein said inner holding frame is laterally extended to said connecting portion; and at least an annular second suspension edge member made of resilient material and connected between said inner frame and said outer supporting frame, wherein said second suspension edge member is extended between said inner holding frame and said outer supporting frame and surrounds around an outer side wall of said inner frame, wherein said first suspension edge member and said second suspension edge member are symmetrically and coaxially arranged in a back to back manner, such that when said vibration element is vibrating reciprocatingly, said first and second suspension edge members cushion and buffer any offset force of said vibration element during vibration to retain said vibration element moving back and forth along an axial direction thereof.

9. The radiation device, as recited in claim 8, wherein said inner frame is supported between said first and second suspension edge members, wherein said first suspension edge member surrounds around a fringe of said vibration element and said second suspension edge member surrounds around said inner frame.

10. A dual suspension edge speaker, comprising at least an annular outer supporting frame;

at least a vibration element;

at least an annular first suspension edge member made of resilient material and extended between said vibration element and said outer supporting frame so as to connect said vibration element with said outer supporting frame;

at least an inner frame connected with said vibration element;

at least an annular second suspension edge member made of resilient material and connected between said inner frame and said outer supporting frame, wherein said first suspension edge member and said second suspension edge member are symmetrically and coaxially arranged in a back to back manner;

a magnetic system; and a voice coil coaxially coupled with vibration element; and a magnetic system arranged to drive said voice coil to move reciprocatingly under an effect of an electromagnetic driving force of said magnetic system so as to drive said vibration element to vibrate reciprocatingly to produce sound, wherein said first and second suspension edge members cushion and buffer any offset force of said vibration element during vibration to retain said vibration element moving back and forth along an axial direction thereof, wherein said outer supporting frame comprises a supporting frame coupling portion connecting with an annular outer edge of said first suspension edge member, an annular outer holding frame connected with an annular outer edge of said second suspension edge member, and a body frame extended between said supporting frame coupling portion and said outer holding frame, so as to support said second suspension edge member in a back to back manner with said first suspension edge member along coaxially.

11. The dual suspension edge speaker, as recited in claim 10, wherein said inner frame is a hollow body having one end connected to a bottom side of said vibration element, wherein said second suspension edge member surrounds around an outer side wall of said inner frame.

12. The dual suspension edge speaker, as recited in claim 11, wherein said inner frame comprises at least a connecting portion and at least an inner holding frame, wherein said connecting portion is connected with said bottom side of said vibration element, wherein said inner holding frame is laterally extended to said connecting portion, wherein said second suspension edge member is extended between said inner holding frame and said outer holding frame.

13. The dual suspension edge speaker, as recited in claim 11, wherein said inner frame is supported between said first and second suspension edge members, wherein said first suspension edge member surrounds around a fringe of said vibration element and said second suspension edge member surrounds around said inner frame.

14. The dual suspension edge speaker, as recited in claim 12, wherein said inner frame is supported between said first and second suspension edge members, wherein said first suspension edge member surrounds around a fringe of said vibration element and said second suspension edge member surrounds around said inner frame.

15. The dual suspension edge speaker, as recited in claim 10, wherein a cross section of each of said first and second suspension edge members has an arch shape defining a protruding side and an indenting side, wherein said indenting sides of said first suspension edge member and said second suspension edge member are arranged in a face to face manner along an axis of said vibration element.

16. The dual suspension edge speaker, as recited in claim 10, wherein each of said first and second suspension edge members has a curvy shape selected from the group consisting of W-shape, M-shape, S-shape, inverted S-shape, V-shape, inverted V-shape, U-shape, inverted U-shape, wavy, and zigzag.

17. A dual suspension edge speaker, comprising at least an annular outer supporting frame;

at least a vibration element;

at least an annular first suspension edge member made of resilient material and extended between said vibration element and said outer supporting frame so as to connect said vibration element with said outer supporting frame;

at least an inner frame, connected with said vibration element, which is a hollow body having one end connected to a bottom side of said vibration element, wherein said inner frame comprises at least a connecting portion and at least an inner holding frame, wherein said connecting portion is connected with said bottom side of said vibration element, wherein said inner holding frame is laterally extended to said connecting portion;

at least an annular second suspension edge member made of resilient material and connected between said inner frame and said outer supporting frame, wherein said second suspension edge member is extended between said inner holding frame and said outer supporting frame and surrounds around an outer side wall of said inner frame, wherein said first suspension edge member and said second suspension edge member are symmetrically and coaxially arranged in a back to back manner;

a magnetic system; and a voice coil coaxially coupled with vibration element; and a magnetic system arranged to drive said voice coil to move reciprocatingly under an effect of an electromagnetic driving force of said magnetic system so as to drive said vibration element to vibrate reciprocatingly to produce sound, wherein said first and second suspension edge members cushion and buffer any offset force of said vibration element during vibration to retain said vibration element moving back and forth along an axial direction thereof.

18. The dual suspension edge speaker, as recited in claim 17, wherein said inner frame is supported between said first and second suspension edge members, wherein said first suspension edge member surrounds around a fringe of said vibration element and said second suspension edge member surrounds around said inner frame.

* * * * *